US009975612B1

(12) United States Patent
Ellis

(10) Patent No.: US 9,975,612 B1
(45) Date of Patent: May 22, 2018

(54) BODY SURFING HYDROFOIL WITH DEPLOYABLE WINGS AND EXTENDABLE LEG FINS

(71) Applicant: Surface Wings, LLC, Deltona, FL (US)

(72) Inventor: Dale Ellis, Deltona, FL (US)

( * ) Notice: Subject to any disclaimer, the term of this patent is extended or adjusted under 35 U.S.C. 154(b) by 0 days. days.

(21) Appl. No.: 15/257,489

(22) Filed: Sep. 6, 2016

Related U.S. Application Data

(63) Continuation-in-part of application No. 14/473,120, filed on Aug. 29, 2014, now Pat. No. 9,694,881, which is a continuation-in-part of application No. 13/328,478, filed on Dec. 16, 2011, now Pat. No. 8,821,203.

(60) Provisional application No. 61/919,085, filed on Dec. 20, 2013, provisional application No. 61/423,879, filed on Dec. 16, 2010, provisional application No. 61/475,999, filed on Apr. 15, 2011, provisional application No. 61/486,029, filed on May 13, 2011.

(51) Int. Cl.
*B63B 35/81* (2006.01)
*B63B 35/79* (2006.01)
*B63B 35/85* (2006.01)

(52) U.S. Cl.
CPC ..... *B63B 35/85* (2013.01); *B63B 2035/7903* (2013.01)

(58) Field of Classification Search
CPC ..... B63B 35/7909; B63B 35/793; B63B 35/7926; B63B 2231/50; B63B 2035/7903; B63B 35/7923
USPC ..... 441/55, 65, 74, 79
See application file for complete search history.

(56) References Cited

U.S. PATENT DOCUMENTS

| | | | |
|---|---|---|---|
| 1,552,603 | A | 9/1925 | Hawks |
| 3,179,963 | A | 4/1965 | Peterson |
| 3,335,441 | A | 8/1967 | Wolfe |
| 3,354,857 | A | 11/1967 | Hobday |
| 3,400,415 | A | 9/1968 | Scheurer |

(Continued)

FOREIGN PATENT DOCUMENTS

| | | |
|---|---|---|
| AU | 60761/96 | 7/1996 |
| FR | 2789651 A1 | 8/2000 |
| WO | 01/83292 A1 | 11/2001 |

OTHER PUBLICATIONS http://www.buzzardbodyboards.co.uk; accessed Aug. 29, 2014.

*Primary Examiner* — Anthony D Wiest
(74) *Attorney, Agent, or Firm* — Allen Dyer Doppelt & Gilchrist

(57) ABSTRACT

A body surfing device comprising a base and a wing attachment, having a wing strut and a wing extension that is rotatable between a deployed position, wherein the wing strut is substantially perpendicular to the base and wing extension, and a stowed position, wherein the wing strut and extension are substantially parallel to the base and the wing strut and extension are nested in a cavity located in the base. The base can also have extendable leg fins that extend between an extended position, wherein the leg fins extend from the back of the base, and a retracted position, wherein the leg fins are substantially nested in leg fins cavities located in the back of the base. The body surfing device may include levers or slide handles that, when actuated, move the wing attachment between the deployed and stowed positions and the leg fins between the extended and retracted positions.

26 Claims, 55 Drawing Sheets

(56) References Cited

U.S. PATENT DOCUMENTS

| | | | |
|---|---|---|---|
| 3,803,652 | A | 4/1974 | Uyehara |
| 4,263,686 | A | 4/1981 | Jarvis, Jr. |
| 4,302,860 | A | 12/1981 | Puch |
| 4,397,636 | A | 8/1983 | Ganshaw |
| 4,437,842 | A | 3/1984 | Connor |
| 4,645,466 | A | 2/1987 | Ellis |
| 4,929,207 | A | 5/1990 | Piatt |
| 4,932,911 | A | 6/1990 | Albrecht |
| 5,013,271 | A | 5/1991 | Bartlett |
| 5,015,208 | A | 5/1991 | Fox et al. |
| 5,055,075 | A | 10/1991 | Waller, Jr. |
| 5,106,331 | A | 4/1992 | Lizarazu |
| D329,633 | S | 9/1992 | Rogers, Jr. |
| 5,167,551 | A | 12/1992 | Davis |
| 5,173,068 | A | 12/1992 | Dunn et al. |
| 5,183,424 | A | 2/1993 | Field |
| 5,516,320 | A | 5/1996 | LaPlant |
| 5,569,057 | A | 10/1996 | Barsdort et al. |
| 6,213,831 | B1 | 4/2001 | Smith |
| 6,544,089 | B2 | 4/2003 | Zapatero Denegri |
| 6,620,010 | B2 | 9/2003 | Noonan |
| 6,986,691 | B2 | 1/2006 | Johnson et al. |
| 7,074,098 | B1 | 7/2006 | Acosta, Jr. |
| 7,144,285 | B1 | 12/2006 | Hendricks |
| 7,232,350 | B1 * | 6/2007 | Krah ..... B63B 35/79 440/21 |
| 7,438,618 | B1 | 10/2008 | Lam |
| 7,438,619 | B2 | 10/2008 | Stayer et al. |
| D607,525 | S | 1/2010 | Marciano |
| 8,216,013 | B1 | 7/2012 | Ellis |
| 8,763,284 | B1 | 7/2014 | Falcone et al. |
| 8,763,551 | B2 * | 7/2014 | Martino ..... F42B 6/10 114/315 |
| 2005/0247248 | A1 * | 11/2005 | Caplan ..... B63B 35/7906 114/66 |
| 2006/0073943 | A1 | 4/2006 | Perka |
| 2008/0020660 | A1 | 1/2008 | Barney |
| 2008/0070458 | A1 | 3/2008 | Crough |
| 2009/0156072 | A1 | 6/2009 | Sick |
| 2011/0151733 | A1 | 6/2011 | Gadler |
| 2013/0178122 | A1 | 7/2013 | LeBlanc |

* cited by examiner

BODY SURFING HYDROFOIL WITH DEPLOYABLE WINGS AND EXTENDABLE LEG FINS

CROSS-REFERENCE TO RELATED APPLICATION

This application is a Continuation-in-Part Application of U.S. patent application Ser. No. 14/473,120, filed Aug. 29, 2014 entitled, "Body Surfing Hydrofoil Base and Attachments", which claims priority to U.S. Provisional Application No. 61/919,085, filed Dec. 20, 2013 entitled, "Hydrofoil Base for Additional Wings and Body Surfing Attachments" and is a continuation-in-part of U.S. patent application Ser. No. 13/328,478, filed Dec. 16, 2011, entitled, "Body Surfing Hydrofoil and Associated Methods" now U.S. Pat. No. 8,821,203 patented on Sep. 2, 2014, which claims the benefit of U.S. Provisional Application No. 61/423,879, filed Dec. 16, 2010, entitled, "Body Surfing Enhancement Device and Associated Methods", U.S. Provisional Application No. 61/475,999, filed Apr. 15, 2011, entitled, "Body Surfing Enhancement Device and Associated Methods", and U.S. Provisional Application No. 61/486,029, filed May 13, 2011, entitled, "Body Surfing Enhancement Device and Associated Methods", the disclosures of which are all hereby incorporated by reference herein in their entirety, and all commonly owned.

FIELD OF INVENTION

The present disclosure generally relates to aquatic sports and more specifically, to apparatuses for body surfing.

BACKGROUND

Surfboards are used to support a person while on top of the surface of water commonly known as "riding" a wave. It is also known to "body surf," that is, to ride a wave without the use of a surfboard by stretching one's body out in as planar a configuration as possible and permitting oneself to be carried ashore by the wave.

Body surfers typically extend their bodies horizontally while projecting their arms forward and allowing a breaking wave to drive them shoreward with the surf. It is important to a body surfer to have a stable ride and to be able to control direction and position on a wave face. Because a body surfer typically avoids using a surf board, it is generally difficult to control stability, direction and position on a wave face. As a result, body surfing suits are popular. For a body surfing suit to work as desired, the suit should allow for ease in bending one's body in all natural directions of movement while swimming and providing buoyancy in a preferred location and position with respect to the surface of the water. Buoyancy should be greatest at the surfer's chest and taper down toward the feet to ensure that the surfer enjoys the safest ride possible. It is also desirable to provide comfort during repeated and multiple rides. It is also desirable that the surfer be allowed to breathe easily during the entire water activity involving swimming, surfing, and vertical or horizontal rest periods.

While few body surfing suits are well known, typically upper body portions do not allow adequate body bending because of a rigid structure being employed and while buoyant materials are used, they are not strategically placed to provide a desirable experience. Further, while fins are employed, they are not typically sized or positioned to provide a synergy with the upper body portion of the suit for enhancing the wave surfing experience.

The present invention seeks to overcome limitations by providing the body surfer a means to stabilize his ride and control his direction and position on a wave while being able to experience multiple events while surfing without over exertion. Further, body surfing is known to be quite difficult and demanding on one's body, especially in more rigorous wave conditions. Therefore, it would be beneficial to provide an apparatus and method that enhances the body surfing experience even in such rigorous conditions.

SUMMARY

In accordance with the teachings disclosed herein, embodiments related to a body surfing device having a deployable wing and extendable leg fins are disclosed.

In an embodiment, the body surfing device comprises a base, a wing strut, and a wing extension. The base has a bottom surface that has a wing extension cavity and a strut cavity therein. The wing strut has a first end that is in rotatable communication with the bottom surface of the base and a second end that is in rotatable communication with the wing extension. The wing extension is substantially parallel to the bottom surface of the base. The wing strut and wing extension are rotatable between a deployed position and a stowed position. In the deployed position, the wing strut is substantially perpendicular to the bottom surface of base and the top surface of the wing extension. In the stowed position, the wing strut and the top surface of the wing extension are substantially parallel to the bottom surface of the base and the wing strut and the wing extension are nested in the wing strut cavity and the wing extension cavity, respectively.

The device may further comprise a separation member positioned on the top surface of the base.

The device may further comprise a secondary wing strut having a first end and a second end. The first end of the secondary wing strut is in rotatable communication with the bottom surface of the base and the second end of the secondary wing strut is in rotatable communication with the wing extension.

The device may further comprise a left leg fin cavity and a right leg fin cavity both positioned in the back side of the base. A right leg fin and a left leg fin are positioned at least partially within the respective right and left leg fin cavities. The right leg fin may have a right leg outer stop protruding from its right side and the left leg fin may have a left leg outer stop protruding from its left side. The right leg fin may have a right leg inner stop protruding from its left side and the left leg fin may have a left leg inner stop protruding from its right side. The right leg fin and the left leg fin may be extendably connected to the base within the right leg fin cavity and left leg fin cavity, respectively, each extending between an extended position and a retracted position. The right leg fin cavity may comprise at least one right leg fin track and left leg fin cavity may comprise at least one left leg fin track. The right leg fin slidingly engages with the at least one right leg fin track and the left leg fin slidingly engages with the at least one left leg fin track.

Alternatively, the device may comprise a single leg fin positioned at least partially within a leg fin cavity. The leg fin may comprise a right leg outer stop protruding from its right side and a left leg outer stop protruding from its left side. The leg fin may be extendably connected to the base within the leg fin cavity and extend between an extended position and a retracted position. The leg fin cavity may comprise at least one fin track and the leg fin may slidingly engage with the leg fin track.

The device may further comprise a left lever and a right lever. The left lever has a first end positioned outside of the base and extends to a second end positioned inside the base. The left lever is in communication with the wing strut. The right lever has a first end positioned outside of the base and extends to a second end positioned inside the base. The right lever is in communication with the wing strut. Actuation of the levers causes the wing strut and the wing extension to move between deployed and stowed positions. If a device includes one or more leg fins, the levers would be in communication with the leg fins and actuation of the levers would cause the leg fins to move between extended and retracted positions.

The device may alternatively comprise a left handle and a right handle. The left handle is slidably engaged in a left handle slot positioned in a top surface of the base. The right handle is slidably engaged in a right handle slot positioned in the top surface of the base. The left slide handle is in communication with left leg fin and extends at least partially through the left handle slot. The right slide handle is in communication with the right leg fin and extends at least partially through the right handle slot. The left leg fin and the right leg fin are in communication with the wing strut. Actuation of the slide handles causes the wing strut and wing extension to move between the deployed position and the stowed position and the left leg fin and the right leg fin to move between the extended position and the retracted position. If the device only includes a single leg fin, the right and left slide handles are in communication with the leg fin and actuation of the slide handles causes the leg fin to move between the extended position and the retracted position.

In another embodiment, the body surfing device comprises a base, a right leg fin and a left leg fin. The base has a back side and a top surface and the back side has a left leg fin cavity and a right leg fin cavity therein. The right leg fin and left leg fin are positioned at least partially within the right leg fin cavity and a left leg fin cavity, respectively. The right leg fin and the left leg fin are extendably connected to the base within the right leg fin cavity and left leg fin cavity, respectively, and each extends between an extended position and a retracted position. In the extended position, the right leg fin and the left leg fin at least partially extend out from the back side of the base and are substantially parallel to the top surface of the base. In the retracted position, the right leg fin and the left leg fin are substantially nested in the respective right leg fin cavity and left leg fin cavity.

The device may further comprise a separation member positioned on the top surface of the base.

The right leg fin may have a right leg outer stop protruding from its right side and the left leg fin may have a left leg outer stop protruding from its left side. The right leg fin may have a right leg inner stop protruding from its left side and the left leg fin may have a left leg inner stop protruding from its right side. The right leg fin cavity may comprise at least one right leg fin track and left leg fin cavity may comprise at least one left leg fin track. The right leg fin slidingly engages with the right leg fin track and the left leg fin slidingly engages with the left leg fin track.

The device may further comprise a left lever and a right lever. The left lever has a first end positioned outside of the base and extends to a second end positioned inside the base. The left lever is in communication with the left leg fin. The right lever has a first end positioned outside of the base and extends to a second end positioned inside the base. The right lever is in communication with the right leg fin. Actuation of the left lever and the right lever cause the left leg fin and the right leg fin to move between extended and retracted positions.

The device may alternatively comprise a left handle and a right handle. The left handle is slidably engaged in a left handle slot positioned in a top surface of the base. The right handle is slidably engaged a right handle slot positioned in the top surface of the base. The left slide handle is in communication with left leg fin and extends at least partially through the left handle slot. The right slide handle is in communication with the right leg fin and extends at least partially through the right handle slot. Actuation of the slide handles causes the right leg fin and the left leg fin to move between the extended and retracted positions.

In an additional embodiment, the body surfing device comprises a base and a leg fin. The base has a back side and a top surface and the back side has a leg fin cavity therein. The leg fin is positioned at least partially within the leg fin cavity. The leg fin is extendably connected to the base within the leg fin cavity and the leg fin extends between an extended position and a retracted position. In the extended position, the leg fin at least partially extends out from the back side of the base and is substantially parallel to the top surface of the base. In the retracted position, the leg fin is substantially nested in the leg fin cavity.

The device may further comprise a separation member positioned on the top surface of the base.

The leg fin may comprise a right leg outer stop protruding from its right side and a left leg outer stop protruding from its left side. The leg fin cavity may comprise at least one fin track and the leg fin slidingly engages with the at least one leg fin track.

The device may further comprise a left lever and a right lever. The left lever has a first end positioned outside of the base and extends to a second end positioned inside the base. The left lever is in communication with the leg fin. The right lever has a first end positioned outside of the base and extends to a second end positioned inside the base. The right lever is in communication with the leg fin. Actuation of the left lever and the right lever causes the leg fin to move between extended and retracted positions.

The device may alternatively comprise a left handle and a right handle. The left handle is slidably engaged in a left handle slot positioned in a top surface of the base. The right handle is slidably engaged a right handle slot positioned in the top surface of the base. The left slide handle is in communication with the leg fin and extends at least partially through the left handle slot. The right slide handle is in communication with the leg fin and extends at least partially through the right handle slot. Actuation of the slide handles causes the leg fin to move between the extended position and the retracted position.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
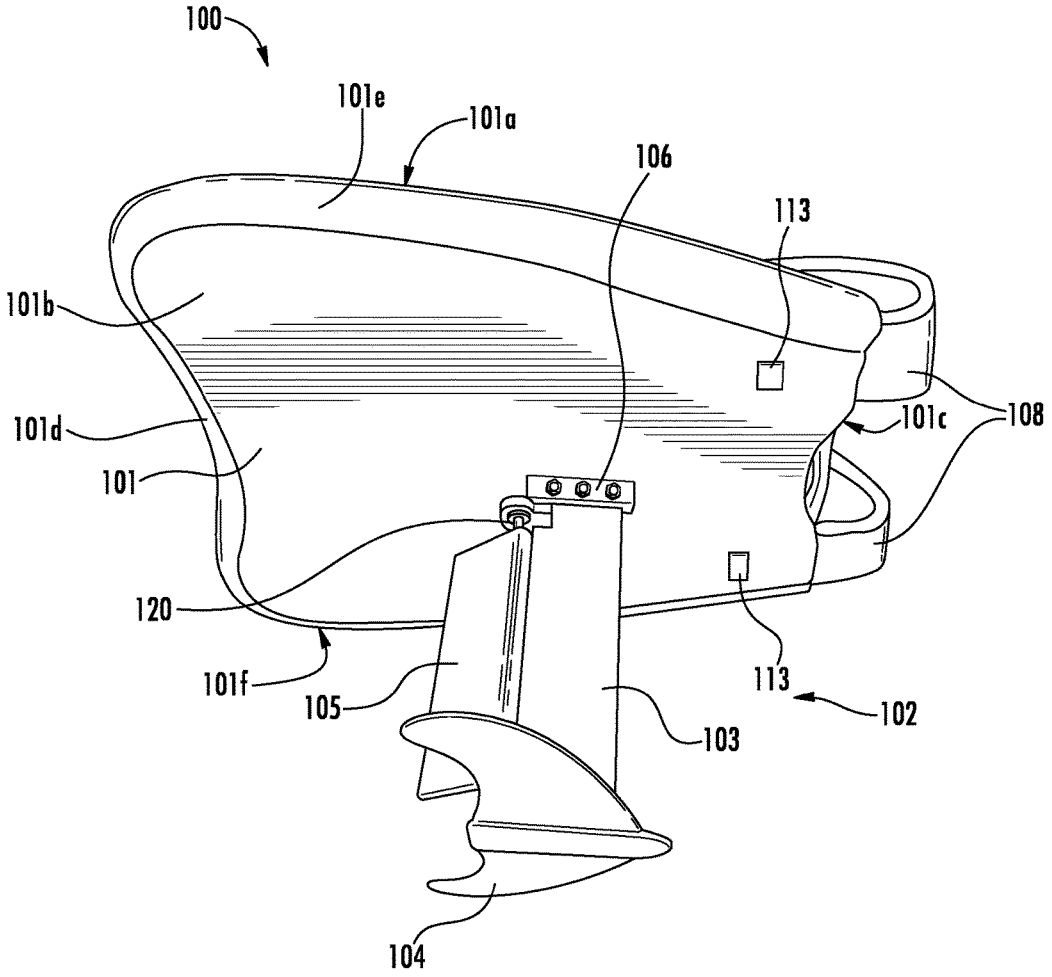
FIG. 1 is a perspective view of a body surfing device having a base and a wing attachment according to an embodiment of the present invention.
Figure 72:
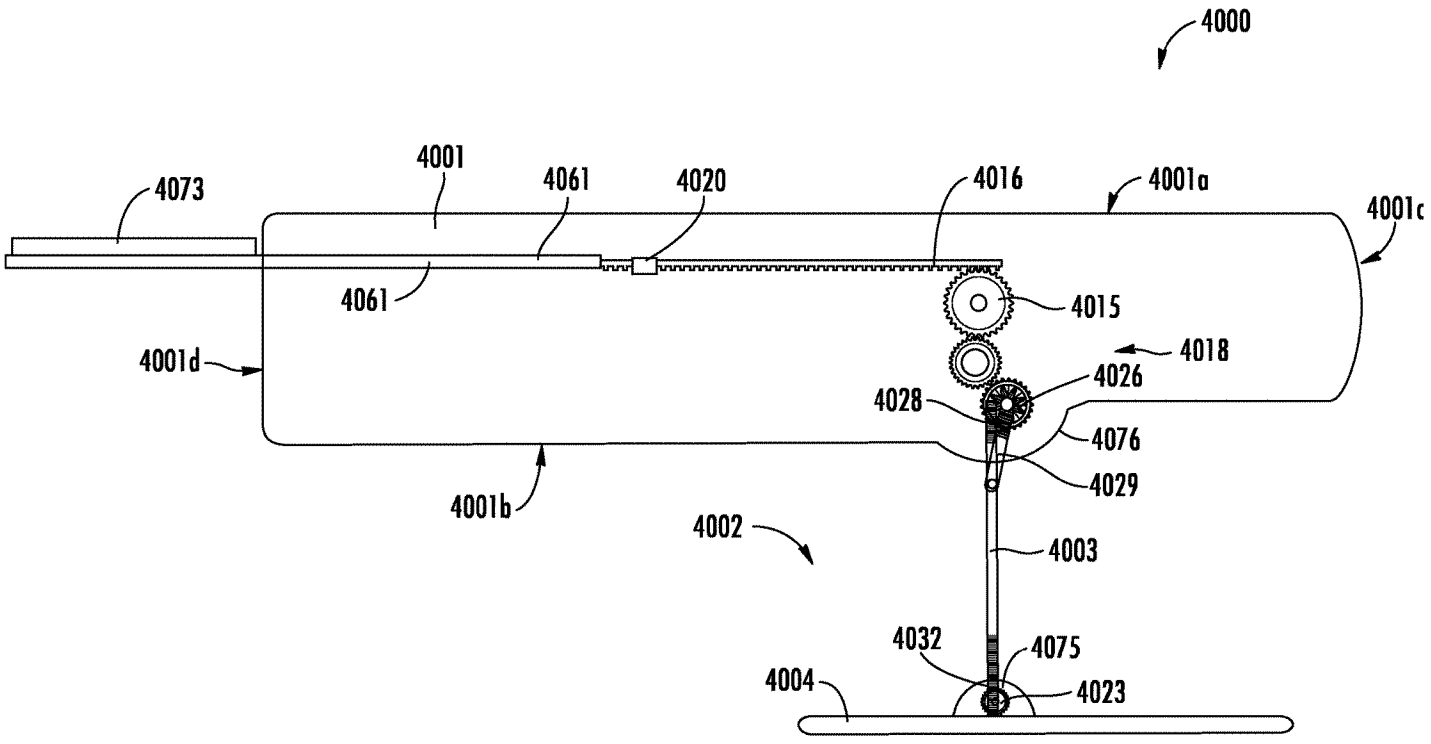
FIG. 72 is a cross-sectional view of the body surfing device of FIG. 69 with the leg fin in its extended position and the wing attachment in its deployed position at line A-A of FIG. 69 according to an embodiment of the present invention.

A detailed description of embodiments for a body surfing device having a deployable wing and extendable leg fins will now be presented with reference to FIGS. 1-72. One of skill in the art will recognize that these embodiments are not intended to be limitations on the scope, and that modifications are possible without departing from the spirit thereof. In certain instances, well-known methods, procedures and components have not been described in detail.

Embodiments of the present invention include a device for body surfing comprising a base that attaches to different sized and shaped wing attachments. Embodiments of the base provide cushion and stabilization to the wearer while providing a reinforced structure to allow attachment and use of different sized and shaped wing attachments. In use, the base can essentially serve to lift the chest of the wearer from the water.

Figure 2:
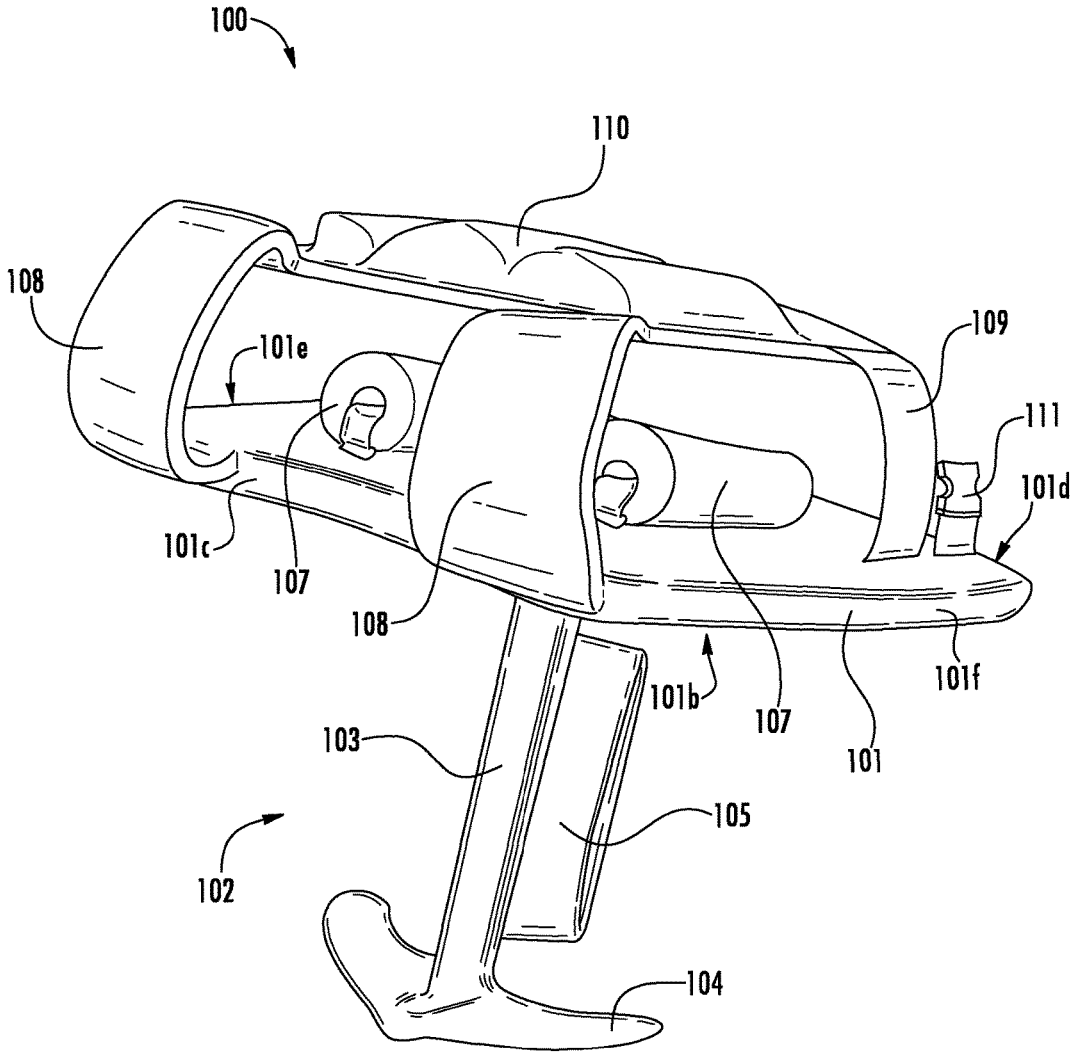
FIG. 2 is a perspective view of a body surfing device having a base and a wing attachment according to an embodiment of the present invention.

As shown in FIGS. 1 and 2, body surfing device 100 comprises base 101 and wing attachment 102. Base 101 has top surface 101*a* and bottom surface 101*b*. When worn by a user, top surface 101*a* faces the user and bottom surface 101*b* faces the water. Base 101 also has front side 101*c*, back side 101*d*, right side 101*e*, and left side 101*f*. In use, front side 101*c* is the portion of base 101 nearest a user's head and back side 101*d* is the portion of base 101 near a user's waist. When worn, right side 101*e* would be on a user's right side and left side 101*f* would be on a user's left side. Base 101 can be generally trapezoidal in shape with front side 101*c* and back side 101*d* (although possibly being curved in shape) being generally parallel with each other, back side 101*d* being greater in length than front side 101*c*, and right side 101*e* and left side 101*d* (also possibly being curved in shape) extending between front side 101*c* and back side 101*d* at the ends of each of front side 101*c* and back side 101*d*.

Figure 3:
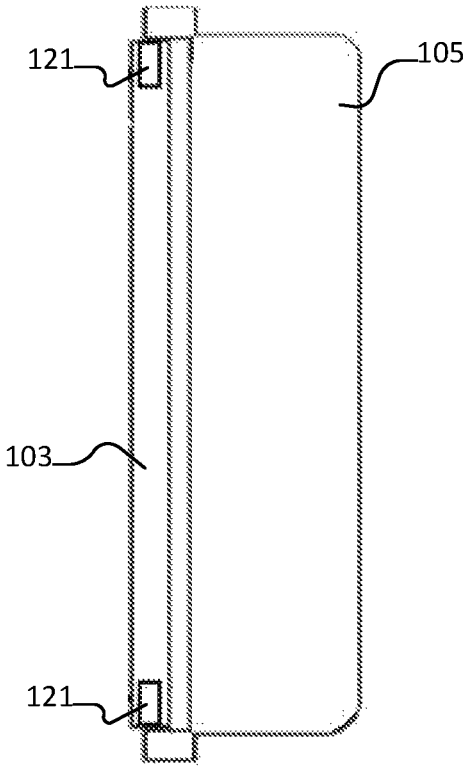
FIG. 3 is a diagram of an exemplary steering fin according to an embodiment of the present invention.

Wing attachment 102, which includes wing strut 103, steering fin 105, and wing extension 104, attaches to base 101 on bottom surface 101*b* at bracket 106. While wing strut 103 and wing extension 104 are rigidly attached to base 101, steering fin 105, which is rotatably connected to wing strut 103 along its length, can be allowed to freely rotate along its connection axis. As shown in FIG. 1, rotation can be provided by axel 120. Axel 120 can be rotatably mounted to steering fin 105 or to base 101. Axel 120 can run the length of steering fin 105. Rotation can be limited to provide stability. As shown in FIG. 3, stop blocks 121 can be used to limit rotation.

Bracket 106 can be any mounting device that mounts wing strut 103 to base 101. The mounting device can be a detachable mounting device. For example, bracket 106 can be a slide-and-self-lock style bracket that allows the user to slide wing attachment 102 into bracket 106 at an angle and then snap wing attachment 102 into a secure, roughly 90 degree position relative to bottom surface 101*b* of base 101. In another example, as illustrated in FIGS. 1 and 2, wing attachment 102 can be secured with fasteners at bracket 106.

Figure 4:
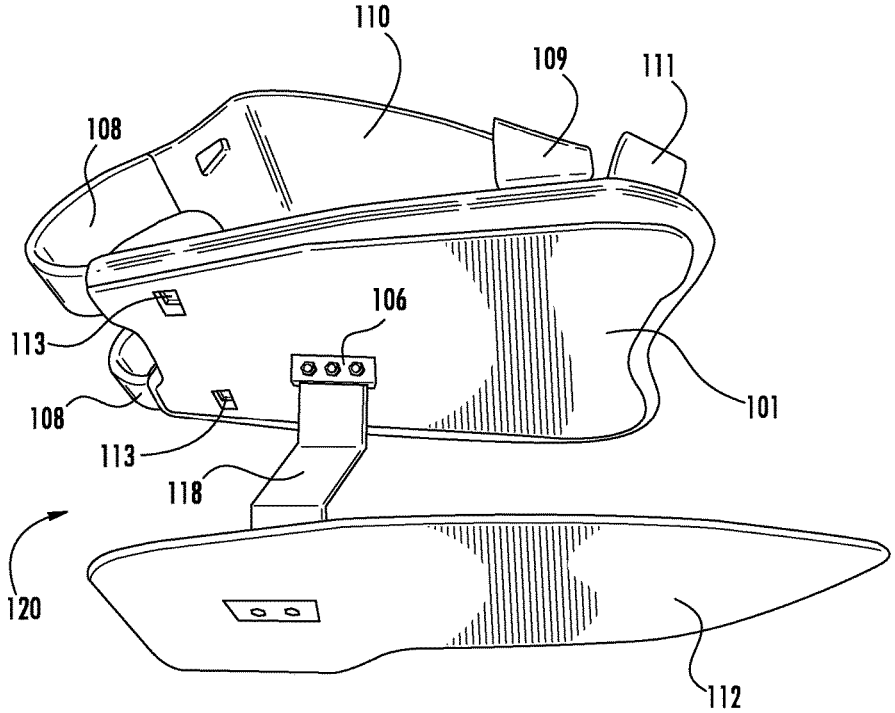
FIG. 4 is a perspective view of a body surfing device having the same base as FIG. 1 and an alternative wing attachment according to an embodiment of the present invention.

Another exemplary wing attachment, wing attachment 120, is shown in FIG. 4. Here, an alternately shaped wing extension, wing extension 112, is mounted to base 101 by wing strut 118. Wing strut 118 has an extended 'Z' shape and is detachably affixed to base 102 at bracket 106.

As can best be seen in FIG. 2, separation members 107 are attached to top surface 101*a* of base 101. In use, separation members 107 rest against the user's chest. A third separation member (not shown in FIG. 2) can also be included between separation members 107. Separation members 107 can be made of buoyant material, such as foam. Separation members 107 can also serve as spacers or struts between the user's chest and base 101. Separation members 107 can help provide a hydrofoil effect by allowing water to flow between separation members 107 and between the user and top surface 101*a* of base 101 at a certain speed and allowing water to flow under base 101 (along bottom surface 101*b*) at a faster speed. This difference in water speed provides lift causing the user's chest to essentially be lifted over the water. The size and shape of separation members 107 and base 101 can vary. Further examples are described in later embodiments.

Also illustrated in FIGS. 2 and 4 is back cover 110 connected to base 101 via shoulder straps 108. Shoulder straps 108 are connected to base 101 at or near front side 101*c*. In use, back cover 110 would be worn on the user's back. Buoyant material can be added to back cover 110 to help prevent the user from rolling over onto his/her back in the water.

In addition to shoulder straps 108, back cover 110 can be connected to base 101 at upper waist strap 109. Upper waist strap 109 can be a stretchable material to allow the user to pull the device over his/her head and shoulders. Upper waist strap 109 can comprise a detachable connection, such as, for example, a parachute buckle. Upper waist strap 109 can connect to top surface 101*a* at or near left side 101*f* and at or near back side 101*d*. An additional upper waist strap (not shown) connecting back cover 110 and base 101 can be located at or near right side 101*f* and at or near back side 101*d*.

Figure 34:
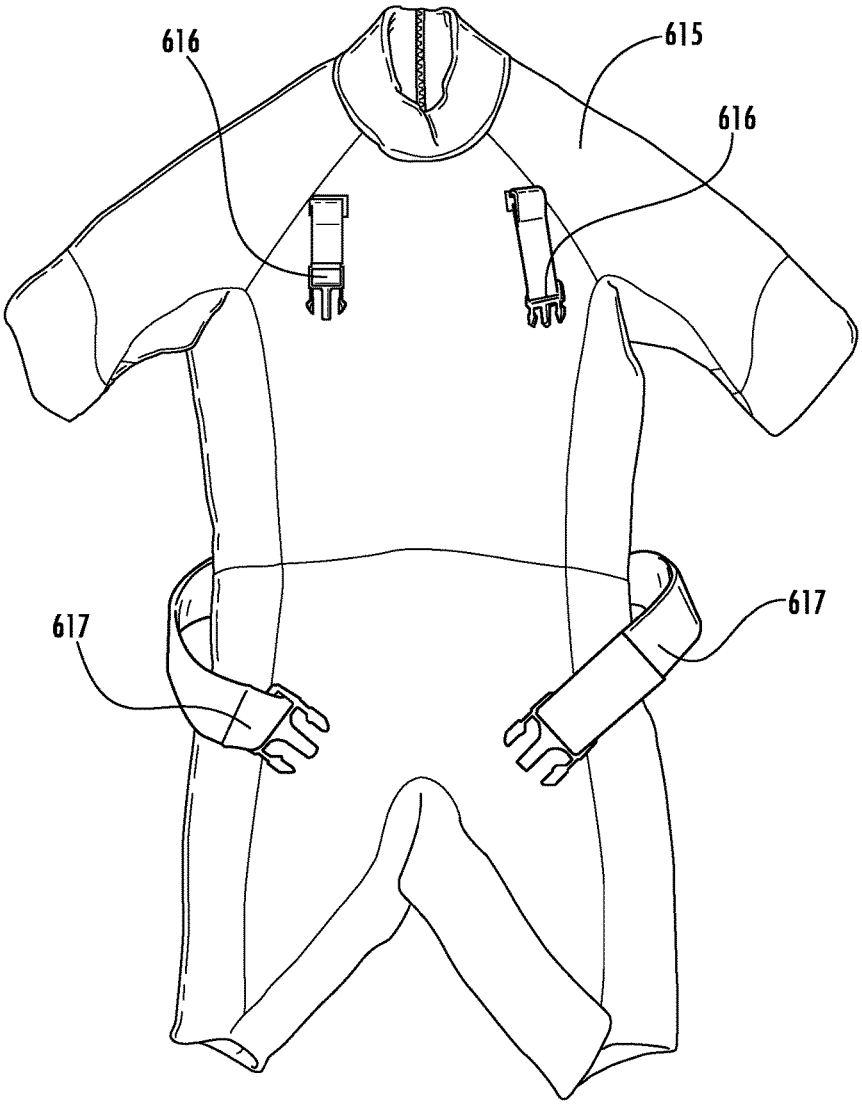
FIG. 34 is a perspective view of a wetsuit for use with a body surfing device according to an embodiment of the present invention.

Body surfing device 100 can also include lower waist strap 111, which can connect to top surface 101*a* of base 101 at or near left side 101*f* and at or near bottom side 101*b*. An additional lower waist strap (not shown) can be connected to top surface 101*a* of base 101 at near right side 101*f* and at or near bottom side 101*b*. Lower waist strap 111 can include a fastener to detachably connect lower waist strap 111 to a user's wetsuit. An exemplary wetsuit for use with embodiments described herein is shown in FIG. 34. As shown, wetsuit 615 includes wetsuit waist straps 617 that are affixed to wetsuit 615. Lower waist straps 111 can connect with wetsuit waist straps 617 to hold body surfing device 100 in place while in use. Alternatively, lower waist strap 111 and the waist strap attached at or near right side 101*e* can detachably connect with each other and be used to wrap around the user's back.

Openings 113 can be used to secure body surfing device 100 to a user's wetsuit or to back cover 110. Straps connected to a user's wetsuit can be threaded through openings 113, looped around top side 101*c* or right side 101*e* or left side 101*f*, as applicable, and removably connected (via, for example, a parachute buckle) to the back of a user's wetsuit. Openings (not shown) can also be located in shoulder straps 108 or back cover 110 and straps threaded through such openings before removably connecting them to the back of a user's wetsuit.

Figure 5A:
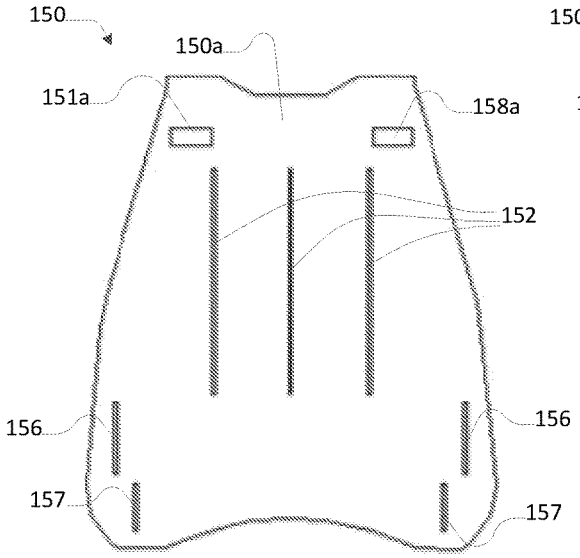
FIG. 5A is a top plan view of a base of a body surfing device according to an embodiment of the present invention.
Figure 5B:
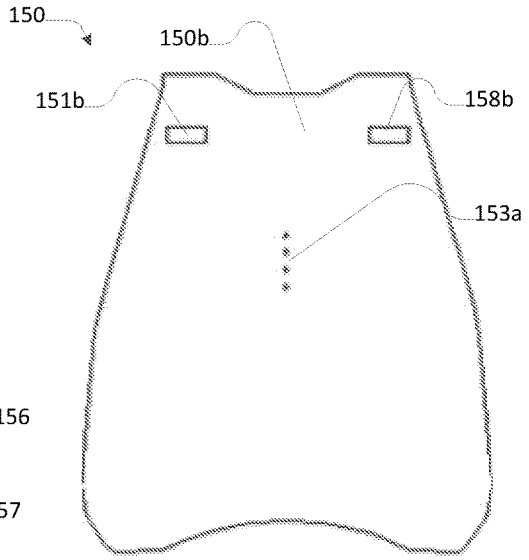
FIG. 5B is a bottom plan view of a base of a body surfing device according to an embodiment of the present invention.
Figure 5C:
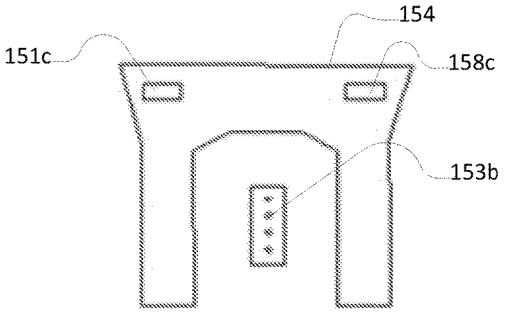
FIG. 5C is a top plan view of an interior of a base of a body surfing device according to an embodiment of the present invention.
Figure 6A:
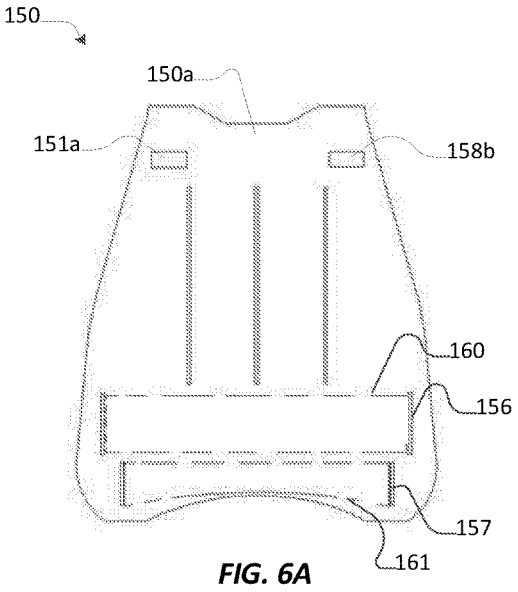
FIG. 6A is a top plan view of a base of a body surfing device illustrating interior components according to an embodiment of the present invention.
Figure 6B:
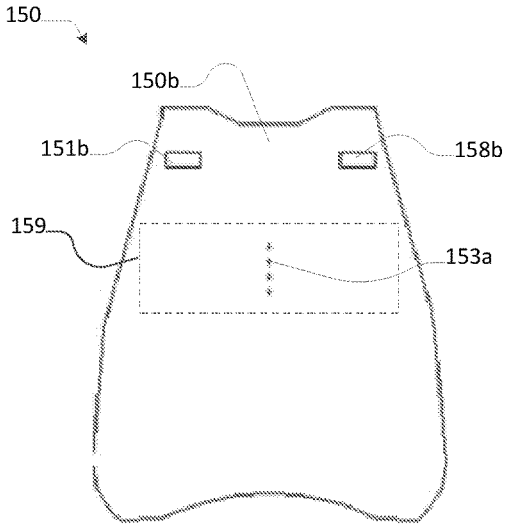
FIG. 6B is a bottom plan view of a base of a body surfing device illustrating interior components according to an embodiment of the present invention.

FIGS. 5A through 7 further detail the design of embodiments of a body surfing device base, such as, for example base 100. FIGS. 5A and 6A are top views of base 150 showing top surface 150*a* and FIGS. 5B and 6B are bottom views of base 150 showing bottom surface 150*b*. FIG. 5C is a view of base interior 154, which can be included in base 150 to provide a reinforced core interior.

Figure 25:
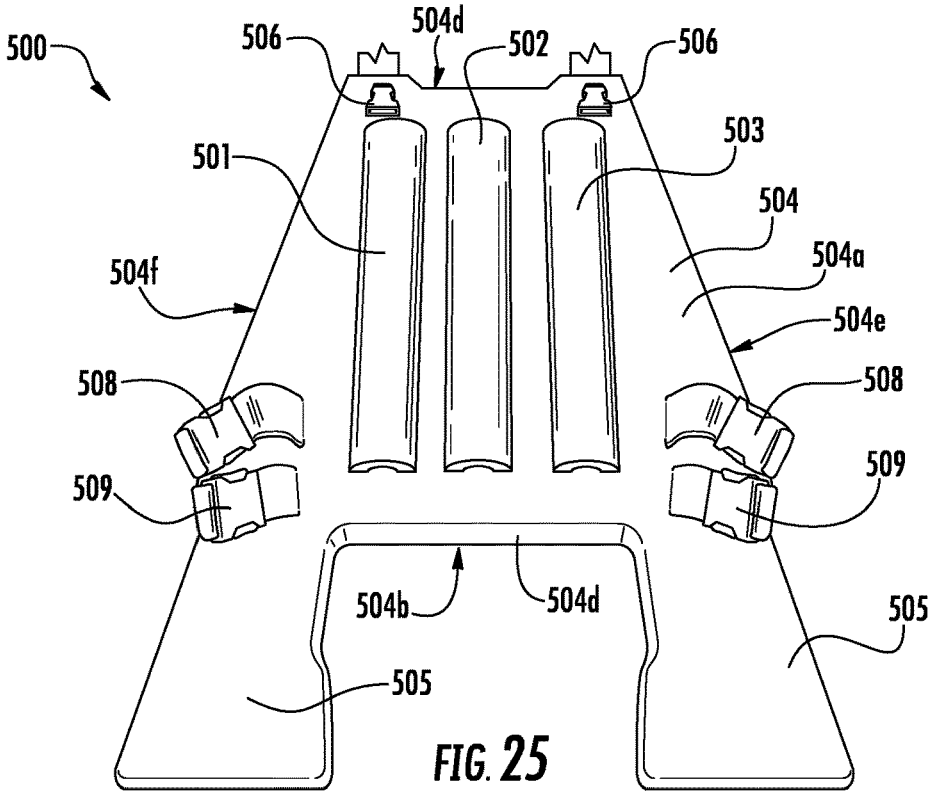
FIG. 25 is a perspective view showing the top side of a body surfing device (with back cover removed) having leg wings and separation members according to an embodiment of the present invention.

In an exemplary embodiment, the outer body of base 150 is made from carbon fiber. The interior of base 150 can comprise rigid foam. Additionally, neoprene can be used to create a reinforced core interior, base interior 154, in the shape shown in FIG. 5C. Base interior 154 is fit in between the foam of interior base 150 such that openings 151*a*, 151*b*, and 151*c* line up with each other, openings 158*a*, 158*b*, and 158*c* line up with each other and bracket connectors 153*a* and 153*b* line up with each other. Shoulder straps can be fastened or sewn to base interior 154. Kevlar/carbon fiber cloth tweed and epoxy can also be located between the foam layers of base 150. Fill lines 152 can result from a chopped carbon fiber and epoxy slurry that can be run on top of base interior 154 to reduce flexing. Fill lines 152 can also be used for placement of separation members (as illustrated in FIG. 25).

In another exemplary embodiment, a piece of neoprene cut to the shape and size of base interior 154 is sandwiched between layers of foam. The neoprene may not extend the full length of the base. Wetted carbon fiber cloth can be used to join the two foam halves along with the other interior pieces. A second neoprene piece can be cut to the shape and size as base interior 154 and bonded to the outer foam that is facing the user's chest. Fiber cloth used to create shoulder straps can then be bonded on top of the neoprene and the exposed foam.

Upper internal structural element 160 provides support for upper waist connection 156, which can connect base 150 to an upper waist strap (e.g. FIG. 2, 109). Lower internal structural element 161 provides support for lower waist connection 157, which can connect base 150 to a lower waist strap (e.g. FIG. 2, 111). Wing connection structural element 159 provides support for bracket connection 153*a*, which can connect base 150 to a wing strut (e.g. FIG. 2 element 103). These structural reinforcements (upper internal structural element 160, lower internal structural element 161 and wing connection structural element 159) can be made of Kevlar®/carbon fiber cloth tweed and epoxy located between the foam layers of base 150. Today's extruded plastics technology includes the ability to use fibers in the liquid matrix before entering the mold. Manufacturing technologies like that, combined with air bladders or injected foams, can be used as substitutes for the Kevlar-carbon fiber foam construction described in embodiments herein.

Figure 7:
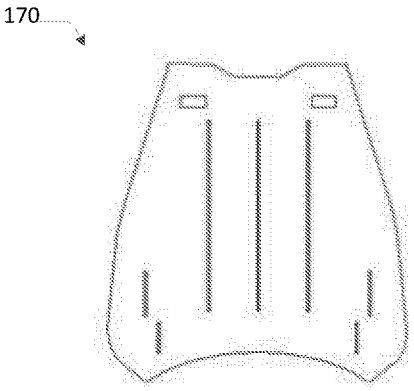
FIG. 7 is a top plan view of a base of a body surfing device illustrating an alternative base design according to an embodiment of the present invention.

FIG. 7 shows an alternative design of a base. The back side (side nearest the user's waist) of base 170 comes to two points.

Figure 8:
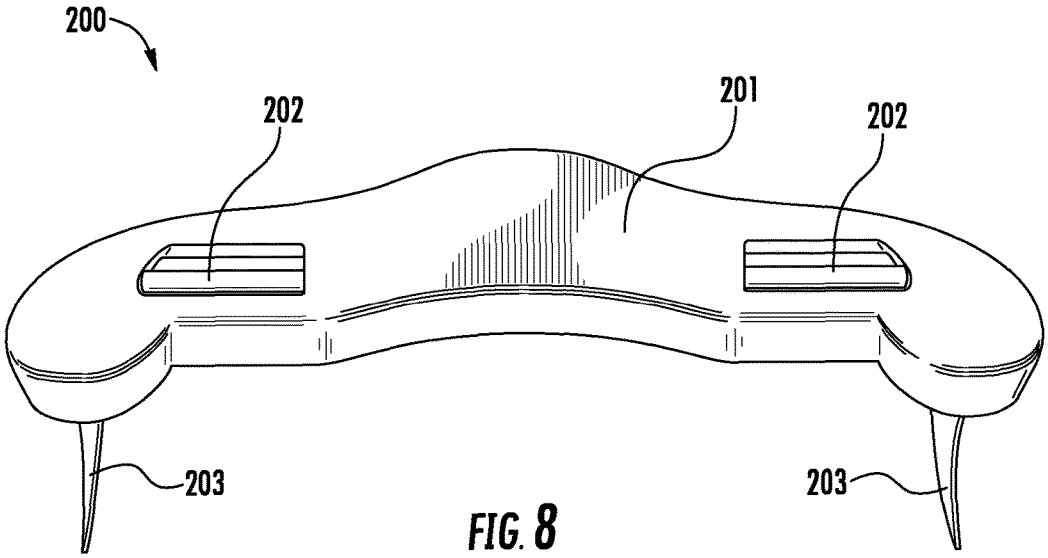
FIG. 8 is a perspective view showing the top of a hand-held wing according to an embodiment of the present invention.
Figure 9:
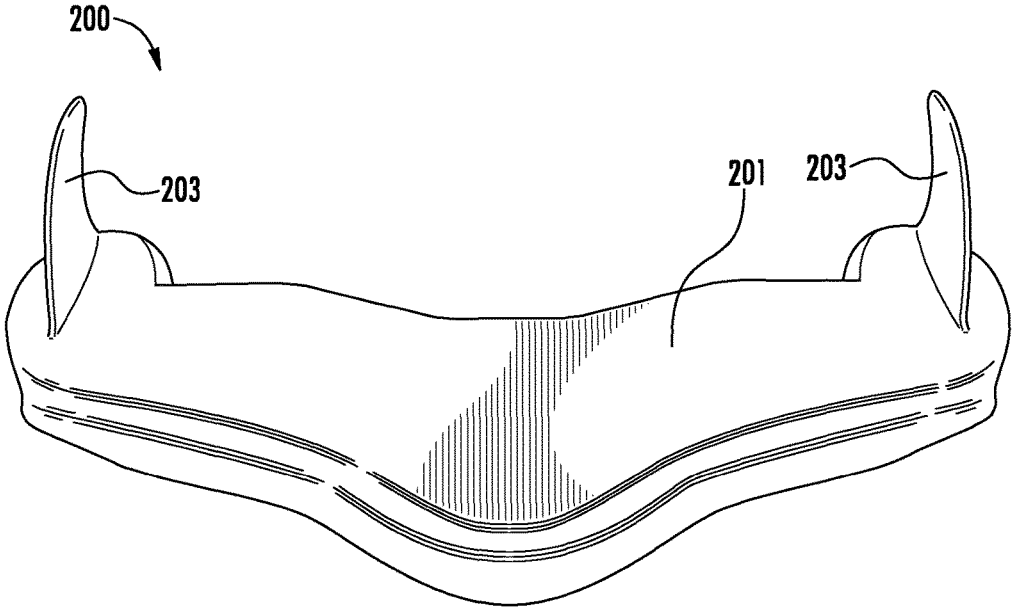
FIG. 9 is perspective view showing the bottom of the hand-held wing of FIG. 8 according to an embodiment of the present invention.

FIGS. 8 and 9 depict hand-held wing 200 which can be used alone or in conjunction with body surfing devices described herein. Hand-held wing 200 can be held at arms-length independent of the body surfing device's base. Hand-held wing can assist a user with steering while in the water. Hand-held wing 200 includes wing base 201 having handles 202 on its top side (shown in FIG. 8) and fins 203 (shown in FIG. 9).

Figure 10:
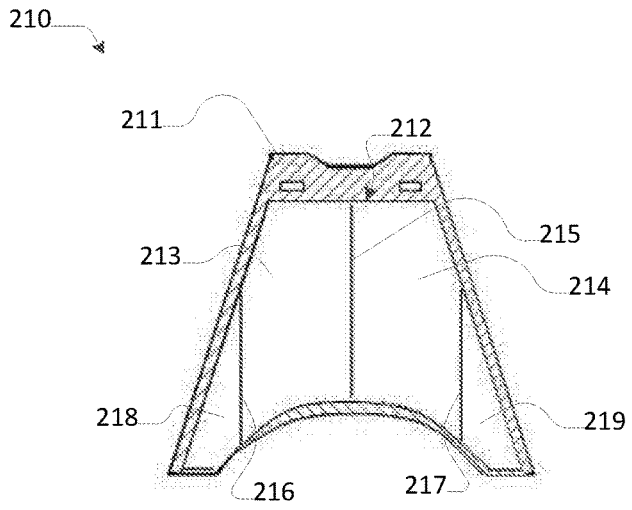
FIG. 10 is a bottom plan view of a base of a body surfing device having a folding wing attachment in its unfolded or flat position attached thereto according to an embodiment of the present invention.
Figure 11:
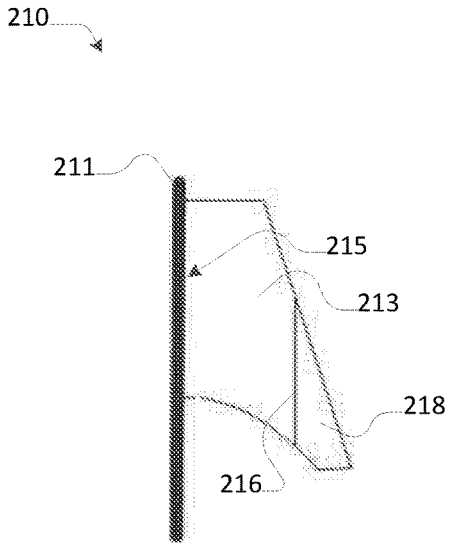
FIG. 11 is a right side elevational view of the body surfing device shown in FIG. 10 with the folding wing attachment folded along its middle hinge according to an embodiment of the present invention.

An embodiment of a body surfing device having a folding wing attachment is illustrated in FIGS. 10 through 13. In FIG. 10, body surfing device 210 having folding wing attachment 212 is shown positioned on base 211 in its unfolded or flat position. Folding wing attachment 212 has middle hinge 215 that allows left wing 214 and right wing 213 of folding wing attachment 212 to fold together about middle hinge 215. FIG. 11 shows a side view of folding wing attachment 212 folded about middle hinge 215.

Figure 12:
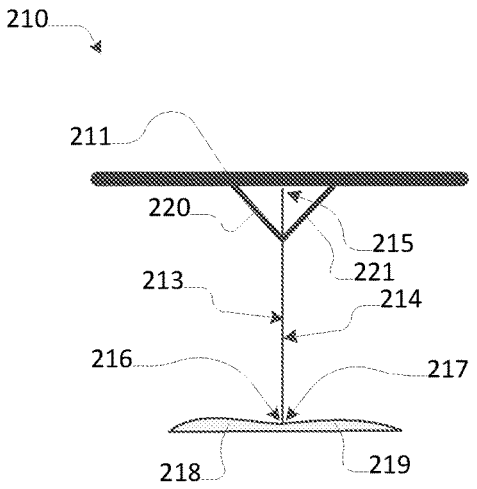
FIG. 12 is a front elevational view of the body surfing device shown in FIG. 10 with the folding wing attachment folded along its middle, left and right hinges according to an embodiment of the present invention.

Left wing 214 can then be folded along left hinge 217 and right wing 213 can be folded along right hinge 216 to form an upside down "T" shape as illustrated in the front view of FIG. 12. In the folded position, right wing extension 218 and left wing extension 219 are substantially parallel to the bottom surface of base 211. This allows the wearer to swim out with folding wing attachment 212 in the flat position (as shown in FIG. 10) to reduce drag and then fold the wings along the hinges to create the upside down "T" shape (as shown in FIG. 12) to ride the waves back to shore. Optionally, right brace 220 and left brace 221 can be hingedly attached to base 211. Right brace 220 and left brace 221 can removably attach to right wing 213 and left wing 214 respectively to provide added stability to folding wing attachment 212.

Figure 13:
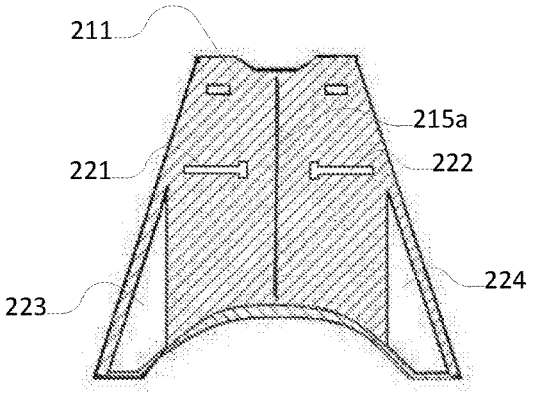
FIG. 13 is a bottom plan view of a base of the body surfing device shown in FIG. 10 with the folding wing attachment removed from the base to show cavities for the wing braces and wing extensions according to an embodiment of the present invention

FIG. 13 depicts a bottom view of base with folding wing attachment 212 removed. Folding wing attachment 212 hingedly attaches to base 211 at middle hinge attachment area 215*a*. Cavities can be included in base 211 for the braces. Left brace cavity 222 can house left brace 221 and right brace cavity 221 can house can house right brace 220 when right wing 213 and left wing 214 are in their unfolded position.

Right wing extension 218 and left wing extension 219 may each include a thicker or protruding portion on its top side as shown in FIG. 12. Base 211 can include cavities to contain the protruding portion to allow folding wing attachment 212 to lay roughly flat when in the unfolded position. Left wing extension cavity 224 can house the protruding portion of left wing extension 219 and right wing extension cavity 223 can house the protruding portion of right wing extension 218.

Figure 14:
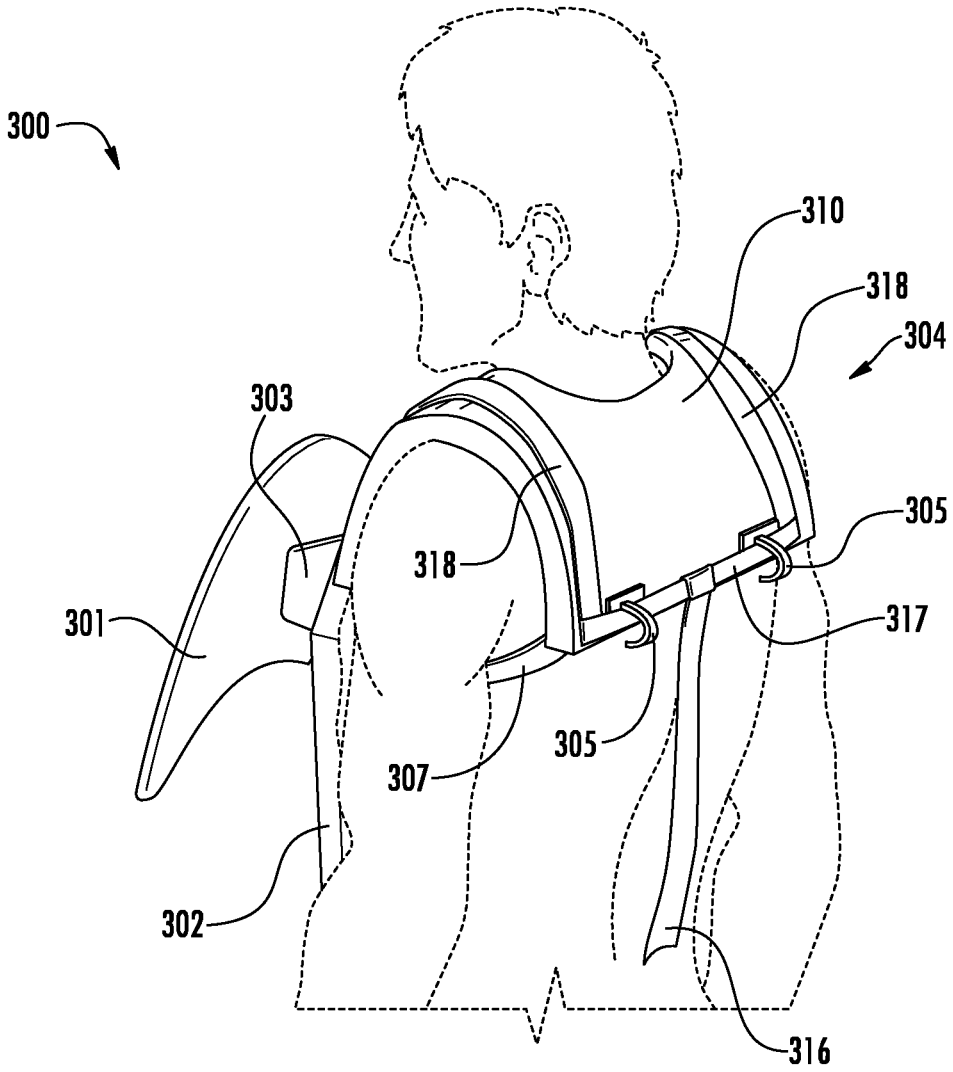
FIG. 14 is a perspective view of a body surfing device secured to a user using a shoulder holster according to an embodiment of the present invention.
Figure 15:
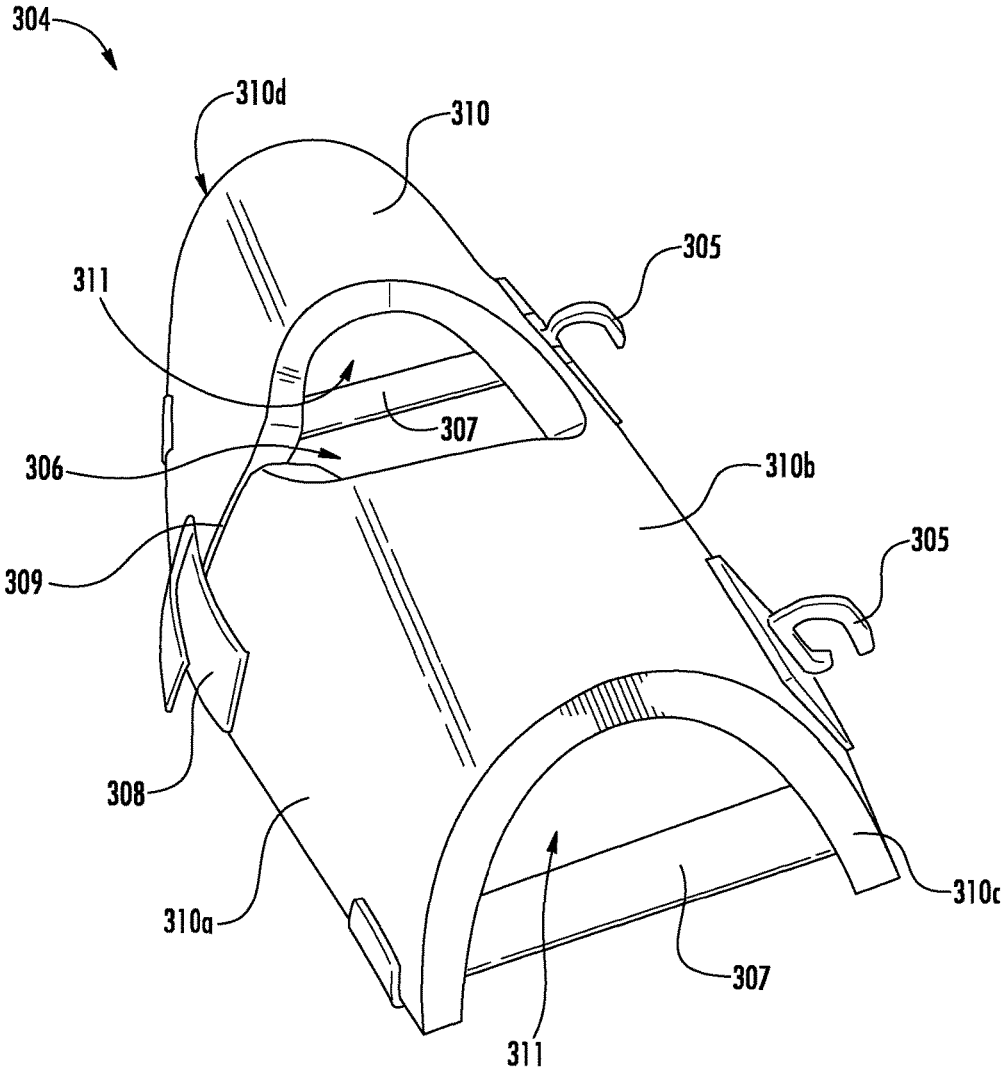
FIG. 15 is a perspective view of the shoulder holster shown in FIG. 14.
Figure 16:
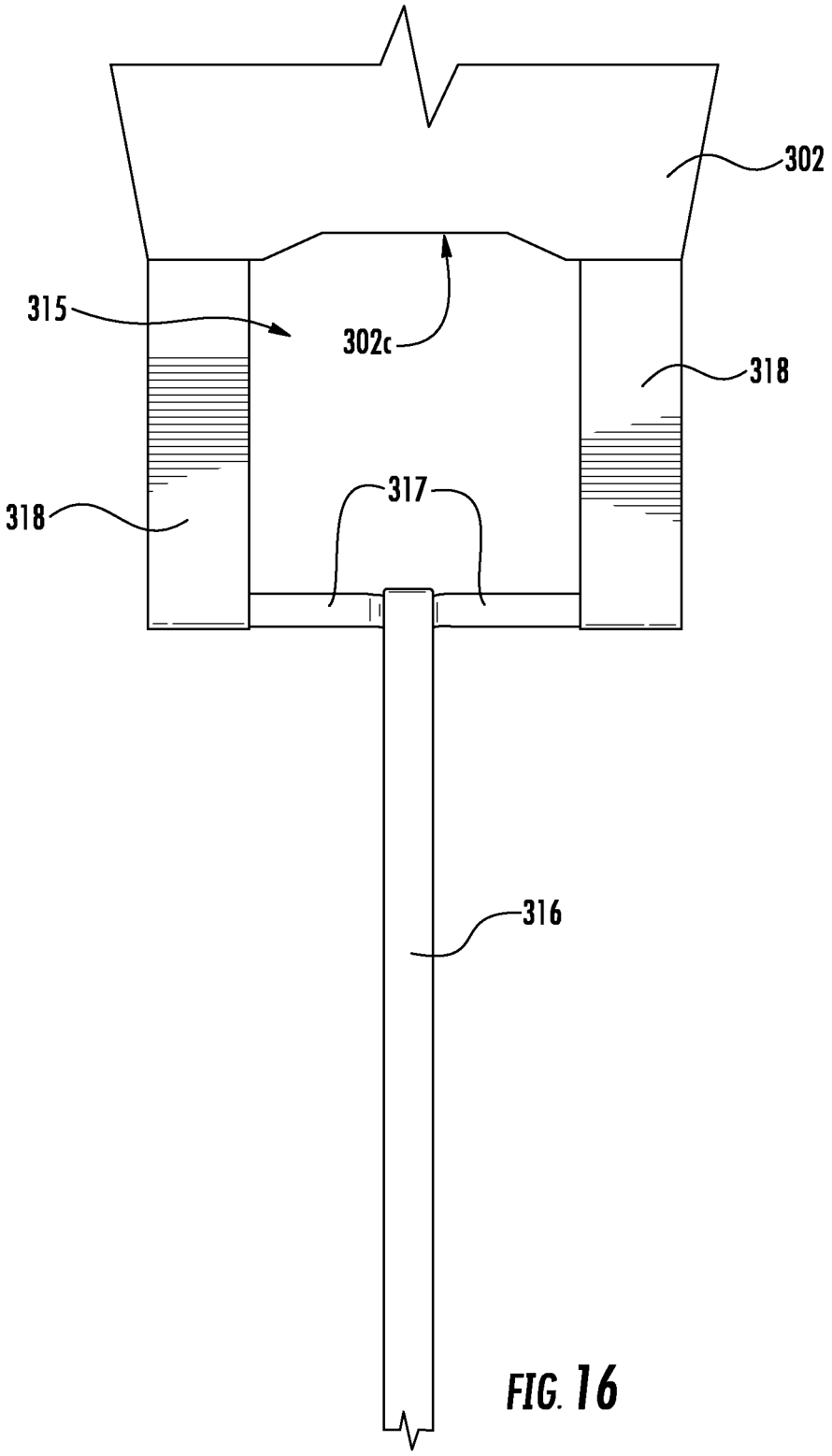
FIG. 16 is a bottom plan view of the front portion of the base and the straps shown in FIG. 14.
Figure 17:
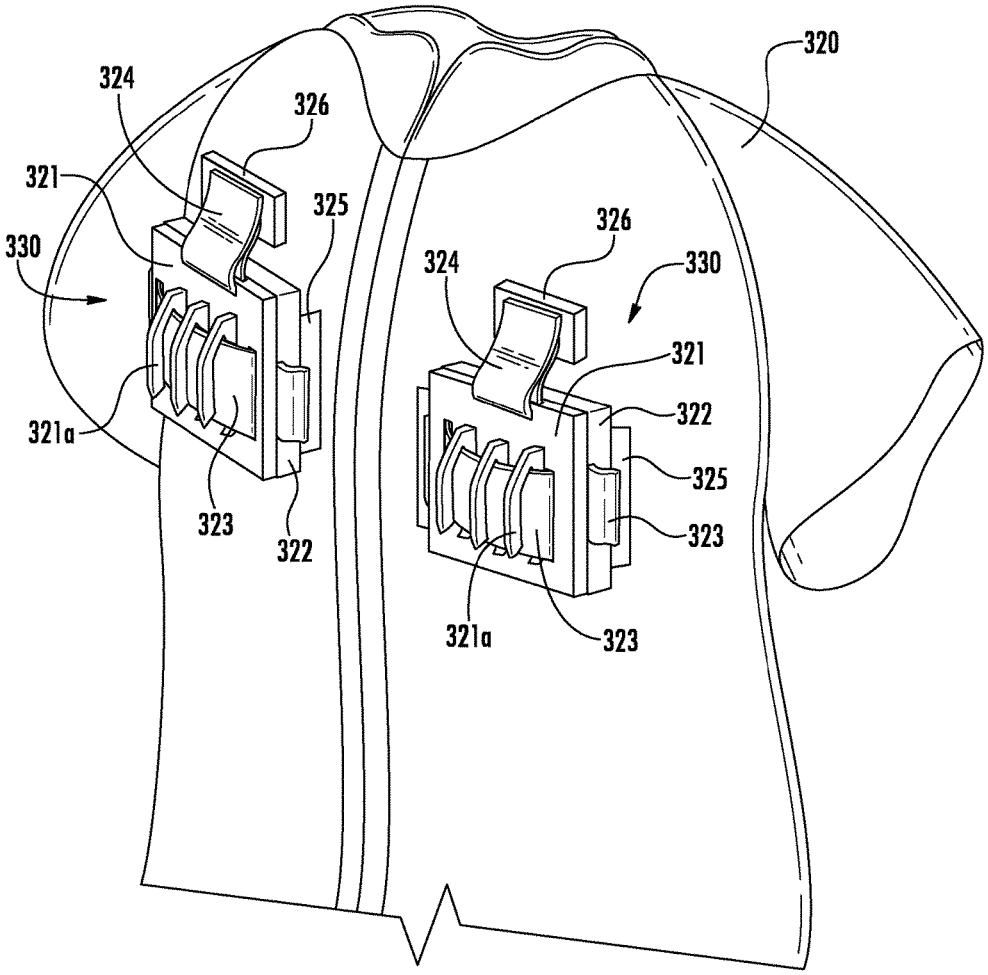
FIG. 17 is a perspective view of a wetsuit having hook attachments according to an embodiment of the present invention.

Embodiments of the body surfing devices described herein can be used with and without a wetsuit. FIGS. 14 through 16 illustrate an embodiment that can be used with or without a wetsuit. As shown, body surfing device 300 includes base 302 connected to wing extension 301 by wing strut 303. Base 302 also includes shoulder straps 318. In an exemplary embodiment, shoulder straps 318 are made of stretchable neoprene. Shoulder straps 318 are connected at one end to base 302 at or near front side 302*c*. In an exemplary embodiment, shoulder straps 318 are connected to base 302 by sandwiching shoulder straps 318 between the foam core and fiber glass/epoxy resin layers of base 302. At their opposite ends, shoulder straps 318 are connected to opposing ends of back strap 317. Back strap 317 can, for example, be made of poly strapping. Extension strap 316 connects at one end to back strap 317 in between the opposing ends of back strap 317. The opposing end of extension strap 316 is untethered. Extension strap 316 can also, for example, be made of poly strapping. Base 302, shoulder straps 318 and back strap 317 together form opening 315. In use, a user's head would fit through opening 315 as illustrated in FIG. 14.

Shoulder holster 304 includes shoulder cover 310 which is in the shape of a rectangle that has been formed into an open arch along its width. Shoulder cover 310 extends lengthwise to about the length of a user's shoulders. Under arm straps 307 connect bottom side 310*a* of shoulder cover 310 to top side 310*b* of shoulder cover 310. Under arm straps 307 are located at or near left side 310*c* of shoulder cover 310 and right side 310*d* of shoulder cover 310. Under arm straps 307 and shoulder cover 310 create arm holes 311 at the right side 310*d* and left side 310*c* of shoulder cover 310. Opening 306 is located in the center of shoulder cover 310. Bottom side 310*a* also includes slit 309 that runs from opening 306 to the edge of bottom side 310*a* creating right and left portions of bottom side 310*a*. Closing fastener 308 connects the right and left portions of bottom side 310*a* and can be opened to allow a user to easily slip his/her arms through arm holes 311 and his/her head through opening 306. Once shoulder holster 304 is on the user, closing fastener 308 can be closed securing shoulder holster 304 on the user's shoulders and upper chest and back. Shoulder holster 304 also includes hooks 305 located on top side 310*b*. In use, hooks 305 receive back strap 317 as shown in FIG. 14. Once shoulder holster 304 has been positioned on the user, the top side of base 302 can be positioned against the user's chest and user's head can be fit through opening 315 so that shoulder straps 318 lay over shoulder cover 310. Extension strap 316 can be used by the user to pull back strap 317 down to engage hooks 305 securing body surfing device 300 in place. Extension strap 316 can also be used to disengage back strap 317 from hooks 305 when the user is done using body surfing device 300.

In another embodiment, wetsuit 320 can be used in place of shoulder holster 304. Wetsuit 320 includes back strap securing devices 330. Although two securing devices 330 are shown, any number of securing devices 330 can be used. In addition, the size of the brackets and/or the number of hooks per bracket can vary. Each of securing devices 330 includes hook bracket 321 having one or more downward facing hooks 321*a* extending therefrom. Hook bracket 321 and hooks 321*a* can be made from carbon fiber and Kevlar® fibers, or similar materials, blended into an epoxy matrix. Hook bracket 321 is secured to hook base 322. Hook base 322 can be made from a non-stretching, non-bending rubber material. Hook base 322 can be affixed to wetsuit 320 with known adhesives. Secondary base 325 can be included between hook base 322 and wetsuit 320. Hook base 322 can be affixed to secondary base 325 with known adhesives and secondary base 325 can be affixed to wetsuit 320 with known adhesives.

Primary strapping 323 can be threaded through openings in hook bracket 321 and affixed to secondary base 325 and/or directly to wetsuit 320 on each side of hook bracket 321. Primary strapping 323 may be affixed to secondary base 325 and/or wetsuit 320 by adhesives or by sewing strapping to secondary base 325 and/or wetsuit 320. Secondary strapping 324 can also be threaded through an opening in hook bracket 321 and affixed to strap base 326, which can be separately affixed to wetsuit 300 apart from hook base 322. Similarly, secondary strapping 324 may be affixed to strap base 326 by adhesives or by sewing strapping to hook base 322. In use, once user is wearing wetsuit 320, hooks 321*a* receive back strap 317, similar to the way hooks 305 of shoulder holster 304 receive back strap 317 in FIG. 14.

Embodiments of the body surfing device described herein include rotating leg fins and/or extendable wing attachments. Body surfing device 400 having rotating leg fins (405*a* and 405*b*) and extendable wing attachment 440 is shown in FIGS. 18 through 24. Although depicted in the same embodiment in FIGS. 18 through 24, the rotating leg fins (405*a* and 405*b*) and extendable wing attachment 440 can be implemented separately and/or in combination with features described with respect to other embodiments.

Body surfing device 400 comprises base 401, extendable wing attachment 440 having wing strut 403 and wing extension 404, rotating right leg fin 405*a* and rotating left leg fin 405*b*. The connections to shoulder straps 402 are also shown. Base 401 has top surface 401*a* and bottom surface 401*b*. When worn by a user, top surface 401*a* faces the user and bottom surface 401*b* faces the water. Base 401 also has front side 401*c*, back side 401*d*, right side 401*e*, and left side 401*f*. In use, front side 401*c* is the portion of base 401 nearest a user's head and back side 401*d* is the portion of base 401 nearest a user's waist. When worn, right side 401*e* would be on a user's right side and left side 401*f* would be on a user's left side.

Shoulder straps 402 can be connected to base 401 at or near front side 401*c*. Shoulder straps 402 can connect to a back cover similar to that shown in FIGS. 2 and 4 and described above. Shoulder straps 402 can also connect to a back strap similar to that shown in FIGS. 14 and 16 and described above. Additional back covers that can be connected to shoulder straps 402 are also described below with reference to FIGS. 33 and 35-37. Although not shown, an upper waist strap and/or a lower waist strap (as described with reference to FIGS. 2 and 4 above and FIGS. 25-31, 33, 35, and 36 below) can be included on base 401. Separation members (not shown), similar to those that described with reference to FIG. 2 above and FIGS. 25-31 and 36 and below, can also be included on base 401.

Figure 18:
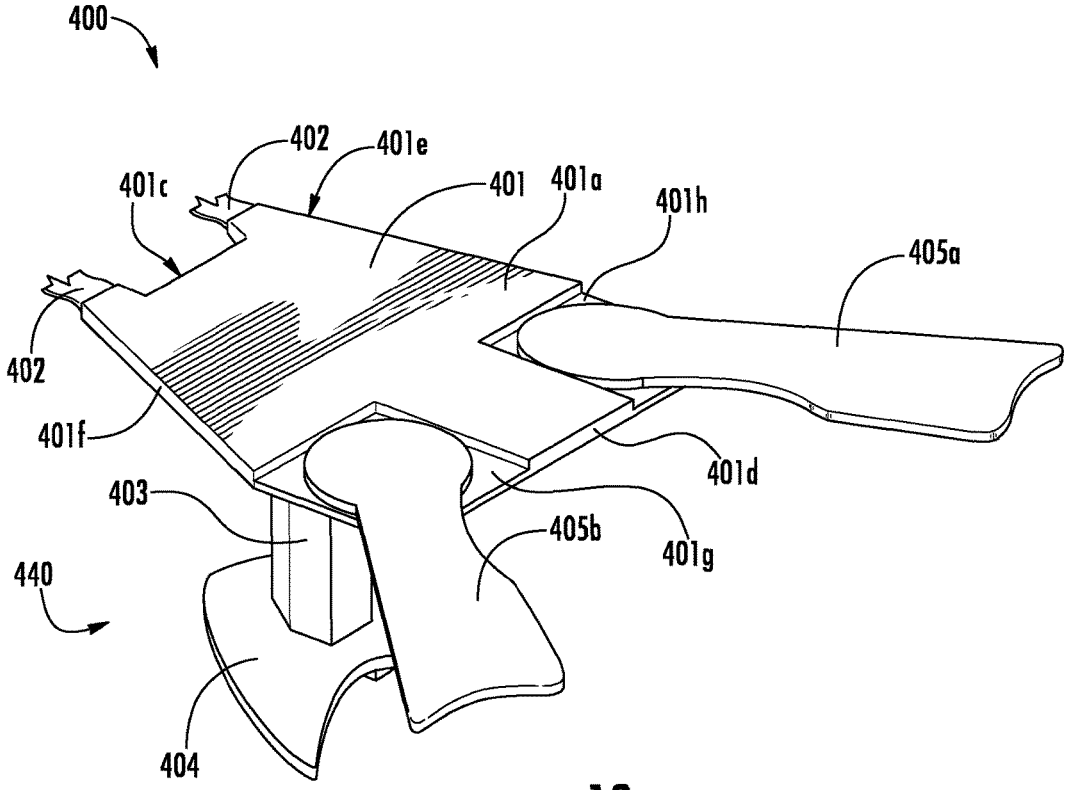
FIG. 18 is a perspective view showing the top side of a body surfing device having rotating leg fins and an extendable wing attachment according to an embodiment of the present invention.
Figure 19:
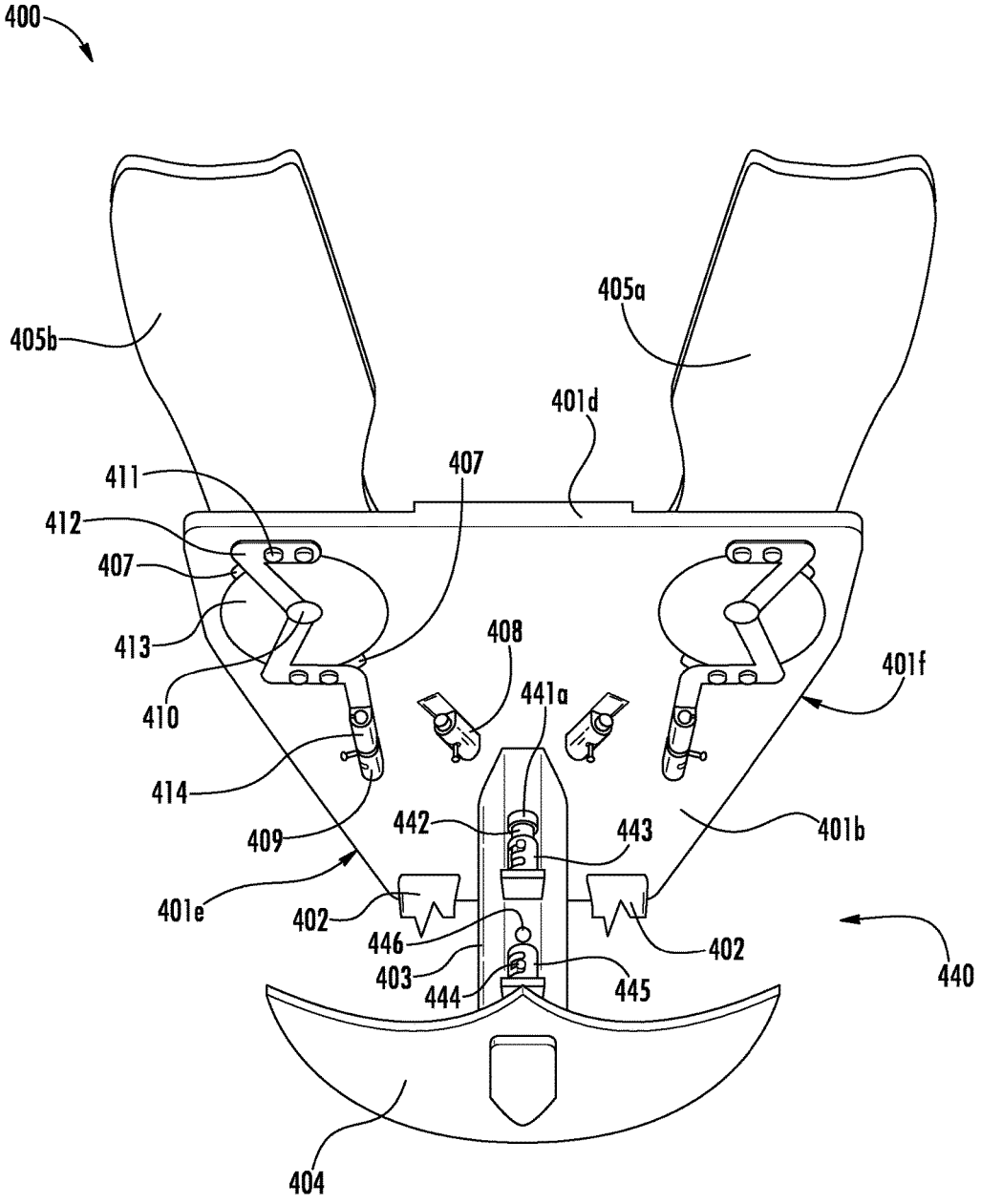
FIG. 19 is a perspective view showing the bottom side of the body surfing device of FIG. 18 with the rotating leg fins in their retracted position and the extendable wing attachment in its retracted position.
Figure 20:
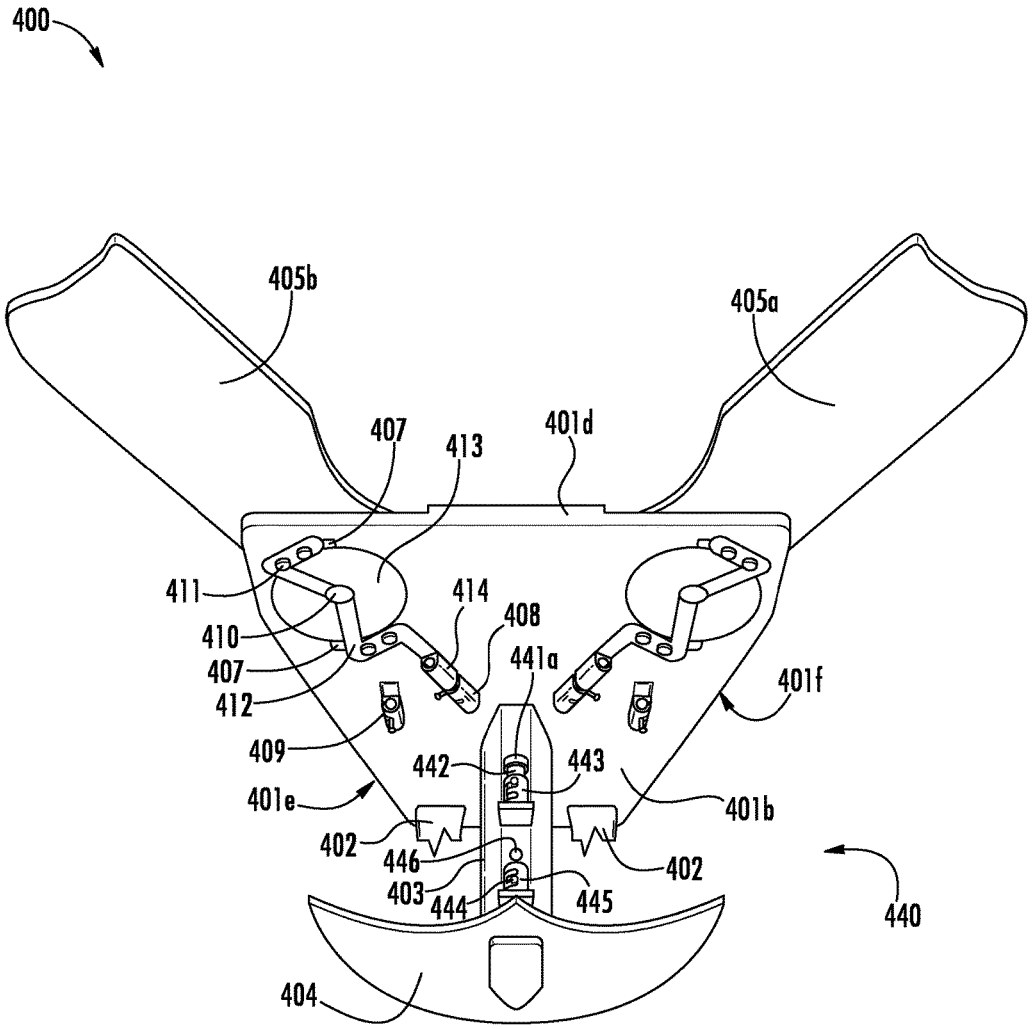
FIG. 20 is a perspective view showing the bottom side of the body surfing device of FIG. 18 with the rotating leg fins in their extended position and the extendable wing attachment in its retracted position.
Figure 21:
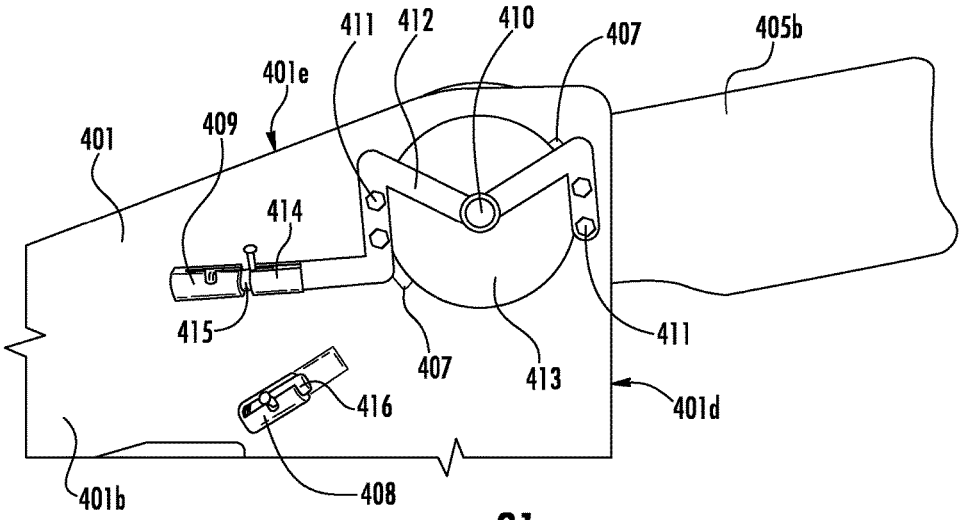
FIG. 21 is a perspective view of the rotation mechanism for the rotating left leg fin of the body surfing device of FIG. 18 with the left fin in its retracted position.

Rotating leg fins 405*a* and 405*b* can be rotated between a retracted position, as shown in FIGS. 19 and 21, and an extended position as shown in FIGS. 18, 20, 22 and 23. In their extended position, rotating leg fins (405*a* and 405*b*) can allow a user to more easily swim while wearing body surfing device 400. An example degree of extension that can allow the user room to swim is about 29 degrees; however, this can vary greatly according to a user's preference. In their retracted position, rotating leg fins (405*a* and 405*b*) provide the user with an area to rest their legs on while surfing. The degree of rotation of rotating leg fins (405*a* and 405*b*) in their retracted position can vary as well. Rotating leg fins (405*a* and 405*b*) help reduce or eliminate the drag effect of a user's legs trailing at a different height than their torso when the hydrofoil effect lifts the upper body out of the water.

As best shown in FIG. 18, rotating left leg wing 405*b* is rotatably connected to depressed area 401*g* of top surface 401*a* of base 401 located near back side 401*d* and left side 401*f*. Similarly, rotating right leg wing 405*a* is rotatably connected to depressed area 401*h* of top surface 401*a* of base 401 located near back side 401*d* and right side 401*e*. The placement of rotating leg fins 401*a* and 401*b* on top surface 401*a* is exemplary. Rotating leg fins 401*a* and 401*b* can also be located on bottom surface 401*b* or in a cutout of base 401 located between top surface 401*a* and 401 *b*. The later modification can be done to the embodiment shown in FIG. 18 by continuing top surface 401*a* over rotating leg fins 401*a* and 401*b*. Rotating leg fins 401*a* and 401*b* extend outward from base 401. Rotating leg fins 401*a* and 401*b* may include a circular portion and a modified (curved) rectangular portion. The size and shape of each portion of rotating leg fins 401*a* and 401*b* is exemplary.

Figure 22:
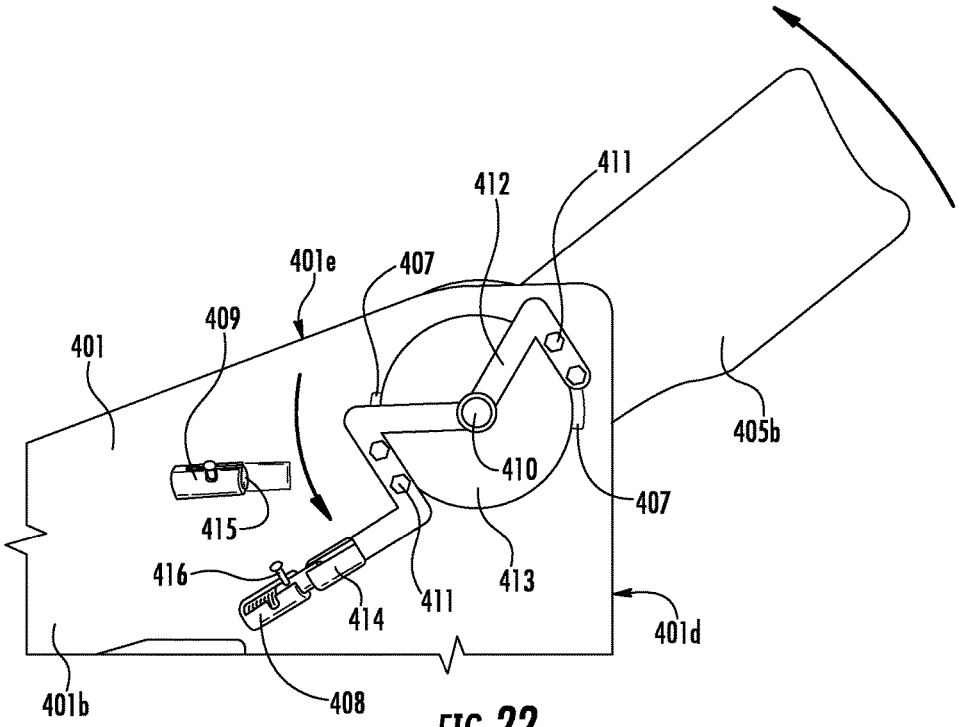
FIG. 22 is a perspective view of the rotation mechanism for the rotating left leg fin of the body surfing device of FIG. 18 with the left fin in its extended position.

The attachment and rotation mechanism for rotating leg fins 405*a* and 405*b* illustrated in the embodiment shown in FIGS. 18 through 23 is exemplary. In this exemplary embodiment, the attachment and rotation mechanism will be described with reference to rotating left leg fin 405*b*. One of ordinary skill in the art will appreciate that rotating right fin 405*a* is similarly attached, but to rotate in the opposite direction. As best shown in FIGS. 21 and 22, which are partial views of base 401 showing its connection to left leg fin 405*b*, rotating left leg fin 405*b* is rotatably connected to base 401 about axel 410. Axel 410 is connected to bracket 412. Bracket 412 includes track pins 411 that are in sliding communication with tracks 407. As track pins 411 move along tracks 407, bracket 412 causes axel 410 to rotate. Axel 410, being rigidly attached to rotating left leg fin 405*b*, causes rotating left leg fin 405*b* to rotate. Spacer 413 is optional and can freely rotate about axel 410. Spacer 413 can have a smooth surface and be used to reduce friction between bracket 412 and bottom surface 401*b*.

Rotation of rotating leg fins (405*a* and 405*b*) can be limited in their degree of rotation relative to base 401. In this exemplary embodiment, tracks 407, are used to limit the degree of movement of rotating left leg fin 405*b*. Tracks 407 can limit rotation when rotating left leg fin 405*b* is retracted as shown in FIG. 21 and when rotating left leg fin 405*b* is extended as shown in FIG. 22. Tracks 407 can be extended in length to provide a greater degree of movement to rotating left leg fin 405*b*.

Rotation of rotating leg fins (405*a* and 405*b*) can also be locked in placed in various positions to prevent movement during use. In this exemplary embodiment, rotating left leg fin 405*b* can be locked in place in a first (retracted) position as shown in FIG. 21 and in a second (extended) position as shown in FIG. 22. In the first position, first connector 409 using spring-loaded first connector pin 415 engages with receiving portion 414 of bracket 412. To engage with receiving portion 414 of bracket 412, first connector pin 415 is in its uncompressed state. To unlock rotating left leg fin 405*b* from the first position, first connector pin 415 can be compressed, disengaging first connector pin 415 from receiving portion 414 of bracket 412. Rotating left leg fin 405*b* can then be rotated to its second position, as shown in FIG. 22. In the second position, second connector 408 using spring-loaded second connector pin 416 engages with the receiving portion 414 of bracket 412. To engage with receiving portion 414, second connector pin 416 can be allowed to move to in its uncompressed state. To unlock rotating left leg fin 405*b* from the second position, second connector pin 416 can be compressed, disengaging second connector pin 416 from receiving portion 414 of bracket 412.

Figure 23:
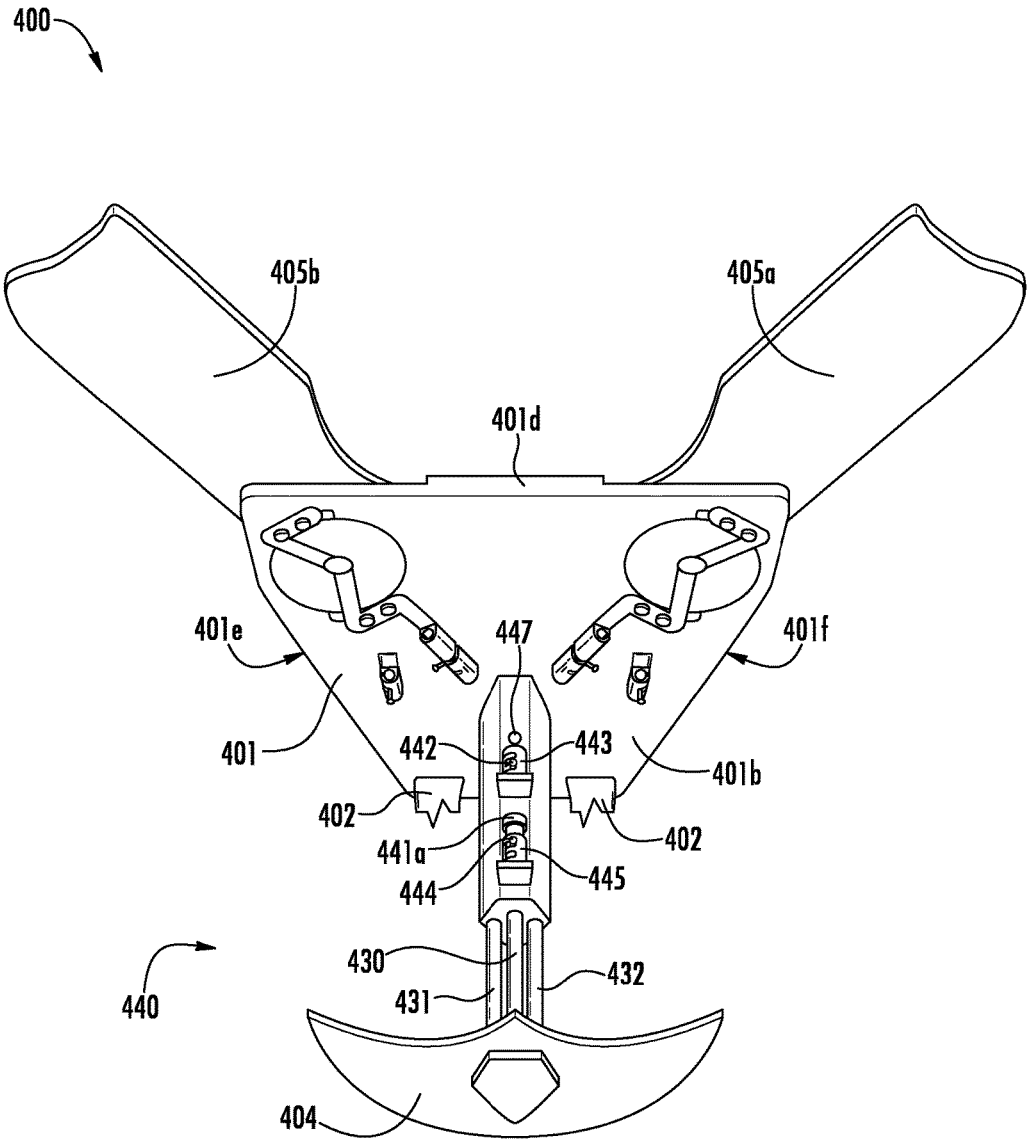
FIG. 23 is a perspective view showing the bottom side of the body surfing device of FIG. 18 with the rotating legs fins in their extended position and the extendable wing attachment in its extended position.
Figure 24:
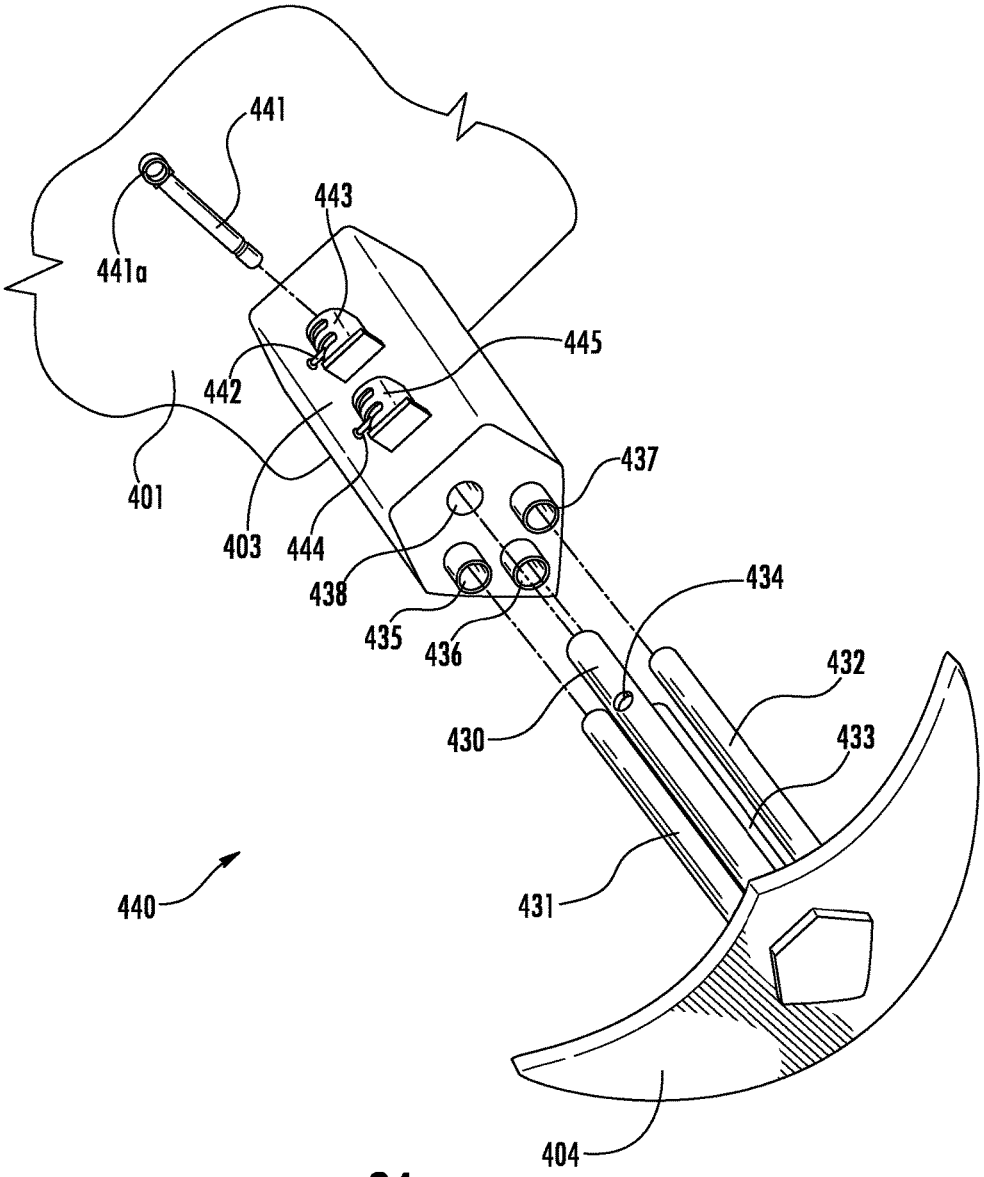
FIG. 24 is an exploded perspective view of the extendable wing attachment of FIG. 18.

Extending wing attachment 440, which is best shown in FIGS. 19, 20, 23, and 24, includes wing strut 403 and wing extension 404. Wing strut 403 is positioned on base 401 on bottom surface 401*b*. Wing extension 404 can be mounted on wing strut 403 in multiple positions or can be removed altogether (and replaced with another wing extension). Although wing extension 404 can be mounted in any number of positions, two positions are illustrated here. The first (retracted) position is shown in FIGS. 19 and 20. The second (extended) position is shown in FIG. 23. An exploded view, also illustrating wing extension 404 completely removed from wing strut 403, is shown in FIG. 24. Wing extension 404 includes a plurality of extension members positioned thereon—locking extension member 430 and secondary extension members 431, 432, and 433. Although four extension members are shown here, any number of extension members can be used including only one extension member. If greater distance between base 401 and wing extension 404 is desired, the length of extension members 430-433 can be increased. Locking extension member includes aperture 434. Wing strut 403 includes a plurality of openings—primary opening 438 and secondary openings 435-337—to receive extension members 430-434. Although four openings are shown here, any number of openings can be used. There should just be at least as many openings as extension members.

To lock wing extension 404 in the first position, extension members 430-434 are placed into their respective openings 435-438 and positioned so that first hole 447 (best shown in FIG. 23) lines up with aperture 434. Primary locking pin 441 having open portion 441*a* (best shown in FIG. 24) can be threaded through first hole 447 and through aperture 434. First lock 443, located adjacent to first hole 447, using first lock pin 442, can be moved to engage with open portion 441*a* of locking pin 441. First lock pin 442 can then be rotated to further engage with first lock 443 securing wing extension 404 in its first position.

To lock wing extension 404 in the second position (shown in FIG. 23), extension members 430-434 are placed into their respective openings 435-438 and positioned so that second hole 446 (best shown in FIGS. 19 and 20) lines up with aperture 434. Primary locking pin 441 can be threaded through second hole 446 and through aperture 434. Second lock 445, located adjacent to second hole 446, using second lock pin 444, can be moved to engage with open portion 441*a* of locking pin 441. Second lock pin 444 can then be rotated to further engage with second lock 445 securing wing extension 404 in its second position.

Figure 26:
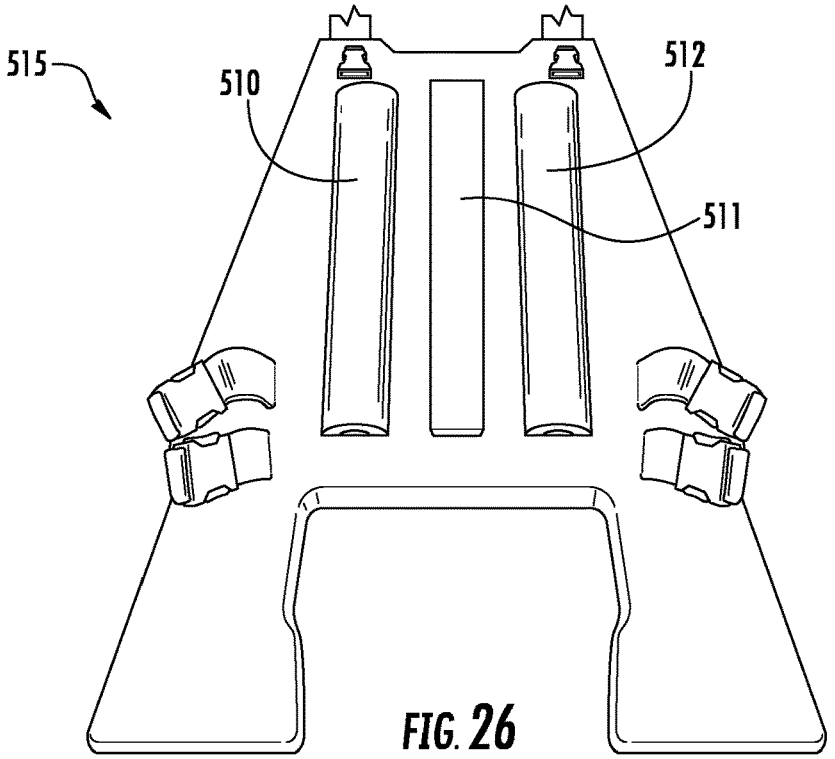
FIG. 26 is a perspective view showing the top side of a body surfing device (with back cover removed) having alternative separation members according to an embodiment of the present invention.
Figure 27:
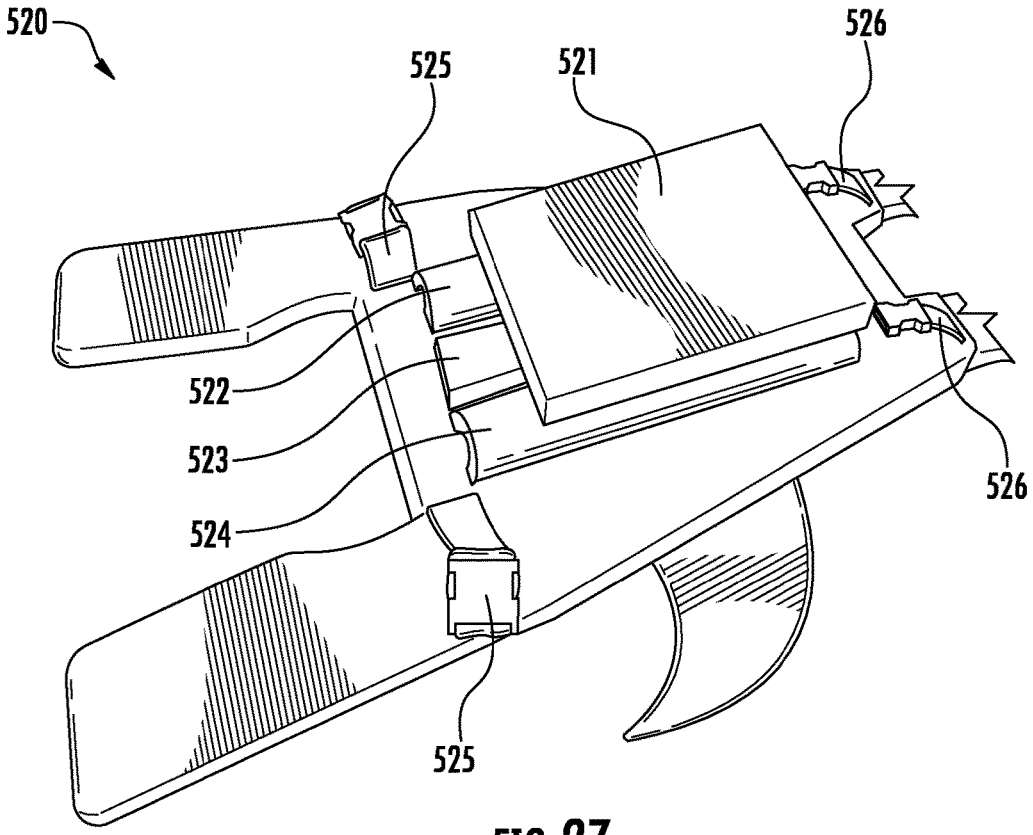
FIG. 27 is a perspective view showing a body surfing device (with back cover removed) having additional alternative separation members according to an embodiment of the present invention.

FIGS. 25 through 27 illustrate various types of separation members, which can be of various shapes sizes and can be arranged in various ways. As shown in FIG. 25, Body surfing device 500 includes separation members 501, 502, and 503. Separation members 501, 502, and 503 have a half cylinder shape. As shown in FIG. 26, body surfing device 515 includes separation members 510, 511, and 512. Separation members 510 and 512 are half cylinders while separation member 511 is rectangular in shape. In FIG. 27, body surfing device 520 includes separation members 521-524. Separation members 522 and 524 are half cylinders while separation member 523 is rectangular in shape. Separation member 521 is also rectangular in shape but is positioned on top of separation member 522-524. The addition of separation member 521 can help enhance the aileron effect of base waist straps 525 (described below) and base chest straps (described below) 526 that can occur when body surfing device 520 is in use.

The separation members of any embodiment described herein can be made of buoyant material, such as foam. The separation members can serve as spacers or struts between the user's chest and the base of the body surfing device. The separation members can help provide a hydrofoil effect by allowing water to flow between the separation members and between the user and the top surface of the base at a certain speed and allowing water to flow under the base (along bottom surface) at a faster speed. This difference in water speed provides lift causing the user's chest to essentially be lifted over the water. The separation members can also be made of a compressible material, which would expand and contract with a user's breathing. The arrangement of separation members can be any arrangement that provides distance between the user and the body surfing device's base. The arrangement can also be made to provide a comfortable experience for the user. Aside from the arrangement shown and described above, another exemplary arrangement would be separation members in the shape of a triangle with the base of the triangle near the front side of the base. The separation members can be separate pieces attached to the base or can be blow molded and formed as part of the base.

Embodiments of the present invention include one or more straps for securing the body surfing device to a user. As shown in FIG. 25, body surfing device 500 includes base upper waist straps 508, base lower waist straps 509 and base waist chest straps 506. Base upper waist straps 508 can comprise a detachable connection, such as, for example, a parachute buckle, as shown. Base upper waist strap 508 can be used to connect to base 504 to a back cover (not shown), to a wetsuit (not shown), or to a connecting strap (not shown) that wraps around a user and connects to both base upper waist straps 508. An exemplary wetsuit that could connect with base upper waist strap 508 is shown in FIG. 34. Base upper waist straps 508 can connect with wetsuit waist straps 617 to hold body surfing device 100 in place while in use. Base upper waist strap 508 can connect to top surface 504*a* at or near back side 504*d* and at or near a respective side of base (left side 504*f* or right side 504*e*).

Base lower waist straps 509 can also comprise a detachable connection, such as, for example, a parachute buckle, as shown. Base lower waist strap 509 can be used to connect to base 504 to a back cover (not shown), to a wetsuit (not shown), or to a connecting strap (not shown) that wraps around a user and connects to both base upper waist straps 509. An exemplary wetsuit that could connect with base lower waist strap 509 is shown in FIG. 34. Base lower waist straps 508 can connect with wetsuit waist straps 617 to hold body surfing device 500 in place while in use. Base lower waist strap 509 can connect to top surface 504*a* at or near back side 504*d* and at or near a respective side of base (left side 504*f* or right side 504*e*).

Base chest straps 506, located on top surface 504*a* at or near front side 504*c* of base 504 and at or near left side 504*f* and right side 504*e*, respectively, can be used to detachably connect body surfing device 500 to a wetsuit, such as wetsuit 615. Wetsuit 615 includes wetsuit chest straps 616 and wetsuit chest straps 616 can connect to respective base chest straps 506 to secure body surfing device to wetsuit 615.

As shown in FIG. 27, base waist straps 525 can be used to connect to a back cover (not shown), similar to that shown and described for upper waist strap 109 (FIGS. 2 and 4) above, upper waist strap 508 (FIG. 25) above, and upper waist strap 604 (FIGS. 33, 35, 36 and 37) below. Base waist straps 525 can also be used to connect a lower waist strap (not shown), similar to that shown and described for lower waist strap 111 (FIGS. 2 and 4), lower waist strap 509 (FIG. 25) above and base lower waist strap 605 (FIGS. 33, 35, 36 and 37) below. Additional waist straps can also be added to body surfing device 520. Base chest straps 526 can be used to detachably connect body surfing device 520 to a user's wetsuit. An exemplary wetsuit for use with embodiments described herein is shown in FIG. 34. As shown, wetsuit 615 includes wetsuit waist straps 617 and wetsuit chest straps 616 that are affixed to wetsuit 615. Wetsuit chest straps 616 can connect to base chest straps 521 and wetsuit waist straps 617 can connect to base waist straps 525.

As illustrated in FIG. 25, leg fins 505 can also extend from base 504 at back side 504*d*. Leg fins 505 help reduce or eliminate the drag effect of a user's legs trailing at a different height than their torso when the hydrofoil effect lifts the upper body out of the water.

Figure 28:
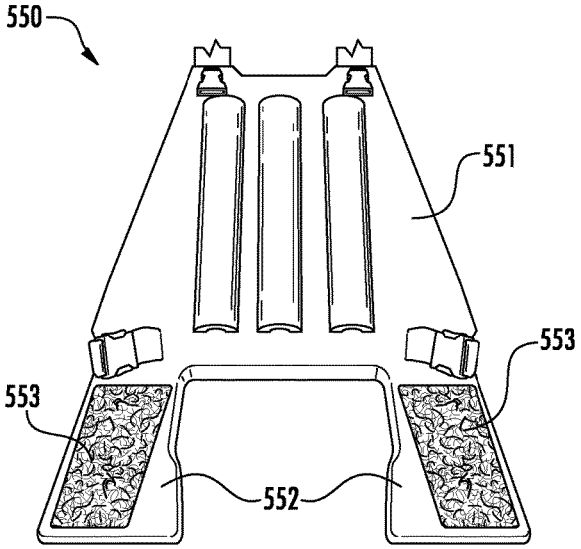
FIG. 28 is a perspective view of a body surfing device (with back cover removed) having leg wings and fasteners for leg mounts according to an embodiment of the present invention.
Figure 29:
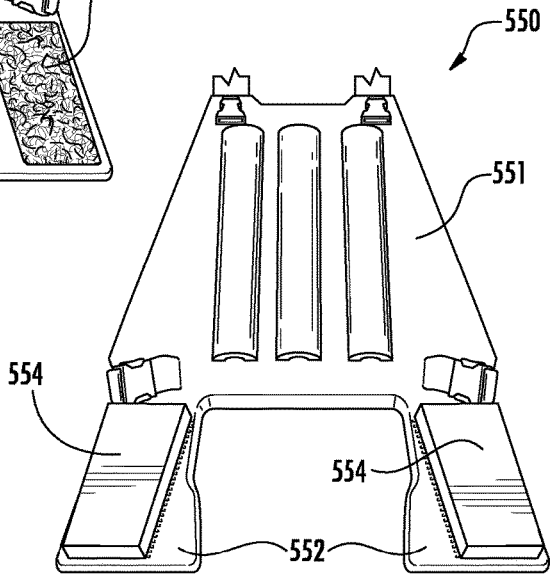
FIG. 29 is a perspective view of the body surfing device of FIG. 28 showing leg mounts in a first position according to an embodiment of the present invention.
Figure 30:
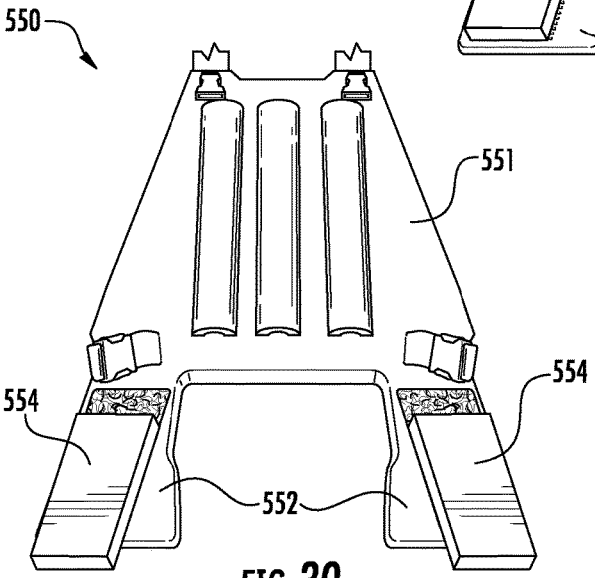
FIG. 30 is a perspective view of the body surfing device of FIG. 28 showing leg mounts in a second position according to an embodiment of the present invention.

FIGS. 28 through 30 illustrate removable leg mounts 554 that can be used to extend the length of leg fins 552 or be used as added cushioning for a user's legs. Leg fins 552 can include a fastener 553, which can be, for example, a hook and loop type fastener. Leg mounts 554 can be removably attached in any number of positions along fastener 553. Two example positions are illustrated in FIGS. 29 and 30. The size and shape of leg fins 552 and leg mounts 554 can vary.

Figure 31:
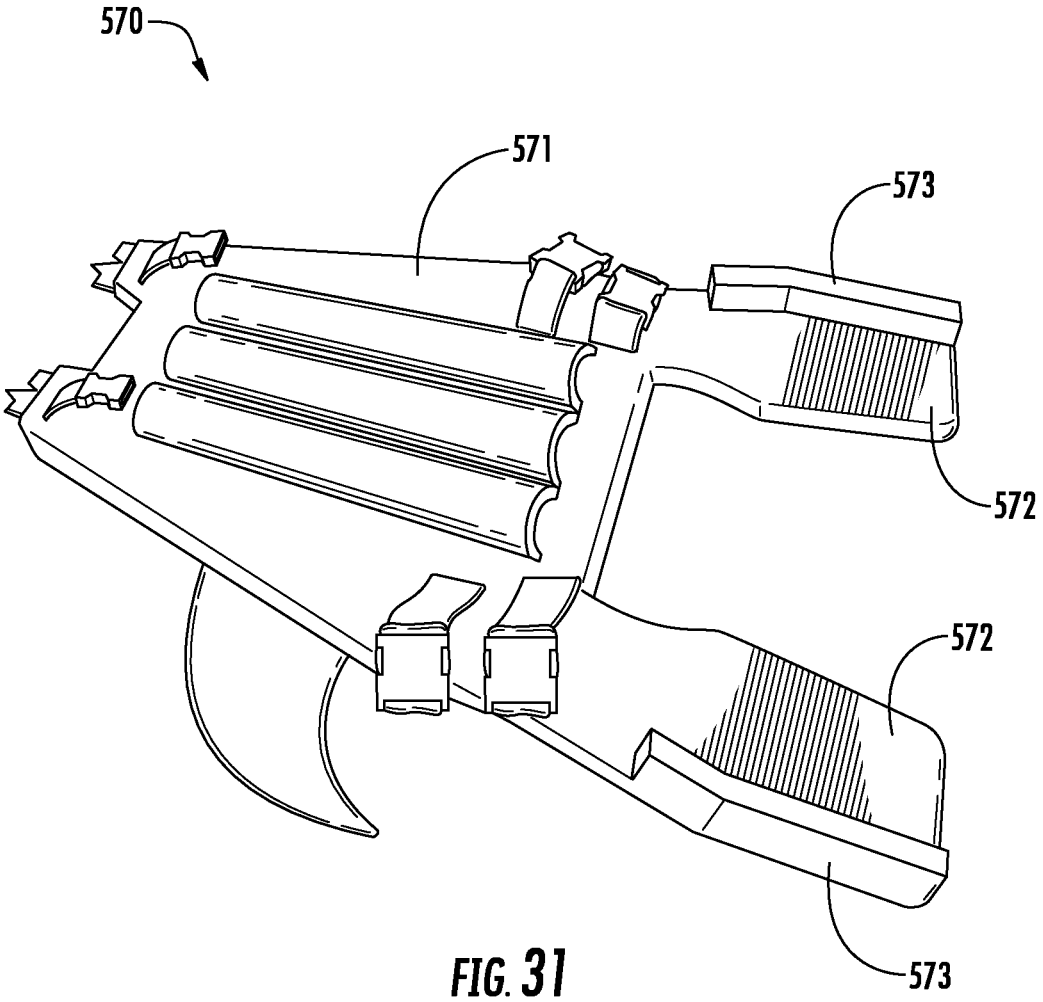
FIG. 31 is a perspective view of a body surfing device having leg fins with leg stops according to an embodiment of the present invention.

FIG. 31 shows body surfing device 570 having leg stops 573. Leg stops 573 are an elevated portion of leg fins 572 located at or near the outside edge of leg fins 572. Leg stops 573 can be used to prevent a user's leg from moving off of leg fin 572.

Figure 32:
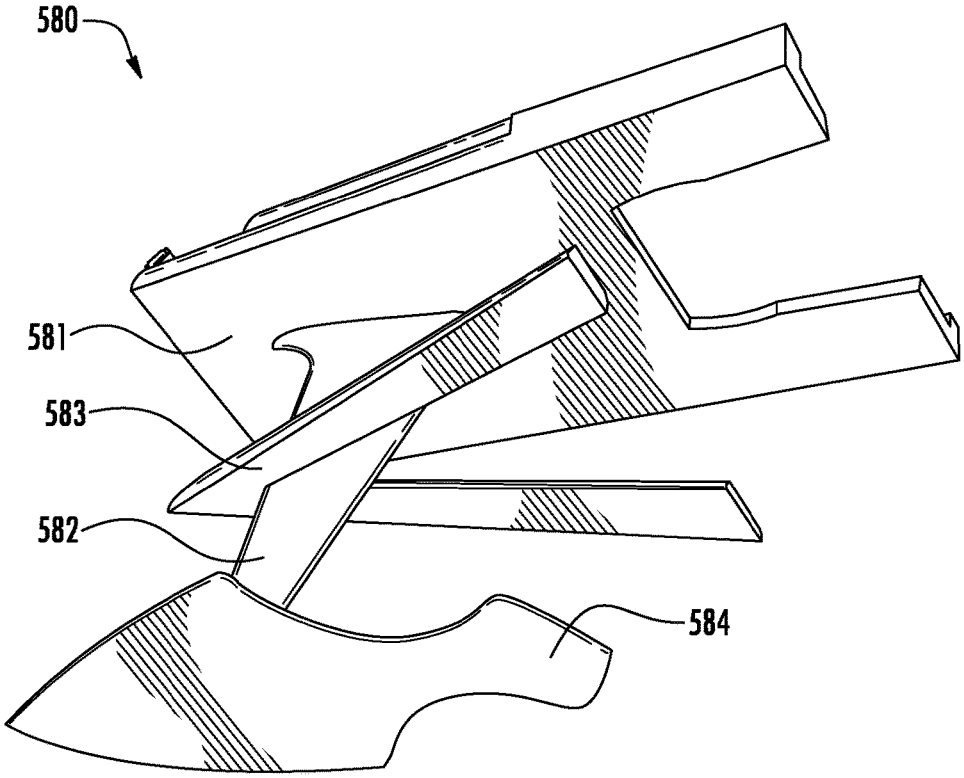
FIG. 32 is a perspective view of a body surfing device having multiple wing extensions according to an embodiment of the present invention.
Figure 33:
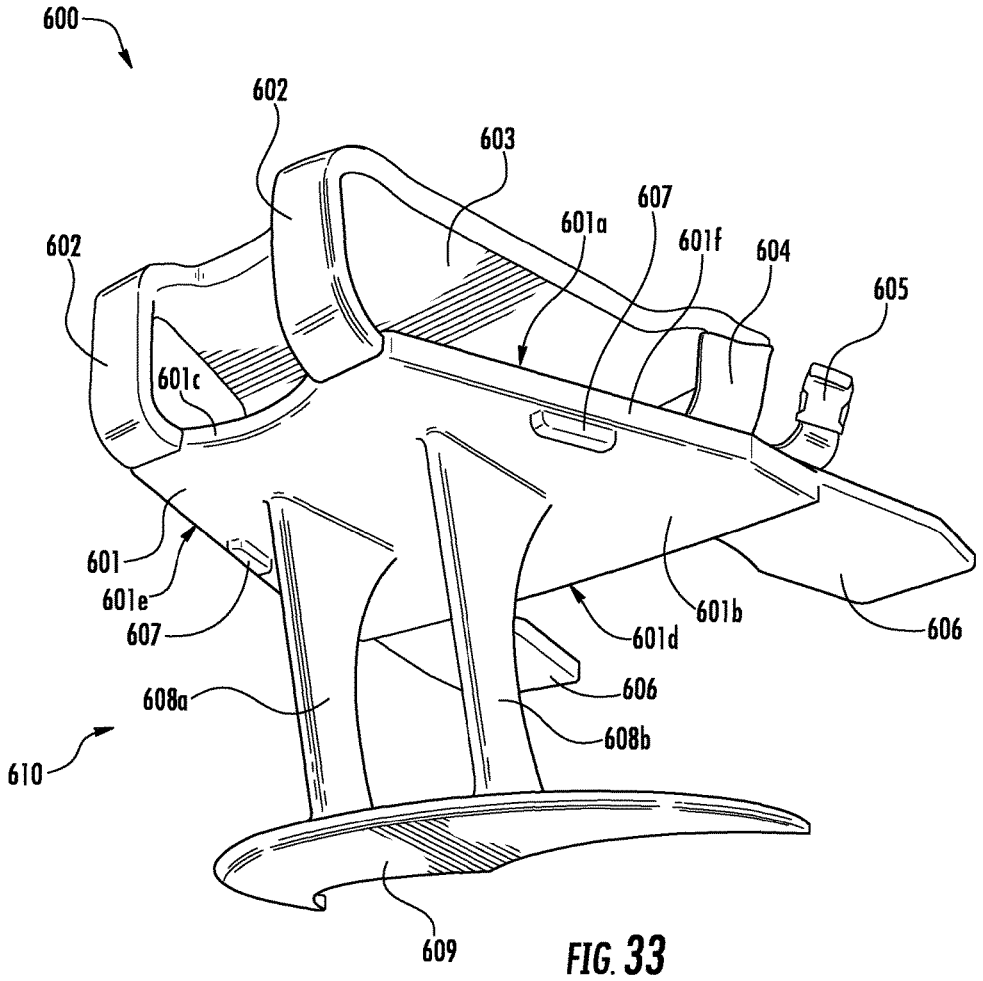
FIG. 33 is a perspective view of a body surfing device having hand grips, and dual strut wing attachment according to an embodiment of the present invention.

The wing attachments of embodiments of the invention can have multiple wing extension and/or multiple struts. As shown in FIG. 32, body surfing device 580, includes two wing extensions—primary wing extension 584 and secondary wing extension 583—connected to a single strut—strut 582. Strut 582 connects to base 581. Body surfing device 600, shown in FIG. 33, includes a single wing extension—wing extension 609—and two struts—struts 608*a* and 608*b*. Struts 608*a* and 608*b* connect to base 601.

Figure 35:
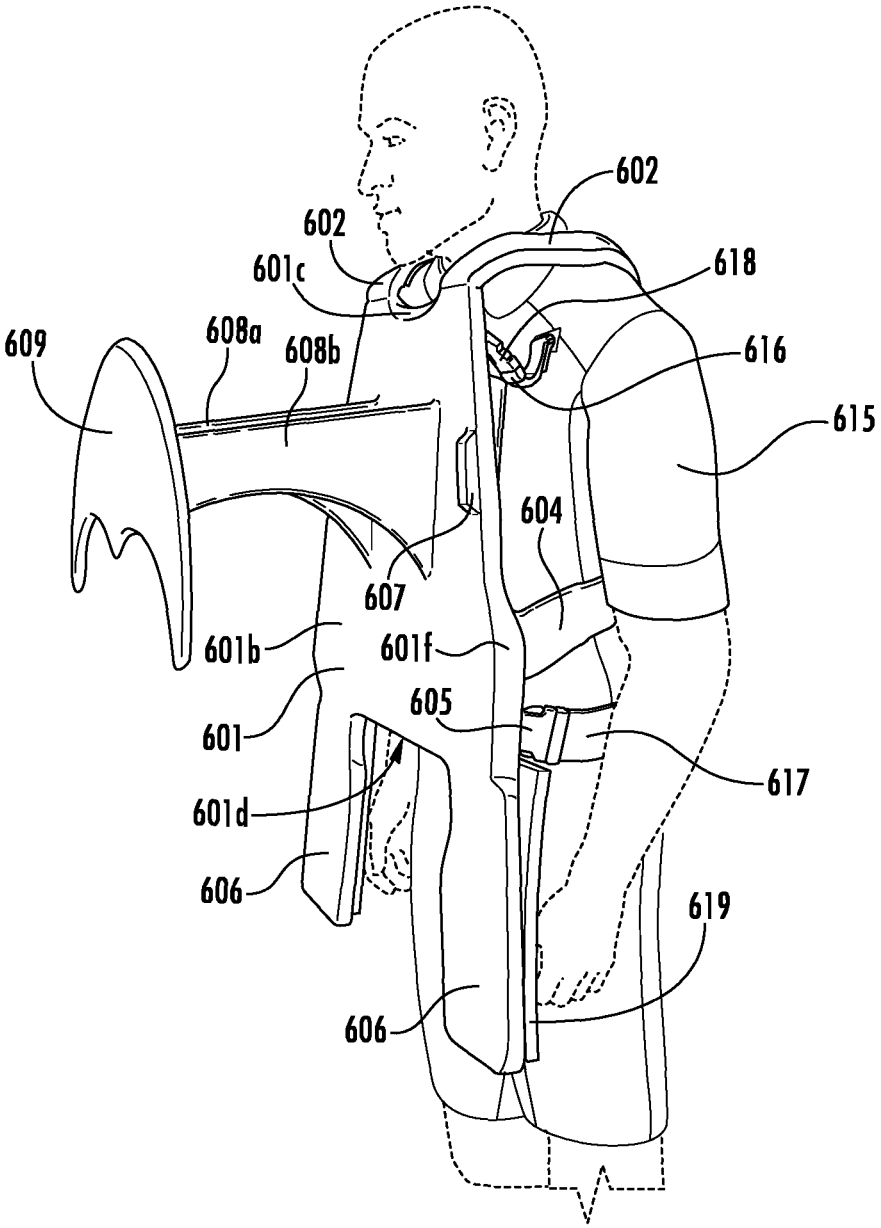
FIGS. 35 through 37 are perspective views of a body surfing device secured to a user wearing a wetsuit according to an embodiment of the present invention.
Figure 36:
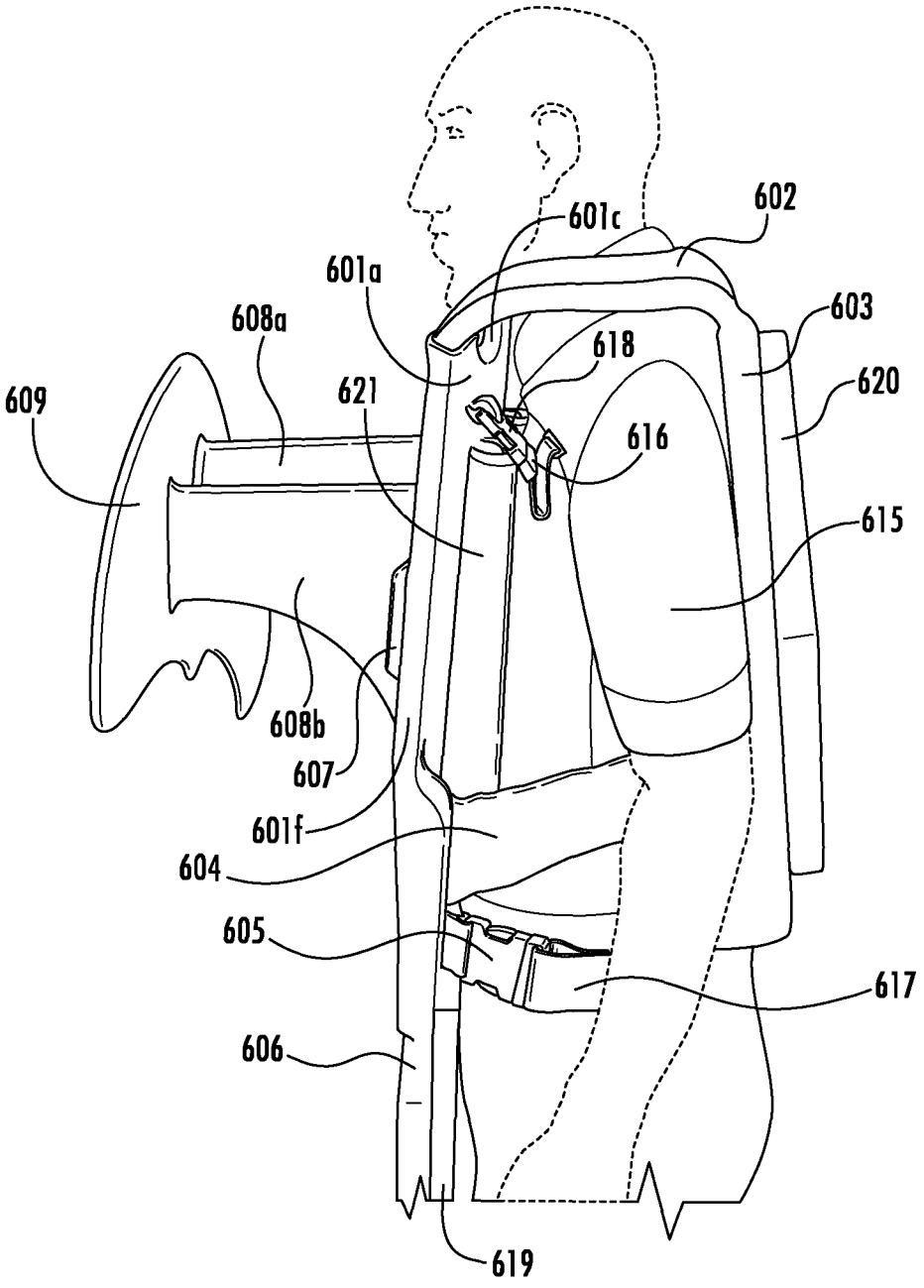
Figure 37:
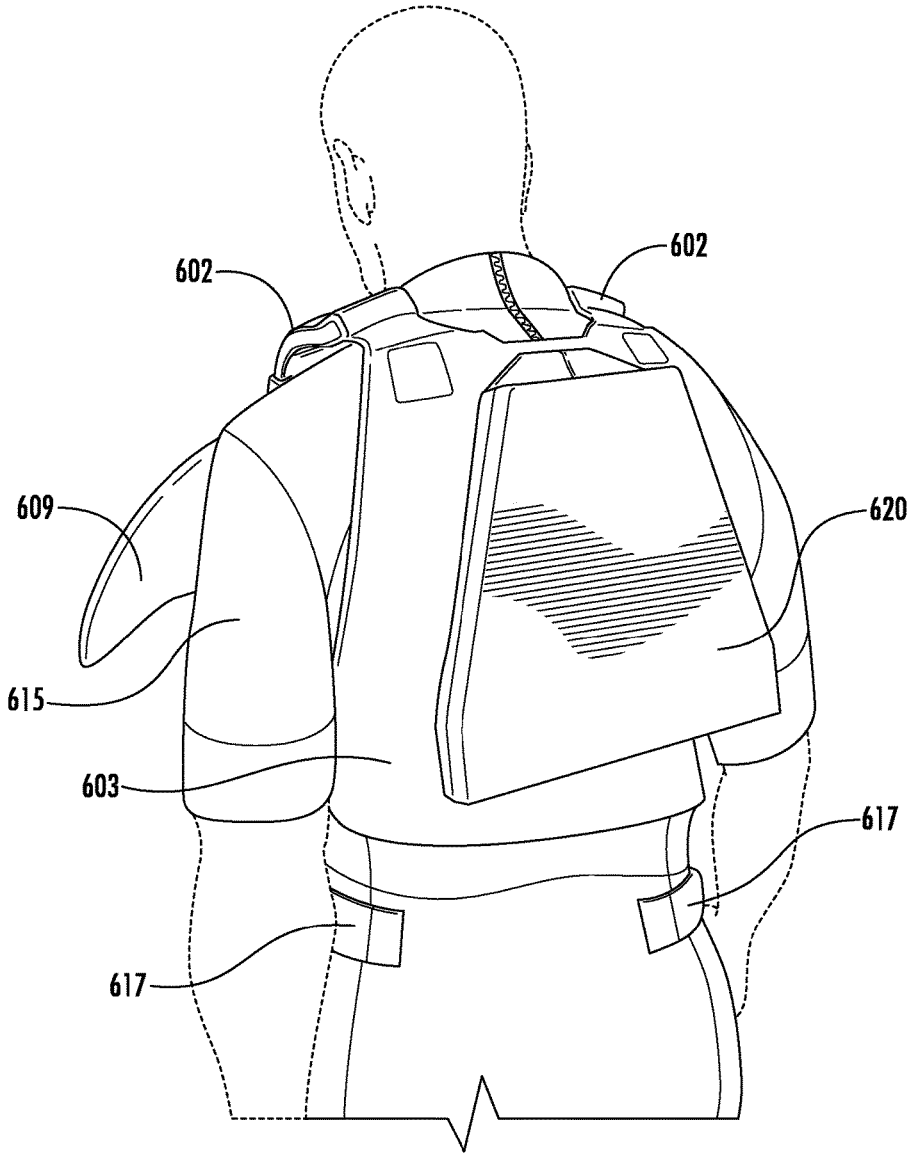

FIGS. 33 through 37 show body surfing device 600 (FIGS. 33, 35-37), wetsuit 615 (FIGS. 34-37), and both body surfing device 600 and wetsuit 615 being worn by a user (FIGS. 35-37). Body surfing device 600 comprises base 601 and dual-strut wing attachment 610. Base 601 has top surface 601*a* and bottom surface 601*b*. When worn by a user, top surface 601*a* faces the user and bottom surface 601*b* faces the water. Base 601 also has front side 601*c*, back side 601*d*, right side 601*e*, and left side 601*f*. In use, front side 601*c* is the portion of base 601 nearest a user's head and back side 601*d* is the portion of base 601 nearest a user's waist. When worn, right side 601*e* would be on a user's right side and left side 601*f* would be on a user's left side. Base can also include hand grips 607, which are elevated portions of bottom surface 601*b* located at or near right side 601*e* and left side 601*f*. Leg fins 606 can also protrude from back side 601*d* of base 601. Leg mounts 619 can be removably attached to at least a portion of leg fins 606.

Dual-strut wing attachment 610, which includes right wing strut 608*a*, left wing strut 608*b* and wing extension 609, attaches to base 601 on bottom surface 601*b*. While a fixed attachment is illustrated, brackets can also be used to removably attach right wing strut 608*a* and left wing strut 608*b* to base 601 in a manner similar to that described above with reference to FIGS. 1-4. Dual-strut wing attachment 610 can also be made extendable in a manner similar to that described above with reference to FIGS. 18-20, 23 and 24. The size and shape of right wing strut 608*a*, left wing strut 608*b* and wing extension 609 are exemplary.

Separation members 621 are attached to top surface 601*a* of base 601. In use, separation members 621 rest against the user's chest. Although only one separation member can be readily viewed (in FIG. 36), other separation members can be included on top surface 601*a*. Exemplary placement of separation members is described in detail with reference to other embodiments presented above.

Back cover 603 is connected to base 601 via shoulder straps 602. Shoulder straps 602 are connected to base 601 at or near front side 601*c*. In use, back cover 603 can be worn on the user's back. Buoyant material, such as back floatation member 620, can be added to back cover 603 to help prevent the user from rolling over onto his/her back in the water.

In addition to shoulder straps 602, back cover 603 can be connected to base 601 at upper waist strap 604. Upper waist strap 604 can be a stretchable material to allow the user to pull the device over his/her head and shoulders. Upper waist strap 604 can comprise a detachable connection, such as, for example, a parachute buckle. Upper waist strap 604 can connect to top surface 601*a* at or near left side 601*f* and at or near bottom side 601*b*. An additional upper waist strap (not shown) connecting back cover 603 and base 601 can be located at or near right side 601*f* and at or near bottom side 601*b*.

Body surfing device 600 can also include lower waist strap 605, which can connect to top surface 601*a* of base 601 at or near left side 601*f* and at or near bottom side 601*b*. An additional lower waist strap (not shown) can be connected to top surface 601*a* of base 601 at near right side 601*f* and at or near bottom side 601*b*. Lower waist strap 605 can include a fastener to detachably connect lower waist strap 605 to wetsuit waist strap 617 on wetsuit 615. Alternatively, lower waist strap 605 and the waist strap attached at or near right side 601*e* can detachably connect with each other and be used to wrap around the user's back.

Base chest straps 618 located on top surface 601*a* at or near front side 601*c* of base 601 and at or near left side 601*f* and right side 601*e*, respectively, can be used to detachably connect body surfing device 600 to wetsuit 615. Wetsuit chest straps 616 are affixed to wetsuit 615 and can connect to respective base chest straps 618 to secure body surfing device 600 to wetsuit 615.

Figure 38:
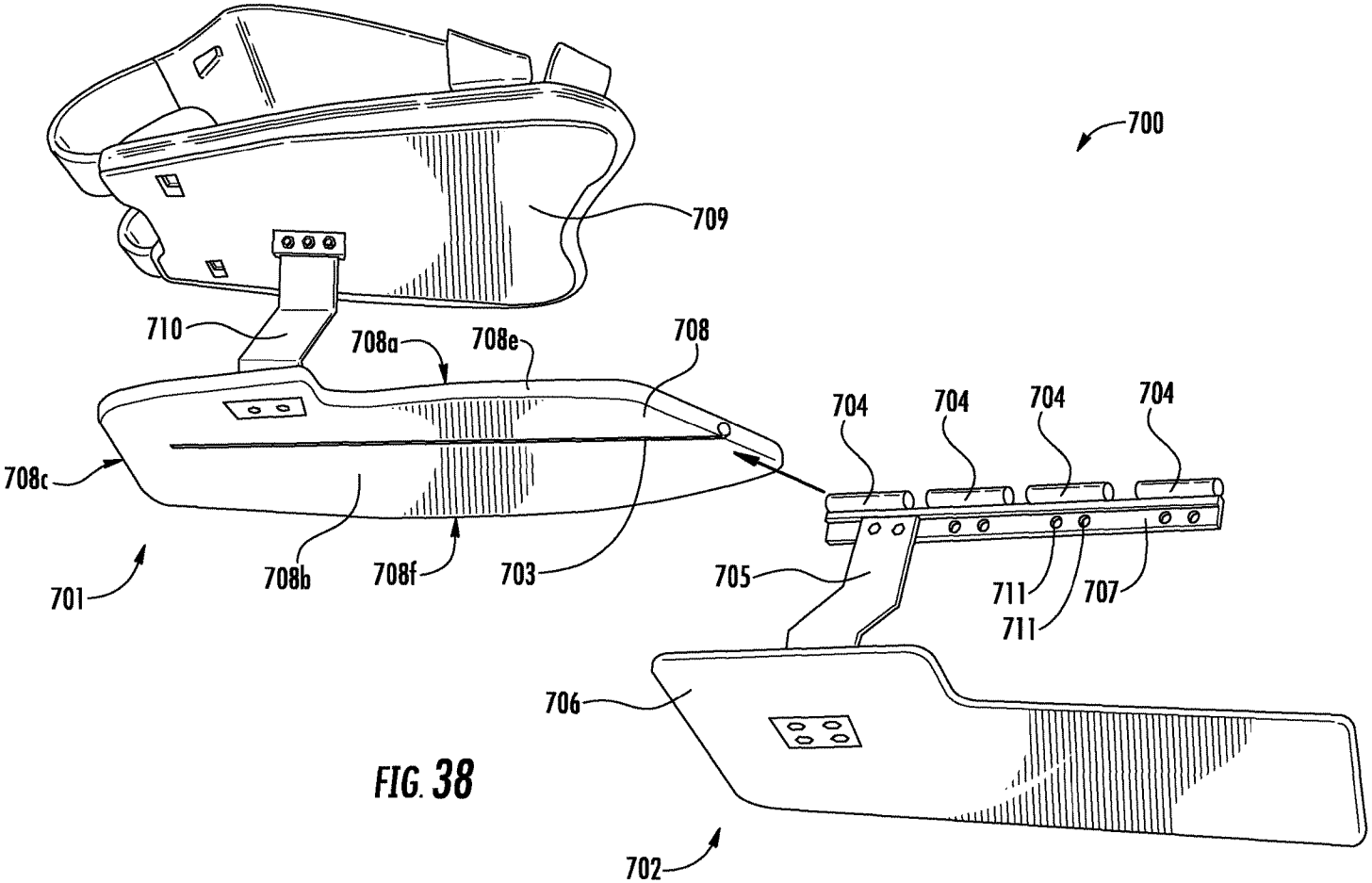
FIGS. 38 and 39 are perspective views of a body surfing device having dual wing attachments according to an embodiment of the present invention.
Figure 39:
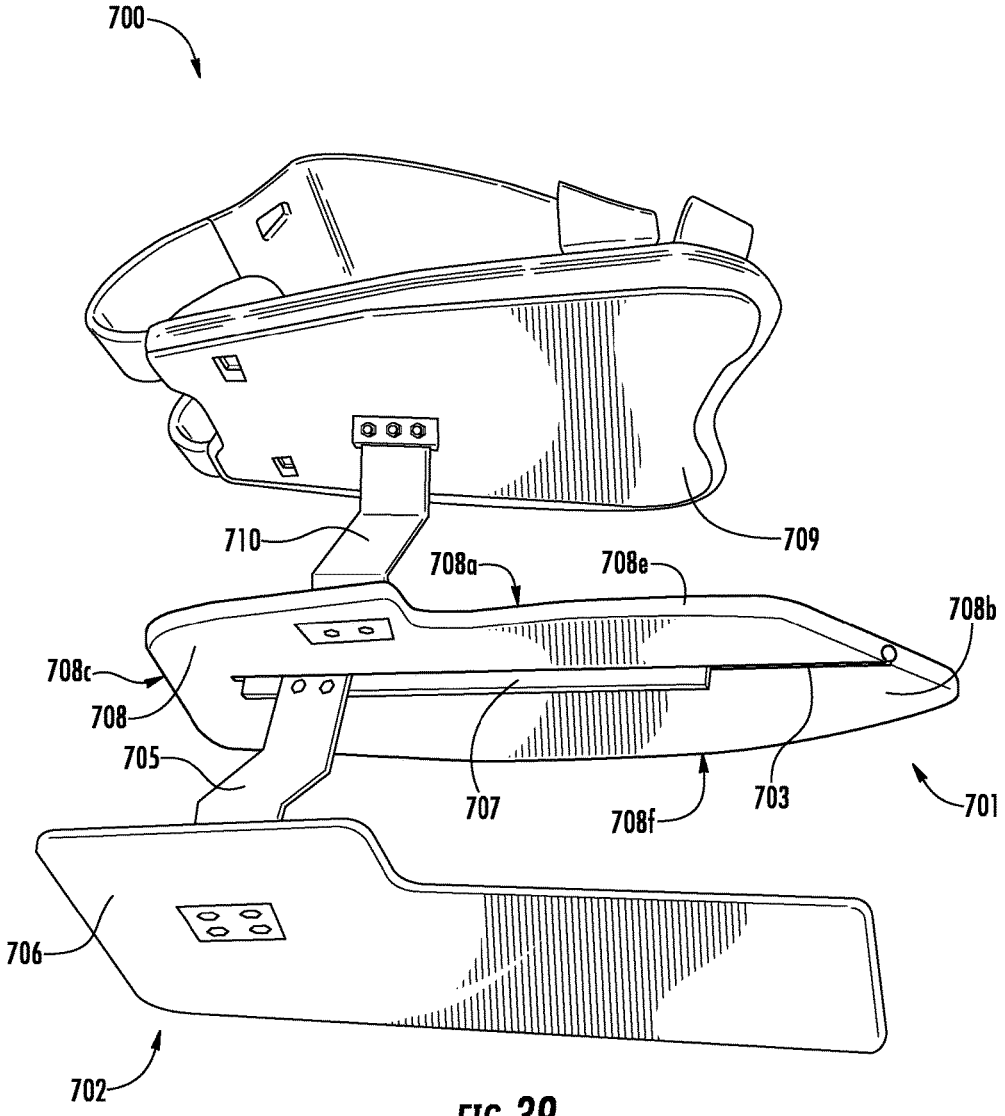

Embodiments of the present invention can include more than one wing attachment. Although two wing attachments are described, additional wing attachment can be added in the same manner. As illustrated in FIGS. 38 and 39, body surfing device 700 includes base 709, primary wing attachment 701 and secondary wing attachment 702. Primary wing attachment 701 includes primary wing strut 710 and primary wing extension 708. Top surface 708*a* of primary wing strut 710 can be permanently affixed to base 709, formed from the same piece as base 709, or detachably affixed to base 709. A detachable mounting mechanism is illustrated in FIGS. 38 and 39. Primary wing strut 710 is detachably affixed to base 709 using a bracket and fasteners. The bracket can also be a slide- and self-lock style bracket that allows the user to slide wing strut 710 into the bracket at an angle an then snap wing strut 710 into a roughly 90 degree position relative to base 709. A track and guide arrangement, as further described below, can also be used in base 709 to receive a portion of wing strut 710.

Secondary wing attachment 702 includes secondary wing strut 705 and secondary wing extension 706. Secondary wing strut 705 can be permanently affixed to primary wing extension 708, formed from the same piece as primary wing extension 708 or detachably affixed to primary wing extension 708. A detachable mounting mechanism is illustrated in FIGS. 38 and 39. Secondary wing strut 705 is detachably affixed to primary wing extension 708 using track 703, which can be a channel formed in bottom surface 708*b* of primary wing extension, and guide bracket 707, which includes guides 704. Although the open end of track 703 is shown in FIGS. 38 and 39 as being positioned at back side 708*d*, the open end could also be positioned at front side 708*c*. With a slight modification to the connection between secondary wing strut 705 and guide bracket 707 and/or secondary wing extension 706, the open end of track 703, could also be positioned at right side 708*e* or left side 708*f* of primary wing extension 708. Alternatively, track 703 can be a bracket-style track that is affixed to bottom side of primary wing extension 708. Guide bracket 707 is rigidly connected to secondary wing strut 705. Guide bracket 707 can be detachably affixed to secondary wing strut 705. Holes 711 along guide bracket 707 can be used to attach secondary wing strut 705, which allows secondary wing strut 705 to be positioned at different places along guide bracket 707 and on primary wing extension 708 when guide bracket 707 is fully engaged with track 703. Guides 704 can slidingly engage with track 703. Guide bracket 707 and track 703 can be a slide and self-lock style system, or a stop that engages with guide bracket 703 can be added to bottom surface 708*b*. Secondary wing strut 705 can also be attached to bottom surface 708*b* using a bracket and fasteners as illustrated for the connection between primary wing strut 710 and base 709.

Figure 40:
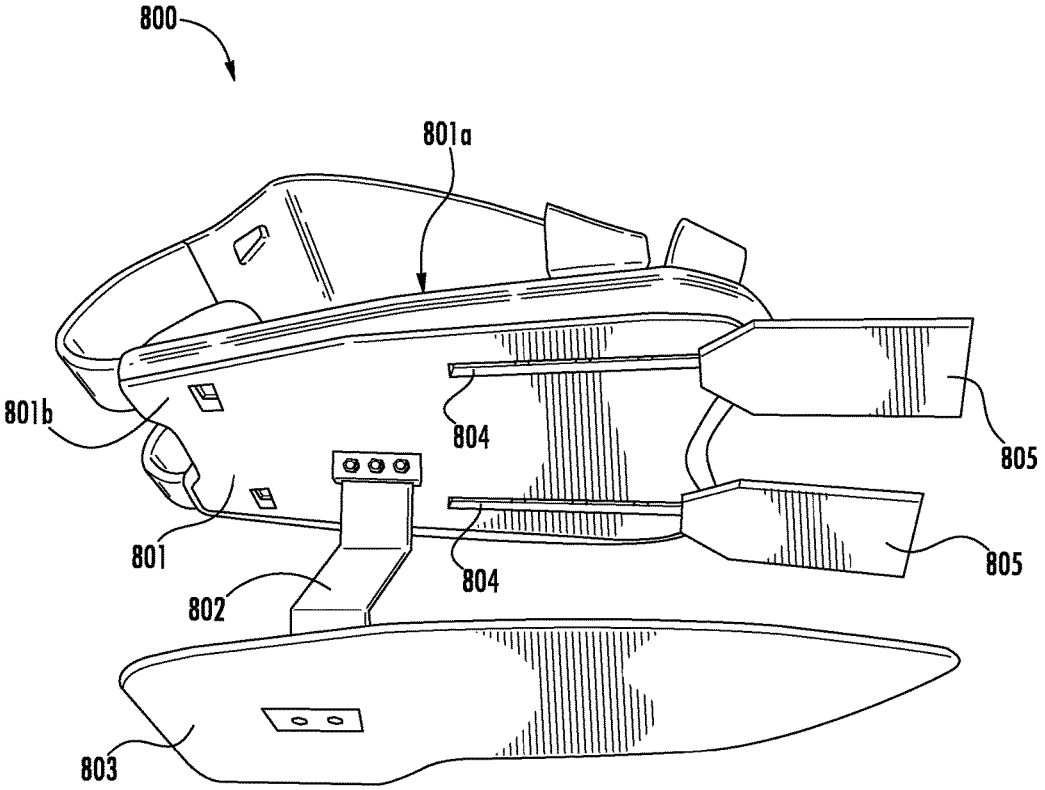
FIG. 40 is a perspective view of a body surfing device having extendable leg fins showing the extendable leg fins in their extended position according to an embodiment of the present invention.
Figure 41:
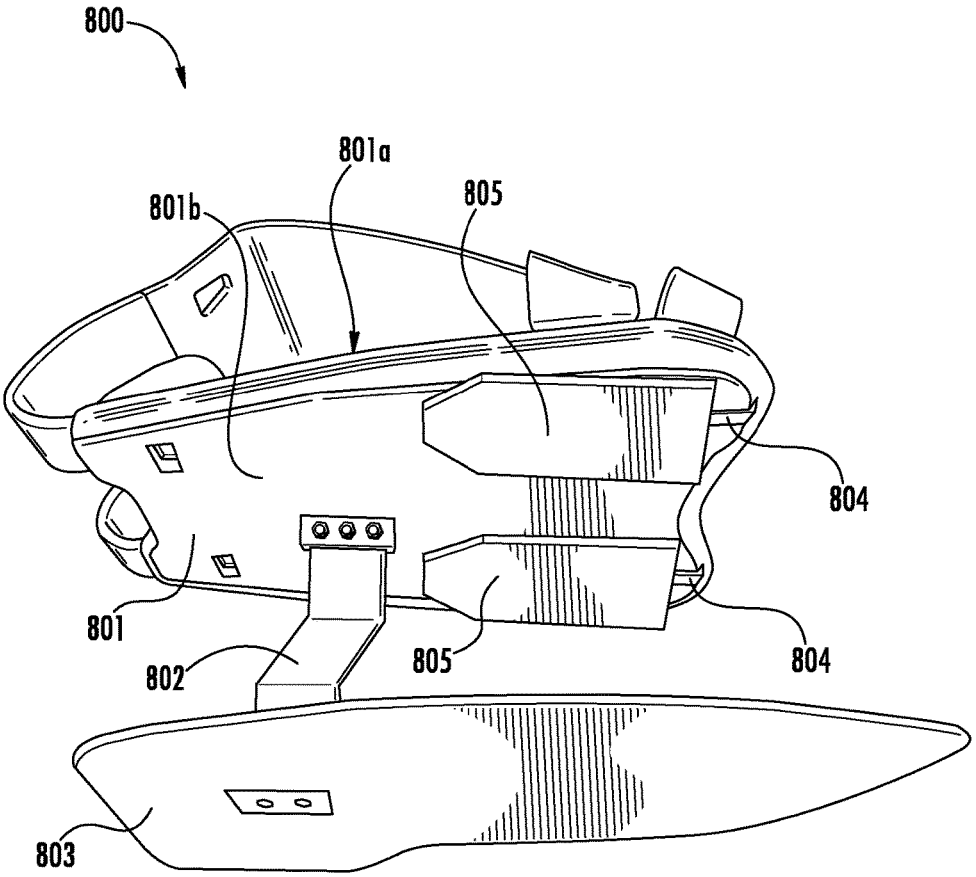
FIG. 41 is a perspective view of the body surfing device of FIG. 40 showing the extendable leg fins in their retracted position.

Embodiments of the present invention can also include extendable leg fins. As illustrated in FIGS. 40 and 41, body surfing device 800 includes base 801, wing strut 802 attached to base 801, wing extension 803 attached to wing strut 802, and extendable leg fins 805. Base 801 includes tracks 804, which can be a channel formed in bottom surface 801*b* of base 801 as shown or, alternatively, a bracket-style track that is affixed to bottom surface 801*b* of base 801. A guide bracket (not shown) having guides (not shown) similar to, for example, guide bracket 707 and guides 704 described with respect to the embodiment shown in FIGS. 39 and 40, is positioned on extendable leg fins 805. The guides (not shown) are in sliding communication with track 804. FIG. 40 illustrates extendable leg fins 805 in their extended position and FIG. 41 illustrates extendable leg fins 805 in their retracted position. Extendable leg fins 805 fins can also be detachably affixed so that leg fins of other shapes and sizes can be attached to base 801. The distance between base 801 and extendable leg fins 805 shown here is exemplary. The distance can be increased by using a longer guide bracket or even including a strut between the guide bracket (not shown) and extendable leg fins 805. The position of extendable leg fins 805 at bottom side 801*b* is exemplary. Extendable leg fins 805 can also be positioned at top side 801*a* of back 801 with a track or bracket located on top side 801*a*. Alternatively, extendable leg fins 805 can be located inside a cutout (or cavity) of base 801, in between top surface 801*a* and bottom surface 801*b*. In addition, extendable leg fins 805 could be connected together to form a single leg fin extending from base 801.

The leg fins discussed herein, including extendable leg fins 805, rotating leg fins 405*a* and 405*b*, and leg fins 505, 552, 572, and 606 can also include fin struts, similar to wing struts, attached thereto and fin extensions, similar to wing extensions, attached to the wing struts.

A sliding extension of the base of body surfing device, as shown and described in U.S. Pat. No. 8,216,013, which is herein incorporated by reference, can also be used with embodiments of the present invention.

Figure 42:
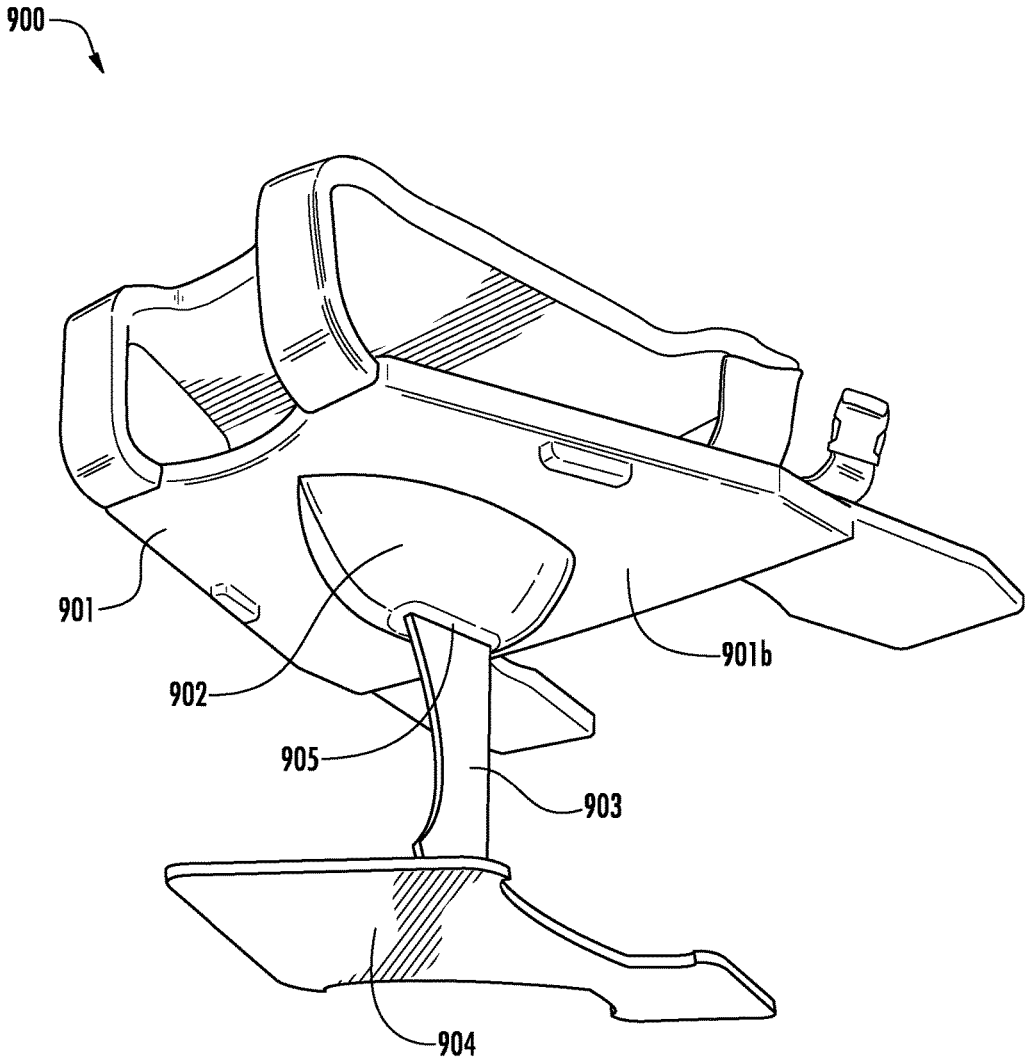
FIG. 42 is a perspective view of a body surfing device illustrating an alternative base-strut connection according to an embodiment of the present invention.
Figure 43:
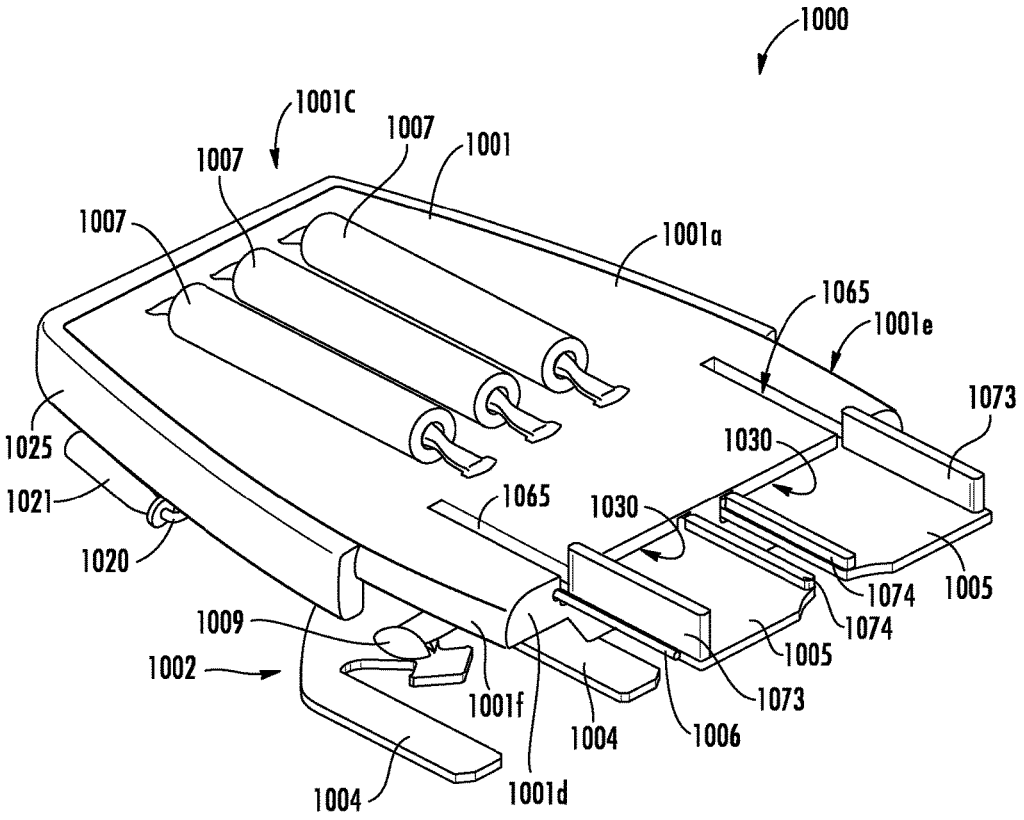
FIG. 43 is a top perspective view of a body surfing device having extendable nesting leg fins and a deployable wing attachment showing the leg fins in their extended position and the wing attachment in its deployed position according to an embodiment of the present invention.
Figure 44:
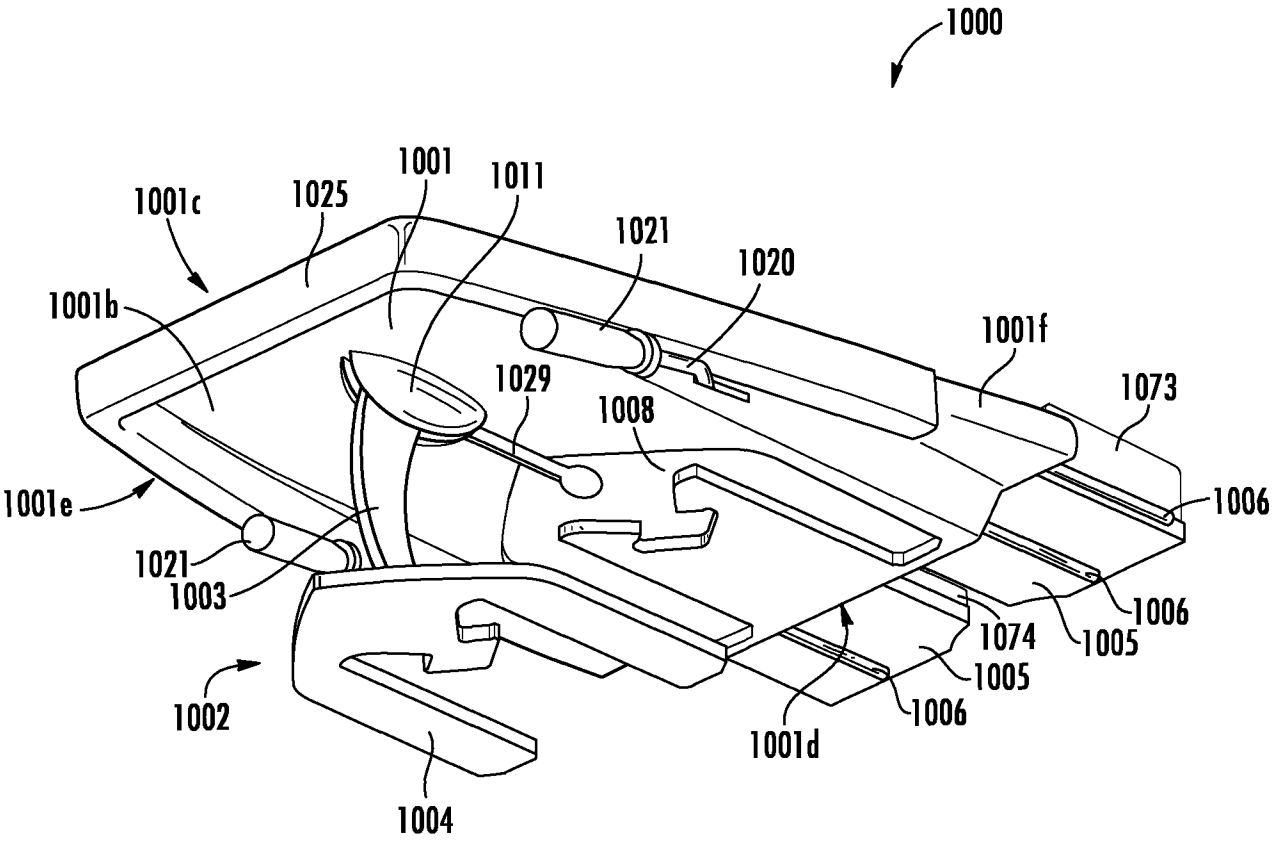
FIG. 44 is a bottom perspective view of the body surfing device of FIG. 43 showing the leg fins in their extended position and the wing attachment in its deployed position according to an embodiment of the present invention.
Figure 45:
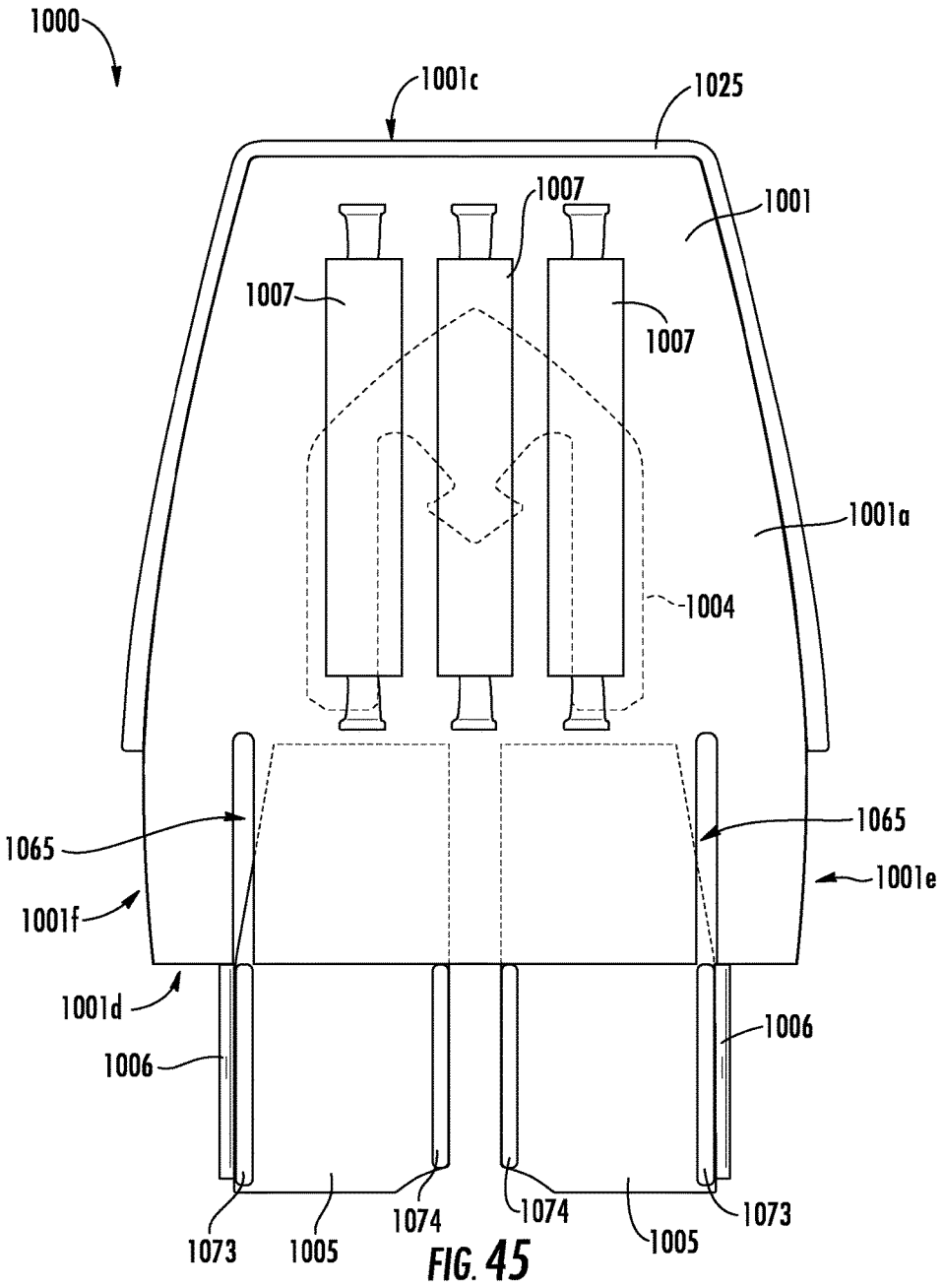
FIG. 45 is a top plan view of the body surfing device of FIG. 43 showing the leg fins in their extended position and the wing attachment in its deployed position according to an embodiment of the present invention.
Figure 46:
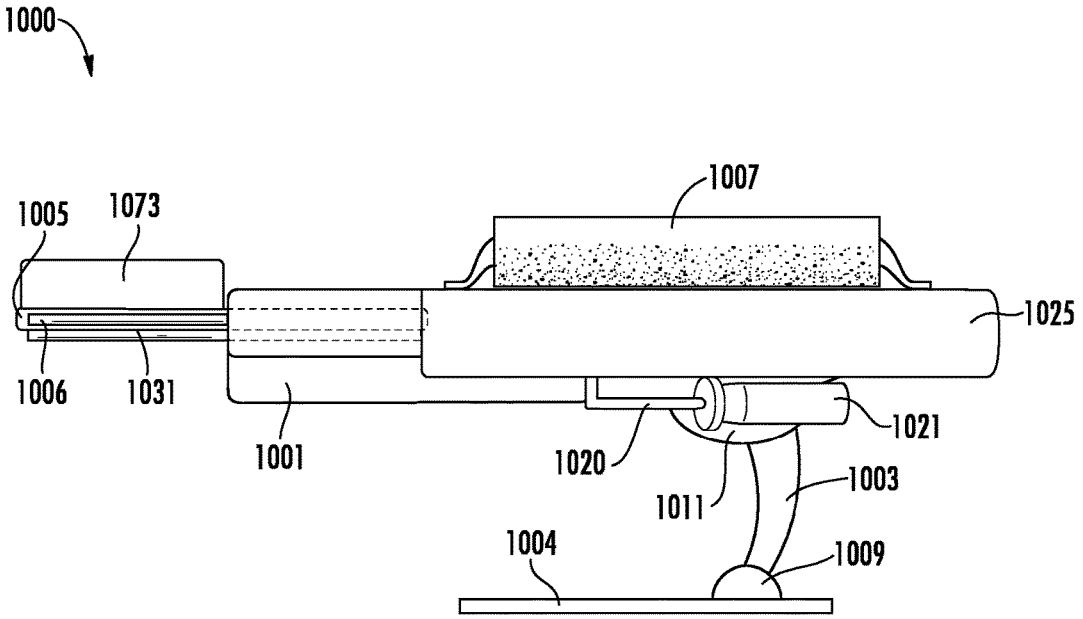
FIG. 46 is a right side elevational view of the body surfing device shown in FIG. 43 showing the leg fins in their extended position and the wing attachment in its deployed position according to an embodiment of the present invention.
Figure 47:
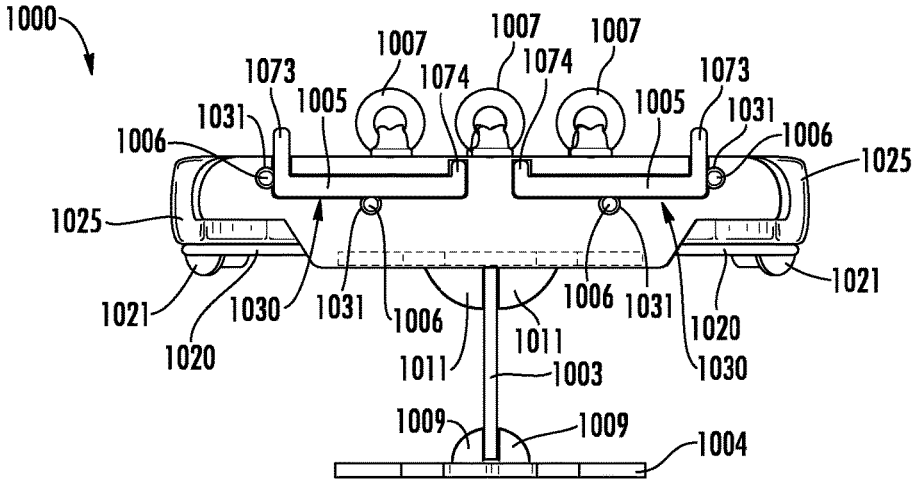
FIG. 47 is a back side elevational view of the body surfing device shown in FIG. 43 showing the leg fins in their extended position and the wing attachment in its deployed position according to an embodiment of the present invention.
Figure 48:
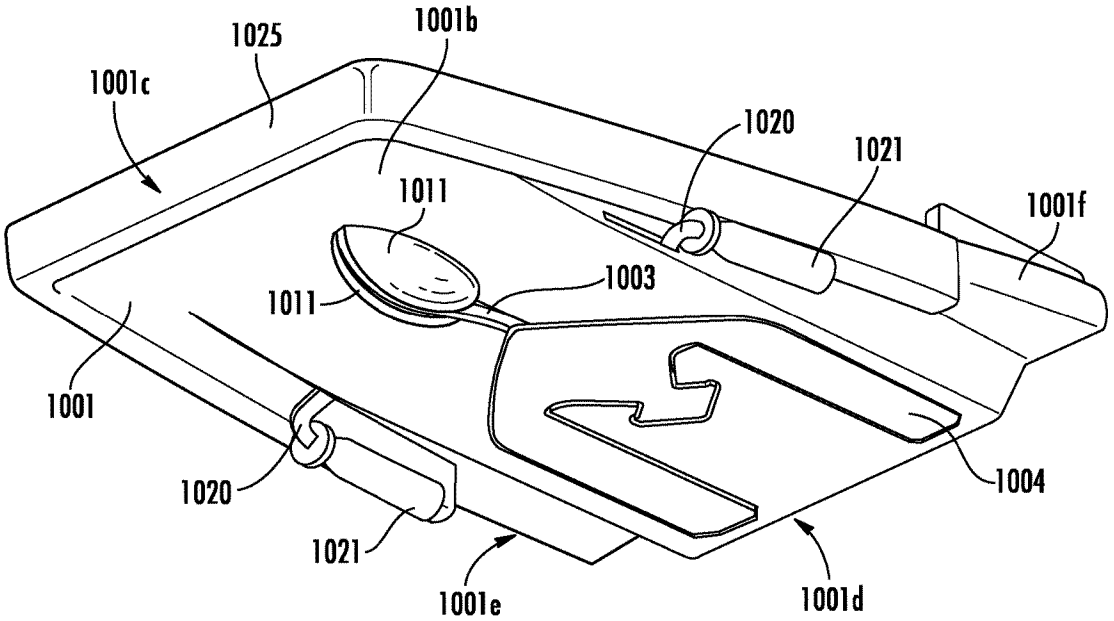
FIG. 48 is a bottom perspective view of the body surfing device of FIG. 43 showing the leg fins in their retracted position and the wing attachment in its stowed position.
Figure 49:
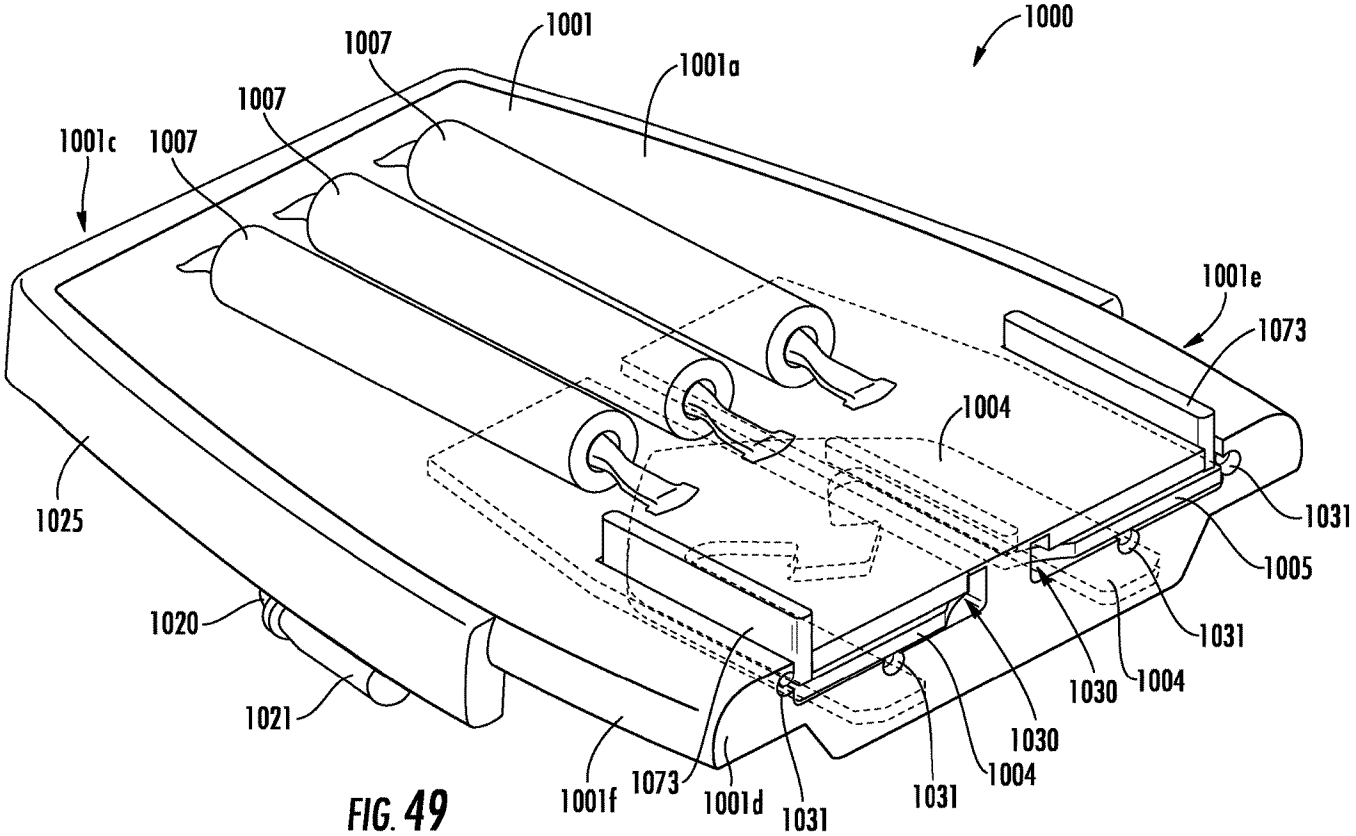
FIG. 49 is a top perspective view of the body surfing device of FIG. 43 showing the leg fins in their retracted position and the wing attachment in its stowed position according to an embodiment of the present invention.
Figure 50:
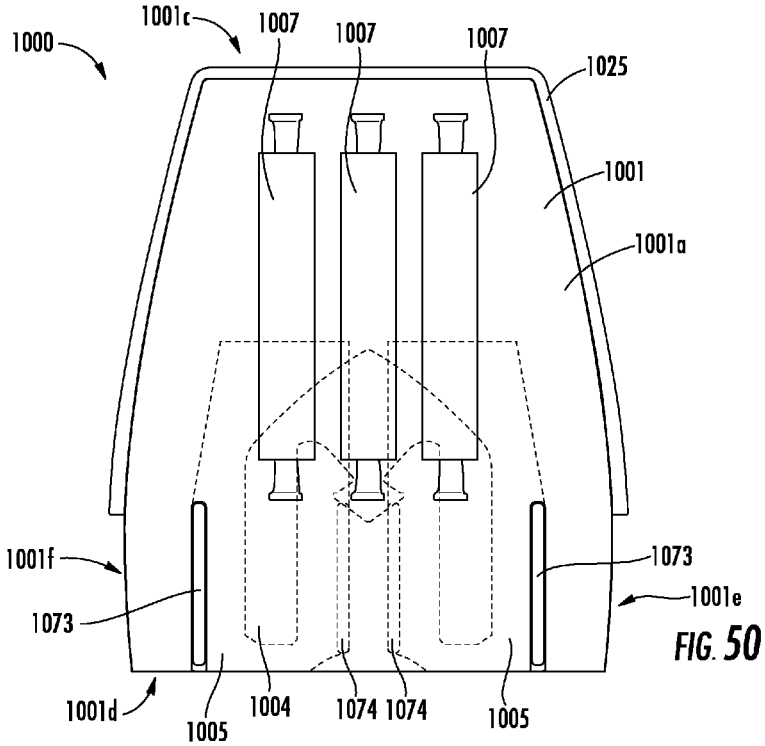
FIG. 50 is a top plan view of the body surfing device of FIG. 43 showing the leg fins in their retracted position and the wing attachment in its stowed position according to an embodiment of the present invention.
Figure 51:
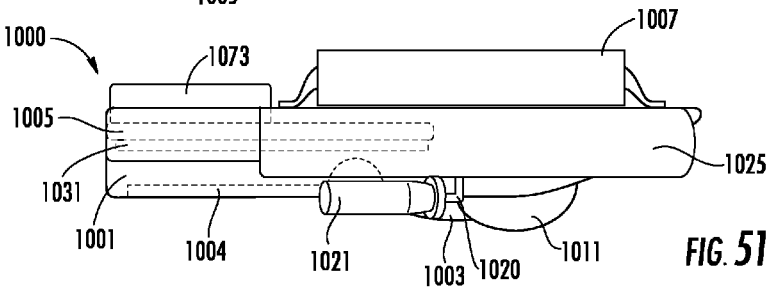
FIG. 51 is a right side elevational view of the body surfing device of FIG. 43 showing the leg fins in their retracted position and the wing attachment in its stowed position according to an embodiment of the present invention.
Figure 52:
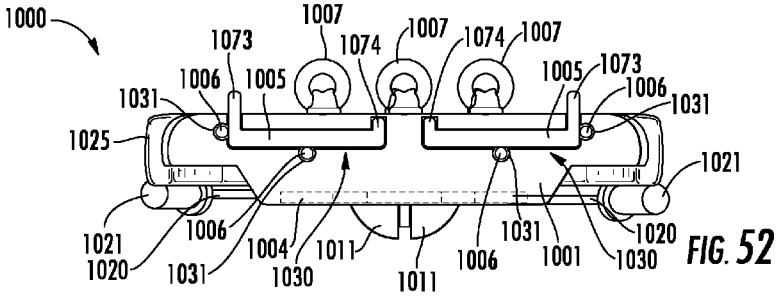
FIG. 52 is a back side elevational view of the body surfing device shown in FIG. 43 showing the leg fins in their retracted position and the wing attachment in its stowed position according to an embodiment of the present invention.

Embodiments of the present invention include alternative shapes to the bottom surface of the base. In an exemplary embodiment shown in FIG. 42, body surfing device 900 comprises base 901 having bottom surface 901*b* with protrusion 902 at its center. Protrusion 902 can curve convexly or concavely down from bottom surface 901*b* to apex 905. Protrusion 902 can also be shaped similarly to a boat's hull. Wing strut 903 is affixed to protrusion 902 at apex 905. Wing extension 904 is affixed to wing strut 903.

Body surfing devices of the present invention can also include one or more embedded or attached electro magnets. Such electro magnets will serve to repel sharks and other sea life. The components of the electro magnets are fully encapsulated in a water proof container. The electro magnet is an electroshock technology created using a step-up transformer or step-up solid state device that converts a small voltage battery (e.g. 12V) to a high voltage (e.g. 2,000V) at a high frequency. The stepped-up output is attached to a copper or copper alloy coil creating an 'always on' circuit. The pulse frequency of the electro magnet can be altered to deliver a long lasting battery charge. An additional 'emergency' circuit can also be included that is in parallel to the 'always on' circuit. This circuit can be activated manually and will provide an additional voltage to the electro magnet to greatly increase the voltage (e.g. 20,000V).

Embodiments of the body surfing device described herein include extendable nesting leg fins and a deployable nesting wing attachment. As illustrated in FIGS. 43 through 53, body surfing device 1000 includes extendable leg fins 1005 and deployable wing attachment 1002. Although depicted in the same embodiment in FIG. 43 through 53, extendable leg fins 1005 and deployable wing attachment 1002 can be implemented separately and/or in combination with features described with respect to other embodiments.

Body surfing device 1000 comprises base 1001, deployable wing attachment 1002 having wing strut 1003 and wing extension 1004, and extendable leg fins 1005. Although not shown, connections to shoulder straps or permanent shoulder straps as shown in other embodiments may also be utilized with body surfing device 1000. Base 1001 has top surface 1001*a* and bottom surface 1001*b*. In use, top surface 1001*a* faces the user and bottom surface 1001*b* faces the water. Base 1001 also has front side 1001*c*, back side 1001*d*, right side 1001*e* and left side 1001*f*. In use, front side 1001*c* is the portion of base 1001 nearest a user's head and back side 1001*d* is the portion of base 1001 nearest a user's waist. In use, right side 1001*e* would be on a user's right side and left side 1001*f* would be on a user's left side.

Figure 55:
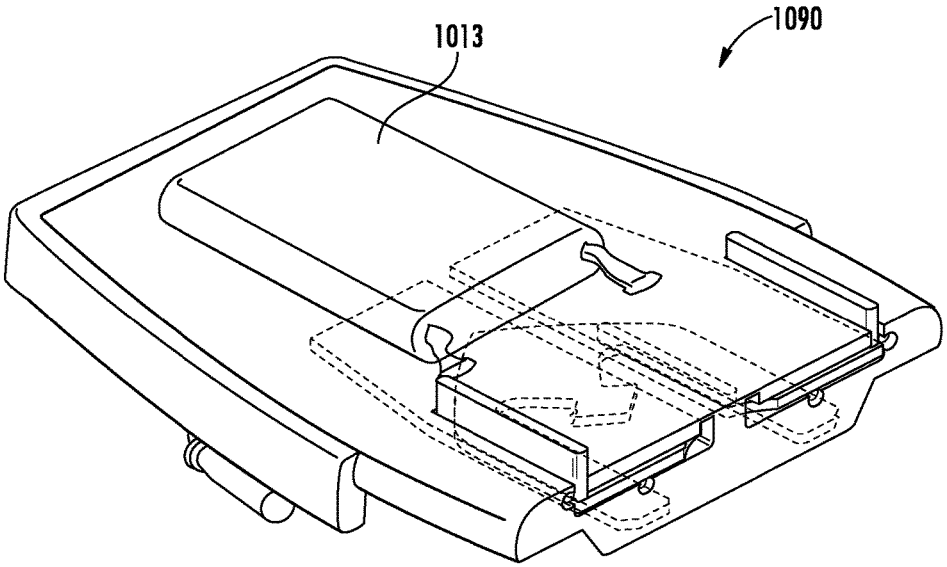
FIG. 55 is a top perspective view of a body surfing device having the same base as the body surfing device of FIG. 43 and an alternative separation member according to an embodiment of the present invention.
Figure 56:
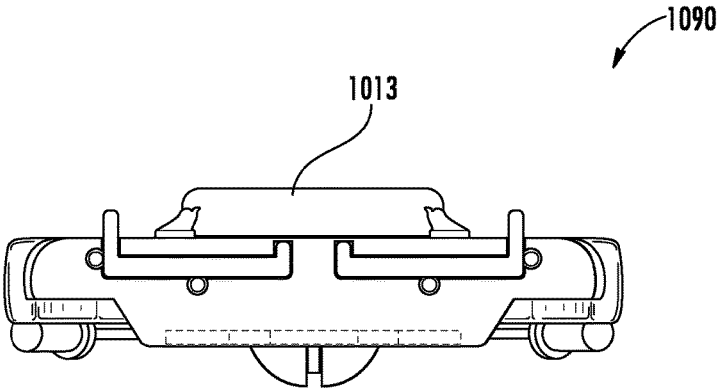
FIG. 56 is a back side elevational view of the body surfing device of FIG. 55 according to an embodiment of the present invention.

Separation members 1007, similar to those shown and described with respect to FIG. 2, are attached to top surface 1001*a* of base 1001. The size and shape of separation members 1007 and base 1001 can vary. As shown in an exemplary embodiment in FIGS. 55 and 56, body surfing device 1090 may have separation member 1013, which is rectangular in shape.

Returning to FIGS. 43-53, Base 1001 may include hand grip 1025 on all or a portion of left side 1001*f*, front side 1001*c*, and right side 1001*e* of base 1001. On its top side hand grip 1025 may be flush with top surface 1001*a*. The bottom side of hand grip 1025 extends past the bottom surface 1001*b* of base 1001 creating a lip for a user to grasp. Embodiment may comprise multiple hand grips instead of a single continuous hand grip as shown in FIGS. 43-53.

Figure 53:
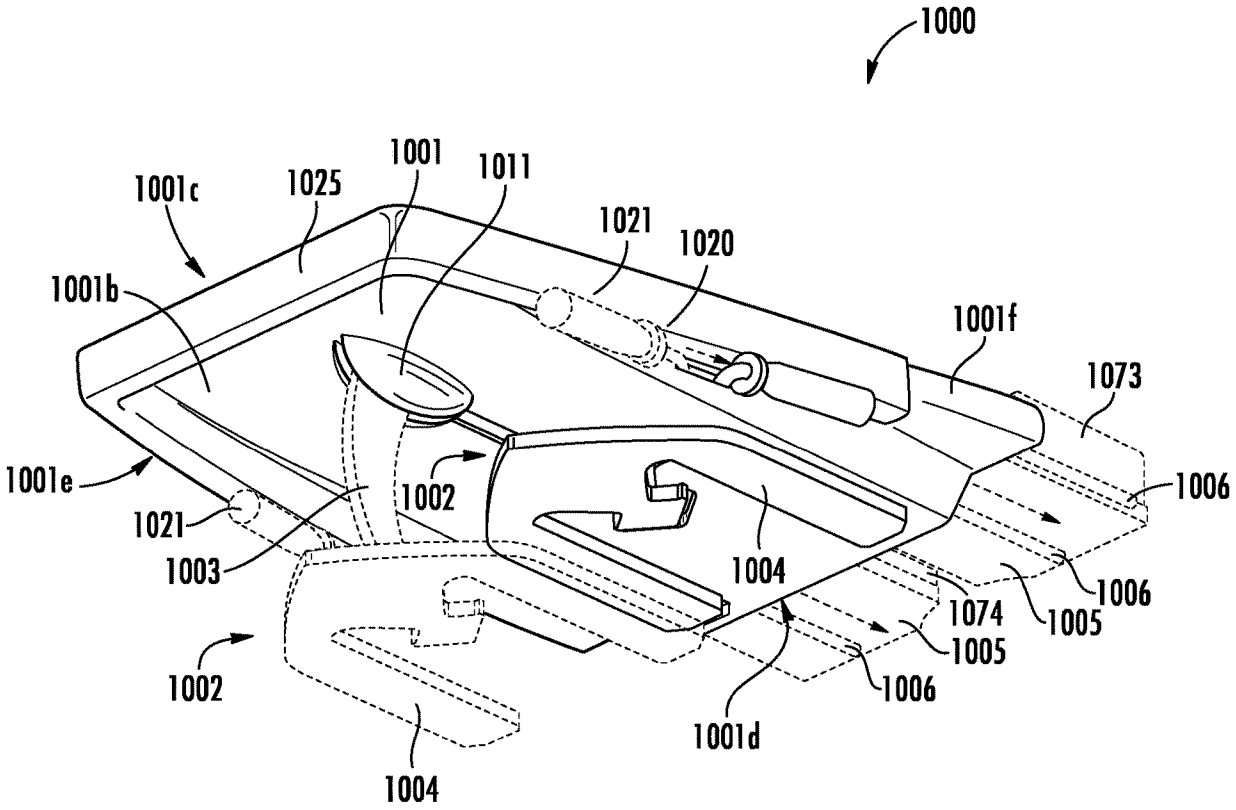
FIG. 53 is a bottom perspective view of the body surfing device of FIG. 43 showing movement of the leg fins from an extended position to a retracted position and of the wing attachment from a deployed position to a stowed position according to an embodiment of the present invention.

Base 1001 includes fin cavities 1030 in back side 1001*d* of base 1001. Fin cavities 1030 may include tracks 1031, which may be a channel formed in the center bottom and external sides of fin cavities 1030 as shown; however, the location and shape should not be construed as limiting. Tracks 1031 may be located in various locations along the cavity wall and may vary in shape and size. Extendable leg fins 1005 may comprise guides 1006 positioned in the center of their bottom side and external sides, which are in sliding communication with tracks 1031 as shown; however, the location and shape should not be construed as limiting. Guides 1006, may be located in various locations about leg fins 1005 to correspond with the respective track. Extendable leg fins 1005 are shown in their extended position in FIGS. 43 through 47. Extendable leg fins 1005 may retract into a nested position within cavities 1030. Extendable leg fins 1005 in the nested position are illustrated in FIG. 48 through 52 and the movement of leg fins 1005 from a deployed position to an extended position is illustrated in FIG. 53. Extendable leg fins 1005 in their extended position act as shelves to support the legs of the user and prevent the user's legs or a portion thereof from dragging in the water. The length of leg fins 1005 can vary. In embodiments, the length is of sufficient length to accommodate all or a substantial portion of the user's thigh.

Extendable leg fins 1005 may further comprise outer leg stops 1073 positioned on the top, outer side of leg fins 1005 and inner leg stops 1074 positioned on the top, inner side of leg fins 1005. Outer leg stops 1073 and inner leg stops 1074 can be used to prevent a user's leg from moving off of extendable leg fins 1005. Alternative embodiments may have only outer leg stops 1073 or only inner leg stops 1074. In embodiments including outer leg stops 1073 and/or inner leg stops 1074, cavities 1030 are shaped in an accommodating manner to allow extendable leg fins 1005 to retract to a nested position. Outer leg stops 1073 and inner leg stops 1074 can vary in shape and size. In embodiments having leg stops with more height, such as outer leg stops 1073 illustrated in the figures, leg stop slots 1065 in base 1001, which each extend from top surface 1001*a* through base 1001 to cavities 1030, allow extendable leg fins 1005 to retract into cavity 1030 without impediment.

Figure 54:
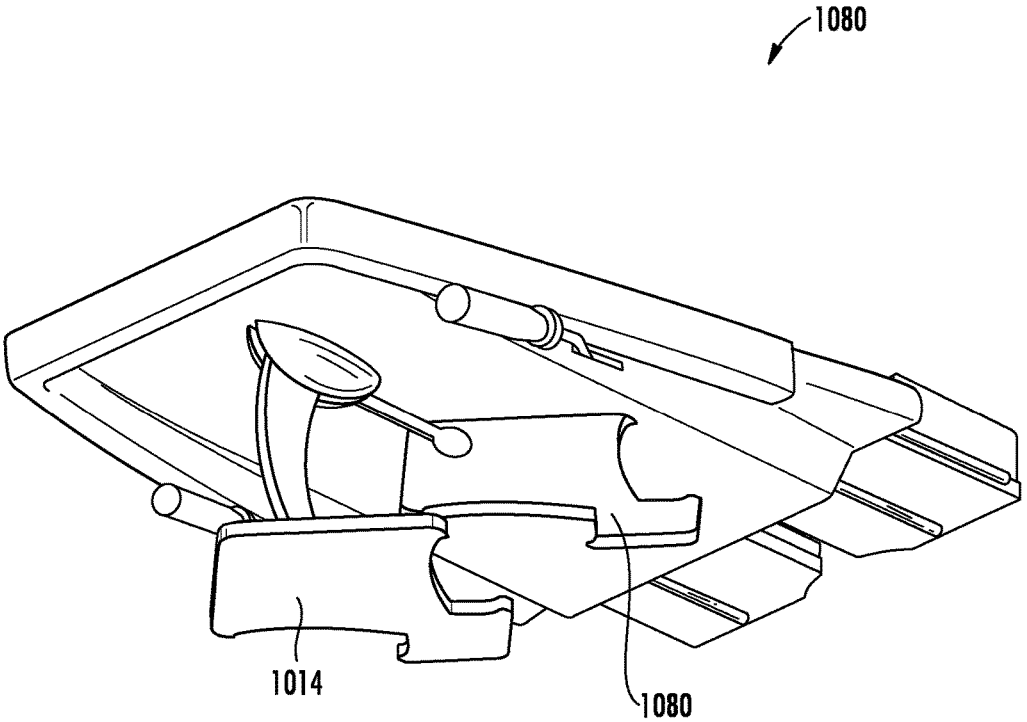
FIG. 54 is a bottom perspective view of a body surfing device having the same base as the body surfing device of FIG. 43 and an alternative wing extension shape according to an embodiment of the present invention.

Deployable wing attachment 1002 includes wing strut 1003 and wing extension 1004, wing strut mount 1009, and base strut mount 1011. One end of wing strut 1003 rotatably attaches to bottom surface 1001*b* of base 1001 at base strut mount 1011. The opposite end of wing strut 1003 rotatably attaches to the top surface of wing extension 1004 at wing strut mount 1009. Each of wing strut mount 1009 and base strut mount 1011 can be formed of one or more elements. Two elements, one on either side of wing strut 1003 are shown here. Wing strut mount 1009 and base strut mount 1011 allow rotation at the respective ends of wing strut 1003 allowing movement of wing attachment 1002 between a deployed position (as shown in FIGS. 43-47) and a stowed position (as shown in FIGS. 48-52). Such movement is illustrated in FIG. 53. In its stowed position, wing extension 1004 and wing strut 1003 are positioned within wing cavity 1008 and strut cavity 1029, respectively, located on bottom surface 1001*b* of base 1001. Wing cavity 1008 and wing extension 1002 can vary in shape and size. To prevent unnecessary drag, cavity 1008 and wing extension 1002 should be similar in shape and size. Body surfing device 1080, having an alternatively-shaped wing extension (1014) and cavity (1012), is shown in FIG. 54.

Body surfing device 1000 may also include levers 1020, which may include handles 1021. Actuation of levers 1020 may be used to cause wing attachment to move between a deployed position and a stowed position and leg fins 1005 to move between an extended position and a retracted position. To allow ease of paddling by a user, handles 1021 and levers 1020 may be positioned under base 1001. In embodiments, handles 1021 and levers 1020 may be positioned just below hand grip 1025. Handles 1021 and levers 1020 may be restricted such that they do not extend beyond the periphery (right side 1001*e* or left side 1001*f*) of base 1001 when they are not being actuated; during actuation all or a portion of handles 1021, and possibly portions of levers 1020, may extend beyond the periphery of base 1001. Movement of wing attachment 1002 between a deployed and stowed position and of leg fins 1005 between an extended and retracted position using levers 1020 can be achieved in a number of ways. In embodiments, rack and pinion assembly with one or more gears may be employed with a central rod that connects between the two leg extensions to deploy them in unison. Alternatively or additionally, a worm gear may also be employed. A breakaway gear assembly may be used for wing attachment 1002. Such an assembly causes wing extension 1002 to move from a deployed position to a stowed position upon a predetermined force impacting wing extension 1004, such as may occur, for example, when a user in approaching the beach, moves too quickly into shallow waters and hits the sand at a high force. Such a safety release/retraction can prevent injury to body surfing device 1000 and, more importantly, to the user.

In alternative embodiments that may not have levers 1020, leg fins 1005 may be spring-loaded such that the springs are compressed when leg fins 1005 are in a retracted position. Leg fins 1005 can be held in place by a latch or similar blocking element connected to base 1001 that prevents leg fins 1005 from extending. Upon release of the blocking element, the spring or set of springs causes leg fins 1005 to deploy. Additional alternative embodiments without levers 1020 may allow the user to manually position wing attachment 1002 and leg fins 1005.

Figure 57:
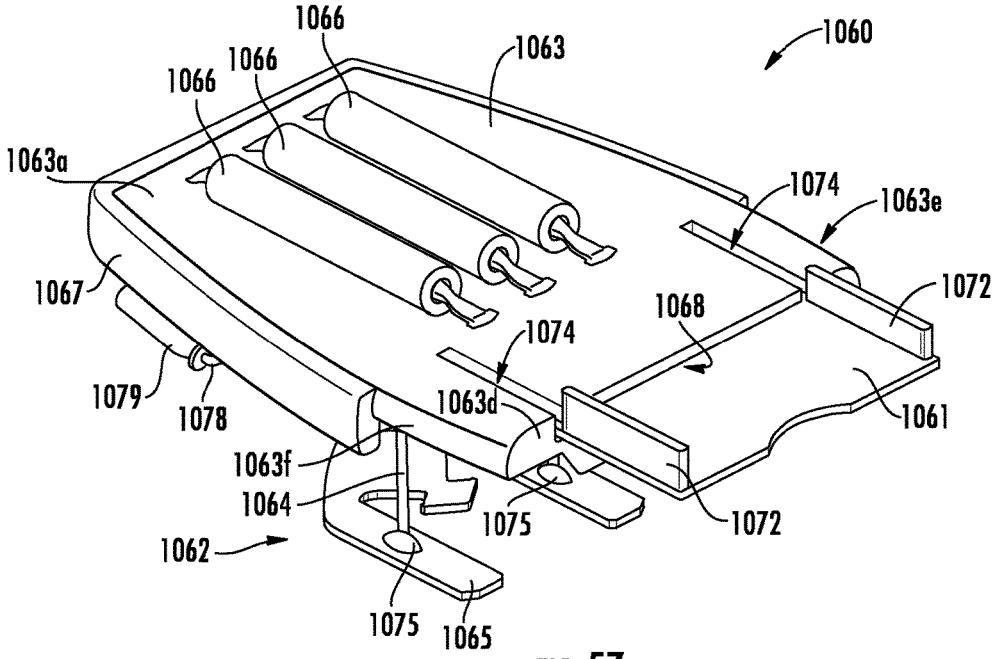
FIG. 57 is a top perspective view of a body surfing device having an extendable nesting leg fin and a double-strut deployable wing attachment showing the leg fin in its extended position and the wing attachment in its deployed position according to an embodiment of the present invention.
Figure 58:
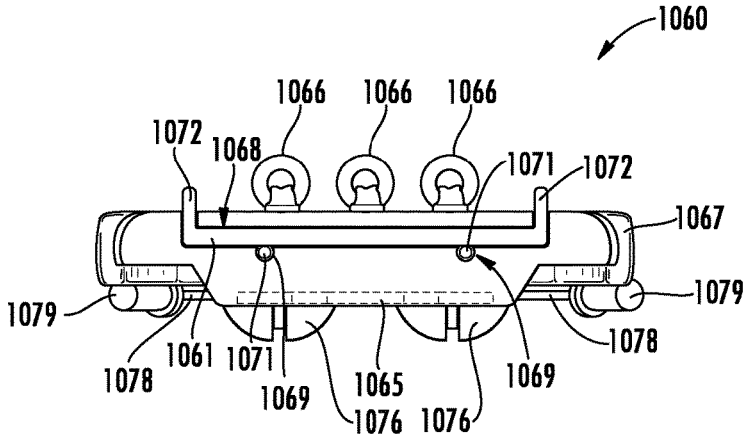
FIG. 58 is a back side elevational view of the body surfing device of FIG. 57 showing the leg fin in its retracted position and the wing attachment in its stowed position according to an embodiment of the present invention.
Figure 59:
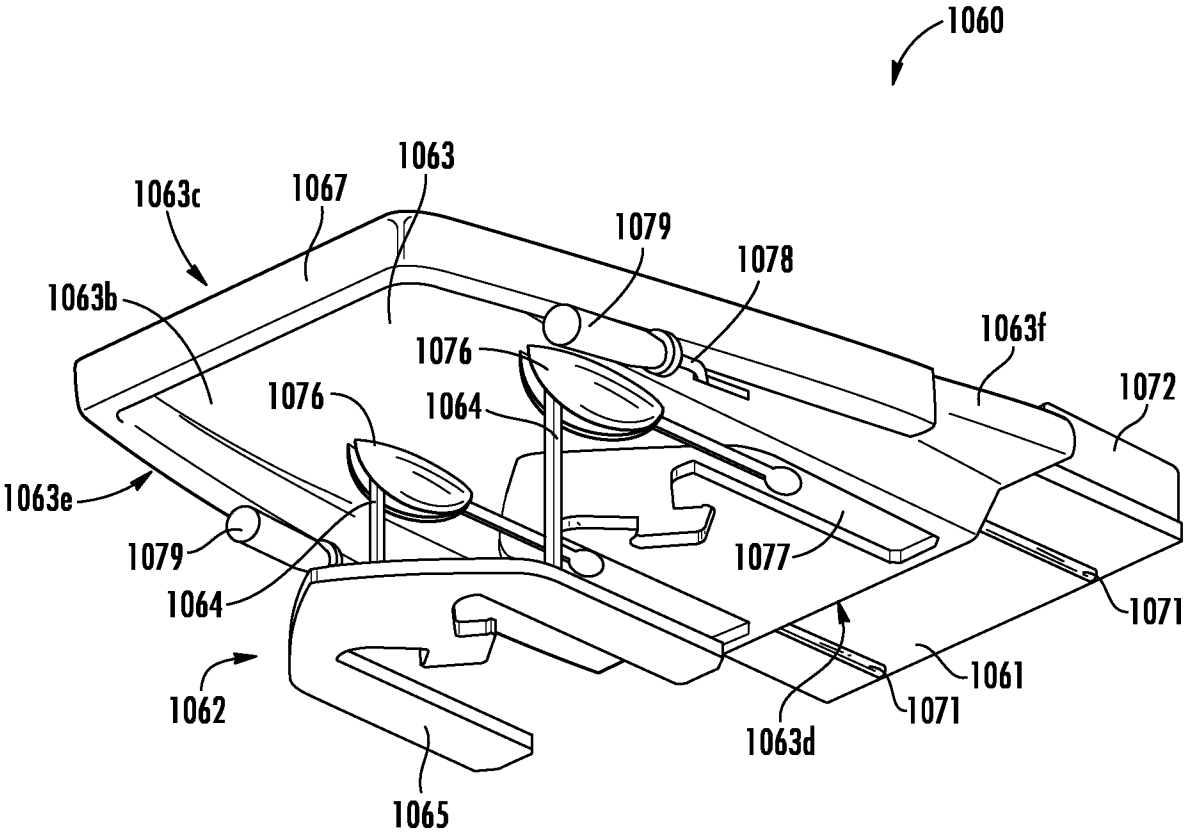
FIG. 59 is a bottom perspective view of the body surfing device of FIG. 57 showing the leg fin in its extended position and the wing attachment in its deployed position according to an embodiment of the present invention.

In an alternative embodiment, as shown in FIGS. 57 through 59, body surfing device 1060 has base 1063, single extendable leg fin 1061 and double-strut wing attachment 1062 having wing struts 1064 and wing extension 1065. Although not shown, connections to shoulder straps or permanent shoulder straps as shown in other embodiments may also be utilized with body surfing device 1060. Base 1063 has top surface 1063*a* and bottom surface 1063*b*. In use, top surface 1063*a* faces the user and bottom surface 1063*b* faces the water. Base 1063 also has front side 1063*c*, back side 1063*d*, right side 1063*e* and left side 1063*f*. In use, front side 1063*c* is the portion of base 1063 nearest a user's head and back side 1063*d* is the portion of base 1063 nearest a user's waist. In use, right side 1063*e* would be on a user's right side and left side 1063*f* would be on a user's left side.

Separation members 1066, similar to those shown and described with respect to FIG. 2, are attached to top surface 1063*a* of base 1063. The size and shape of separation members 1066 and base 1063 can vary.

Base 1063 may include hand grip 1067 on all or a portion of left side 1063*f*, front side 1063*c*, and right side 1063*e* of base 1063. On its top side, hand grip 1067 may be flush with top surface 1063*a*. The bottom side of hand grip 1067 extends past the bottom surface 1063*b* of base 1063 creating a lip for a user to grasp. Embodiment may comprise multiple hand grips instead of a single continuous hand grip as shown in FIGS. 57 through 59.

Base 1063 includes fin cavity 1068 in back side 1063*d* of base 1063. Fin cavity 1068 may include tracks 1069, which may be channels formed in the bottom of cavity 1068 as shown; however, the location and shape should not be construed as limiting. Tracks 1069 may be located in various locations along the cavity wall and may vary in shape and size. Extendable leg fin 1061 may comprise guides 1071 positioned on its bottom side, which are in sliding communication with tracks 1069 as shown; however, the location and shape should not be construed as limiting. Guides 1071, may be located in various locations about leg fin 1061 to correspond with the respective track. Extendable leg fin 1061 is shown in its extended position in FIGS. 57 and 59. Extendable leg fin 1061 may retract into a nested position within cavity 1068. Extendable leg fin 1061 in its nested position is illustrated in FIG. 58. Extendable leg fin 1061 in its extended position acts as a shelf to support the legs of the user and prevent the user's legs or a portion thereof from dragging in the water. The length of extendable leg fin 1061 can vary. In embodiments, the length is of sufficient length to accommodate all or a substantial portion of the user's thigh.

Extendable leg fin 1061 may further comprise outer leg stops 1072 positioned on the top, outer sides of leg fin 1061. Outer leg stops 1072 can be used to prevent a user's legs from moving off of extendable leg fin 1061. In embodiments including outer leg stops 1072, cavity 1068 is shaped in an accommodating manner to allow extendable leg fin 1061 to retract to a nested position. Outer leg stops 1073 can vary in shape and size. In embodiments having leg stops with more height, such as outer leg stops 1072 illustrated in the figures, leg stop slots 1074 in base 1063, which each extend from top surface 1063*a* through base 1063 to cavity 1068, allow extendable leg fin 1061 to retract into cavity 1068 without impediment.

Deployable wing attachment 1062 includes wing struts 1064 and wing extension 1065, wing strut mounts 1075, and base strut mounts 1076. One end of each of wing struts 1064 rotatably attaches to bottom surface 1063*b* of base 1063 at respective base strut mounts 1076. The opposite end of each of each of wing struts 1064 rotatably attaches to the top surface of wing extension 1065 at respective wing strut mounts 1075. Each of wing strut mounts 1075 and base strut mounts 1076 can be formed of one or more elements. As shown here, each wing strut mount 1075 and each base strut mount 1076 comprises two elements. Wing strut mounts 1075 and base strut mounts 1076 allow rotation at the respective ends of wing struts 1064 allowing movement of wing attachment 1062 between a deployed position (as shown in FIGS. 57 and 59) and a stowed position (as shown in FIG. 58). In its stowed position, wing extension 1065 is positioned within base cavity 1077 located on bottom surface 1063*b* of base 1063. Base cavity 1077 and wing extension 1065 can vary in shape and size. To prevent unnecessary drag, base cavity 1077 and wing extension 1065 should be similar in shape and size.

Body surfing device 1060 may also include levers 1078, which may include handles 1079. Actuation of lever 1078 may be used to cause wing attachment to move between a deployed position and a stowed position and leg fins to move between an extended position and a retracted position. To allow ease of paddling by a user, handles 1079 may be and levers 1078 may be positioned under base 1063. In embodiments, handles 1079 and levers 1078 may be positioned just below hand grip 1067. Handles 1079 and levers 1078 may be restricted such that they do not extend beyond the periphery (right side 1063*e* or left side 1063*f*) of base 1063 when they are not being actuated; during actuation all or a portion of handles 1079, and possibly portion of levers 1078, may extend beyond the periphery of base 1063. Movement of wing attachment 1062 between a deployed and stowed position and of leg fin 1061 between an extended and retracted position using levers 1078 can be achieved in a number of ways. In embodiments, rack and pinion assembly with one or more gears may be employed with a central rod that connects between the two leg extensions to deploy them in unison. Alternatively or additionally, a worm gear assembly may be employed with a central rod connecting the pinion gears to a breakaway gear assembly. A breakaway gear assembly causes wing extension 1065 to move from a deployed position to a stowed position upon a predetermined force impacting wing extension 1065, such as may occur, for example, when a user in approaching the beach, moves too quickly into shallow waters and hits the sand at a high force. Such a safety release/retraction can prevent injury to body surfing device 1060 and, more importantly, to the user.

In alternative embodiments that may not have levers 1078, leg fin 1061 may be spring-loaded such that the springs are compressed when leg fin 1061 is in a retracted position. Leg fin 1061 can be held in place by a latch or similar blocking element connected to base 1063 that prevents leg fins 1061 from extending. Upon release of the blocking element, the spring or set of springs causes leg fin 1061 to deploy. Additional alternative embodiments without levers 1078 may allow the user to manually position wing attachment 1062 and leg fin 1061.

Figure 60:
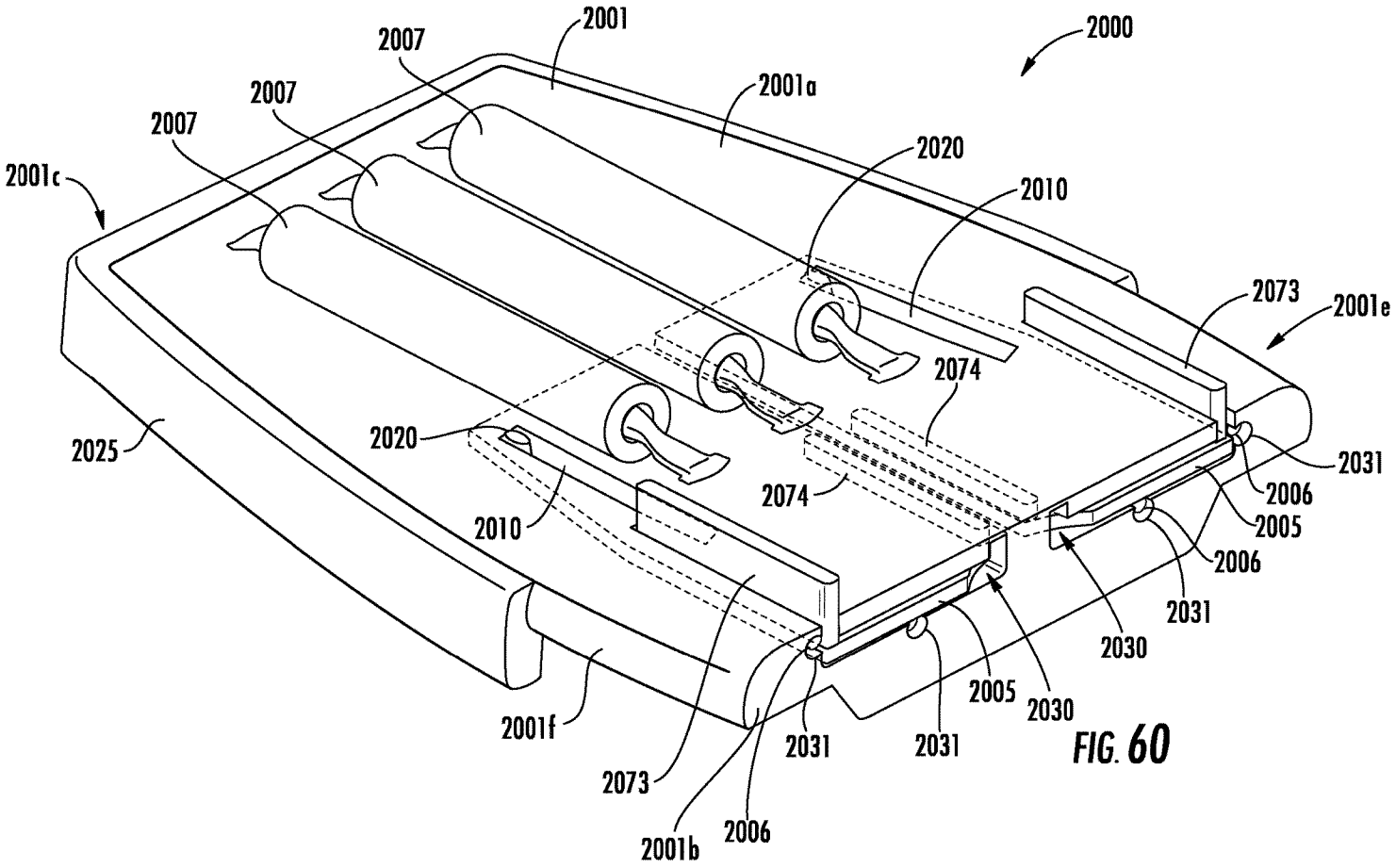
FIG. 60 is a top perspective view of a body surfing device having extendable leg fins driven by slide handles showing the leg fins in their retracted position according to an embodiment of the present invention.
Figure 62:
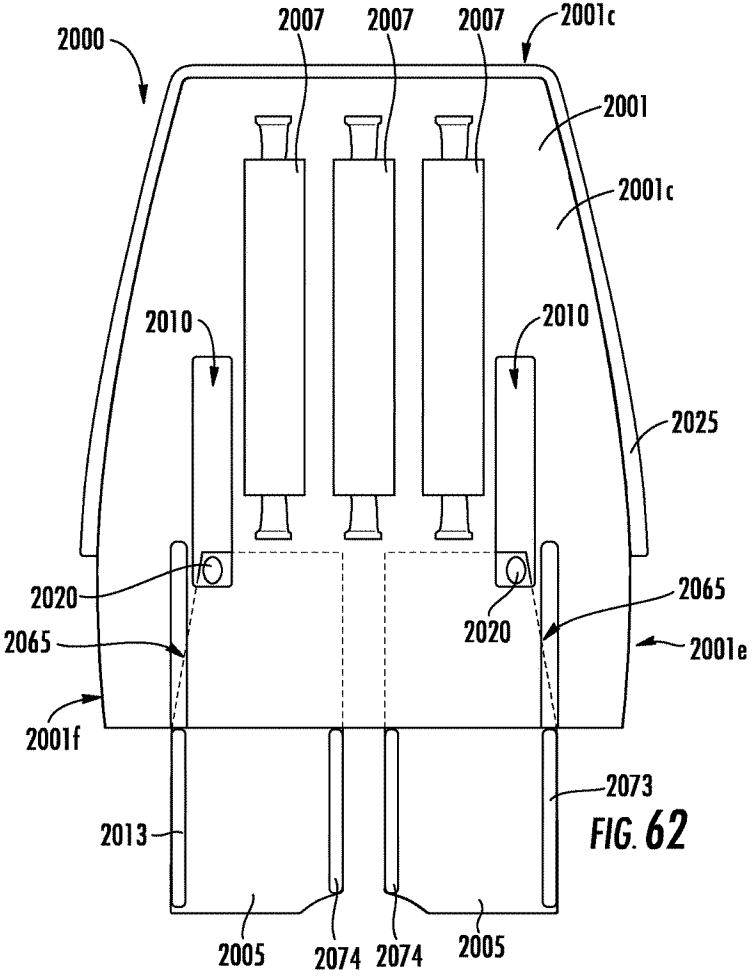
FIG. 62 is a top plan view of the body surfing device of FIG. 60 showing the leg fins in their extended position according to an embodiment of the present invention.
Figure 61:
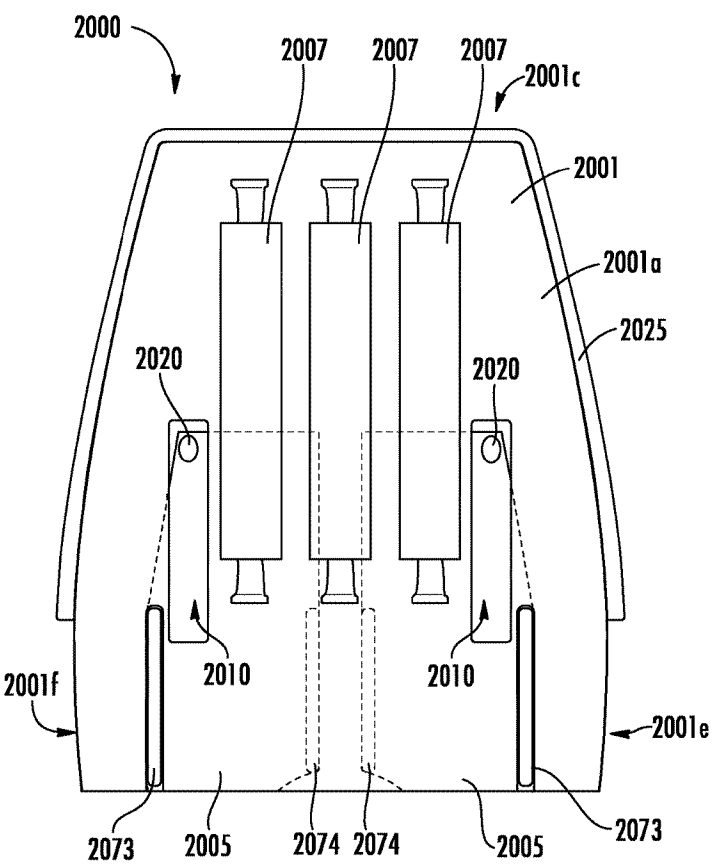
FIG. 61 is a top plan view of the body surfing device of FIG. 60 showing the leg fins in their retracted position according to an embodiment of the present invention.

In alternative embodiments, as illustrated in FIGS. 60 through 62, slide handles 2020 may be used to actuate extendable leg fins 2005. Although depicted here without a wing attachment, any wing attachment described herein could be incorporated with extendable leg fins 2005 and slide handles 2020.

Body surfing device 2000 comprises base 2001, extendable leg fins 2005 and slide handles 2020. Although not shown, connections to shoulder straps or permanent shoulder straps as shown in other embodiments may also be utilized with body surfing device 2000. Base 2001 has top surface 2001*a* and bottom surface 2001*b*. In use, top surface 2001*a* faces the user and bottom surface 2001*b* faces the water. Base 2001 also has front side 2001*c*, back side 2001*d*, right side 2001*e* and left side 2001*f*. In use, front side 2001*c* is the portion of base 2001 nearest a user's head and back side 2001*d* is the portion of base 2001 nearest a user's waist. In use, right side 2001*e* would be on a user's right side and left side 2001*f* would be on a user's left side.

Separation members 2007, similar to those shown and described with respect to FIG. 2, are attached to top surface 2001*a* of base 2001. The size and shape of separation members 2007 and base 2001 can vary.

Base 2001 may include hand grip 2025 on all or a portion of left side 1201*f*, front side 2001*c*, and right side 2001*e* of base 2001. On its top side hand grip 2025 may be flush with top surface 1201*a*. The bottom side of hand grip 2025 extends past the bottom surface 2001*b* of base 2001 creating a lip for a user to grasp. Embodiment may comprise multiple hand grips instead of a single continuous hand grip as shown in FIGS. 60 through 62.

Base 2001 includes fin cavities 2030 in back side 2001*d* of base 2001. Fin cavities 2030 may include tracks 2031, which may be a channel formed in the center bottom and external sides of cavity 2030 as shown; however, the location and shape should not be construed as limiting. Tracks 2031 may be located in various locations along the cavity wall and may vary in shape and size. Extendable leg fins 2005 may comprise guides 2006 positioned in the center of their bottom side and external sides, which are in sliding communication with tracks 2031 as shown; however, the location and shape should not be construed as limiting. Guides 2006, may be located in various locations about leg fins 2005 to correspond with the respective track. Extendable leg fins 2005 are shown in their extended position in FIG. 62. Extendable leg fins 2005 may retract into a nested position within fin cavities 2030. Extendable leg fins 2005 in the nested position are illustrated in FIGS. 60 and 61. Extendable leg fins 2005 in their extended position act as shelves to support the legs of the user and prevent the user's legs or a portion thereof from dragging in the water. The length of leg fins 2005 can vary. In embodiments, the length is of sufficient length to accommodate all or a substantial portion of the user's thigh.

Extendable leg fins 2005 may further comprise outer leg stops 2073 positioned on the top, outer side of leg fins 2005 and inner leg stops 2074 positioned on the top, inner side of leg fins 2005. Outer leg stops 2073 and inner leg stops 2074 can be used to prevent a user's leg from moving off of extendable leg fins 2005. Alternative embodiments may have only outer leg stops 2073 or only inner leg stops 2074. In embodiments including outer leg stops 2073 and/or inner leg stops 2074, cavities 2030 are shaped in an accommodating manner to allow extendable leg fins 2005 to retract to a nested position. Outer leg stops 2073 and inner leg stops 2074 can vary in shape and size. In embodiments having leg stops with more height, such as outer leg stops 2073 illustrated in the figures, leg stop slots 2065 in base 2001, which each extend from top surface 2001*a* through base 2001 to fin cavities 2030, allow extendable leg fins 2005 to retract into cavities 2030 without impediment.

Slide handles 2020, which are shown in FIG. 60 through 62 to have an elliptical cylinder shape, may be of any shape and size that allows the user to readily grip it. Slide handles 2020 are fixed to respective leg fins 2005 and are accessible to the user through slide handle slots 2010 formed in top surface 2001*a* of base 2001. Slide handles 2020 are slidable from a first position shown in FIGS. 60 and 61 to a second position shown in FIG. 62. Slide handle 2020 may be used to move leg fins 2005 between a retracted position (when slide handle 2020 is in its first position) and an extended position (when slide handle 2020 is in its second position).

In an exemplary embodiment, movement of a single-strut wing attachment between a deployed position and a stowed position and movement of leg fins between an extended position and a retracted position is accomplished through use of a series of gears as shown and described with reference to FIGS. 63 through 68. As shown, body surfing device 3000 has base 3001, extendable leg fins 3005 and single-strut wing attachment 3002 having wing struts 3003 and wing extension 3005. Although not shown, connections to shoulder straps or permanent shoulder straps as shown in other embodiments may also be utilized with body surfing device 3000. Base 3001 has top surface 3001*a* and bottom surface 3001*b*. In use, top surface 3001*a* faces the user and bottom surface 3001*b* faces the water. Base 3001 also has front side 3001*c*, back side 3001*d*, right side 3001*e* and left side 3001*f*. In use, front side 3001*c* is the portion of base 3001 nearest a user's head and back side 3001*d* is the portion of base 3001 nearest a user's waist. In use, right side 3001*e* would be on a user's right side and left side 3001*f* would be on a user's left side.

Although not shown, separation members, similar to those shown and described with respect to FIG. 2, may be attached to top surface 3001*a* of base 3001. Base 3001 may include one or more hand grips (not shown) on all or a portion of left side 3001*f*, front side 3001*c*, and right side 3001*e* of base 3001.

Figure 63:
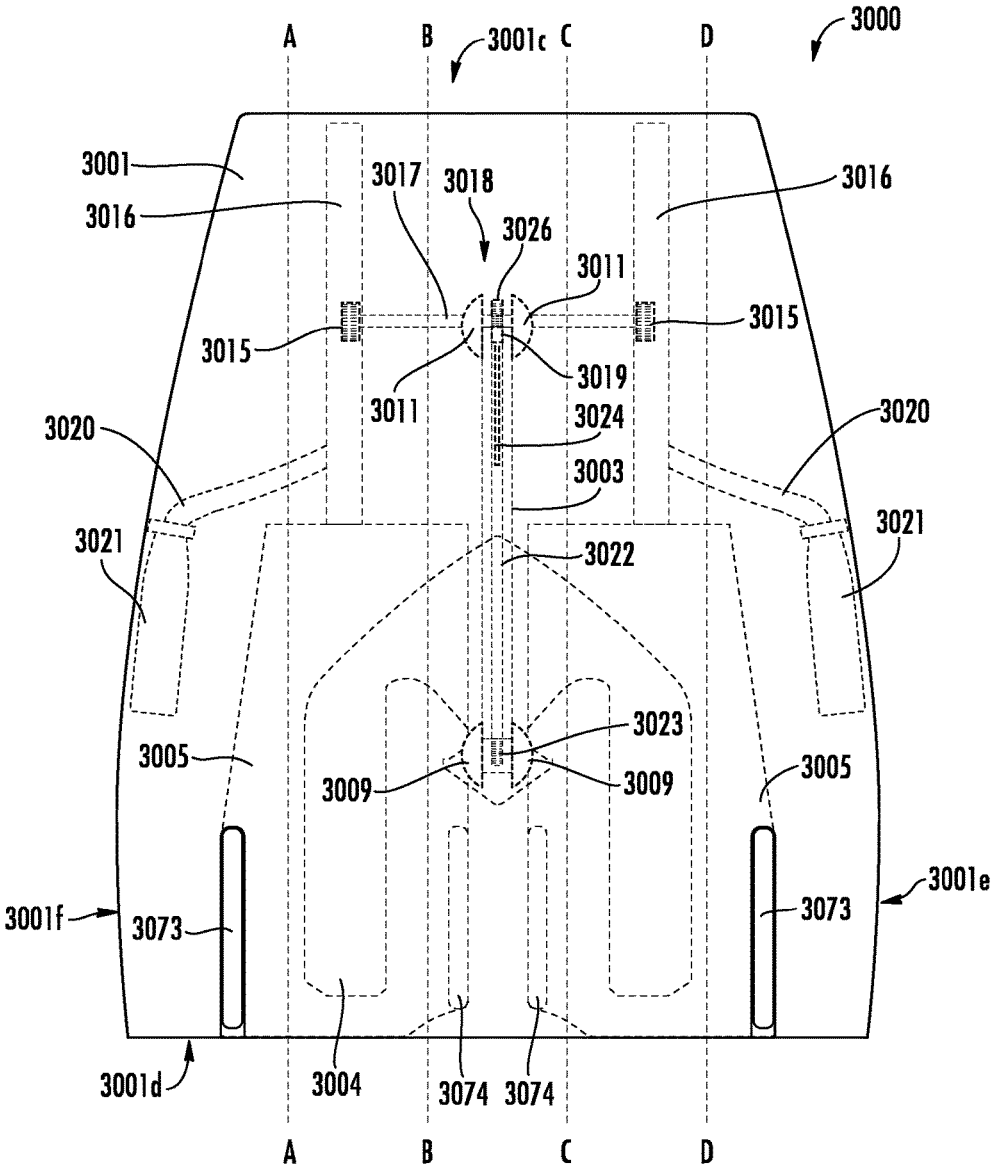
FIG. 63 is a top plan view of the body surfing device having extendable leg fins and a single strut deployable wing attachment with the leg fins in their retracted position and the wing attachment in its stowed position showing the internal elements that operate the extendable leg fins and the deployable wing attachment according to an embodiment of the present invention.
Figure 64:
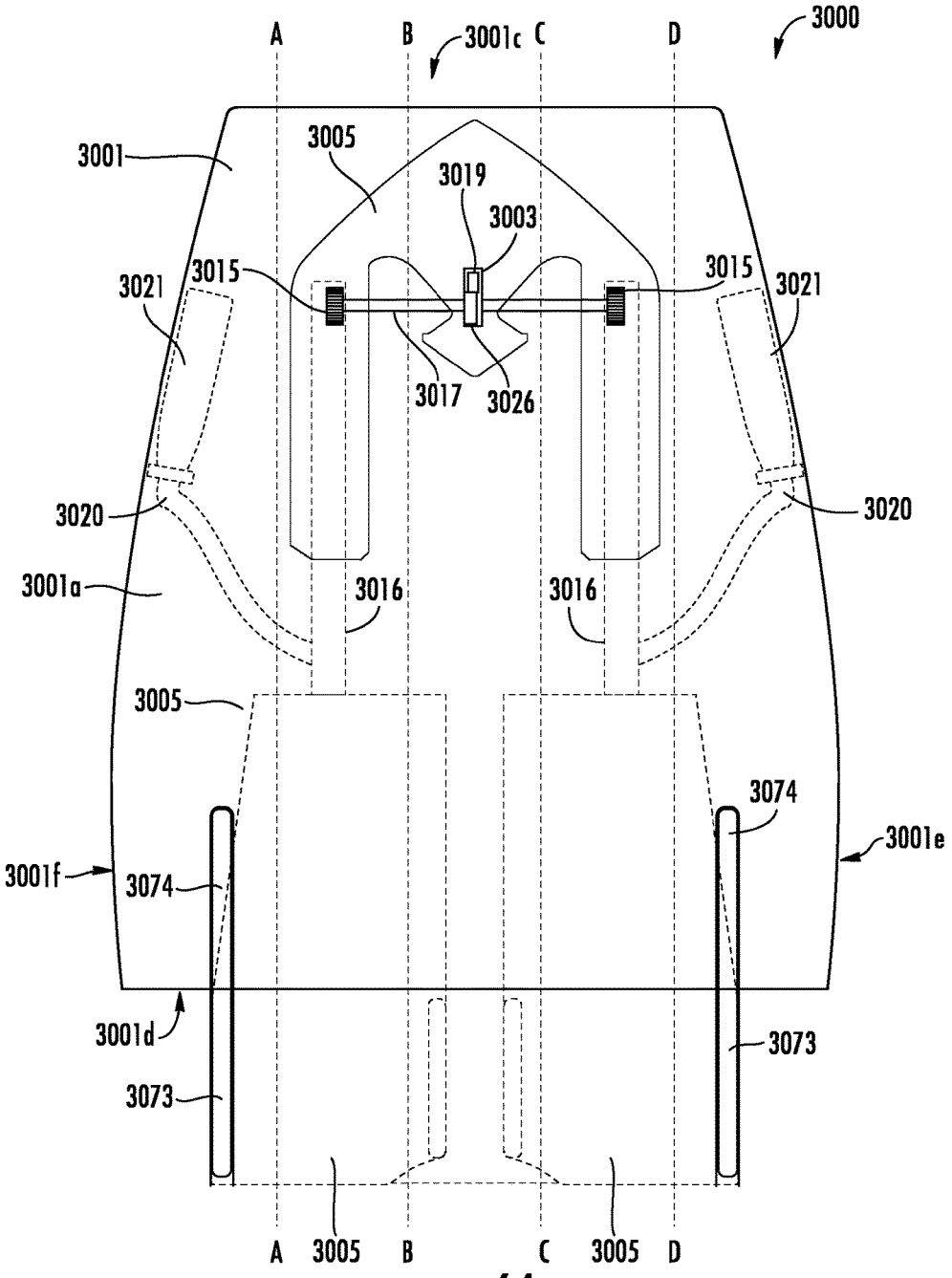
FIG. 64 is a top plan view of the body surfing device of FIG. 63 with the leg fins in their extended position and the wing attachment in its deployed position showing the internal elements that operate the extendable leg fins and the deployable wing attachment according to an embodiment of the present invention.
Figure 65:
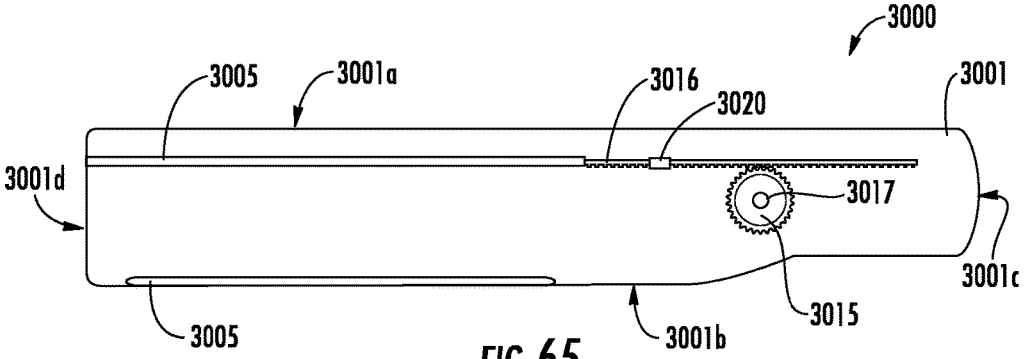
FIG. 65 is a cross-sectional view of the body surfing device of FIG. 63 with the leg fins in their retracted position and the wing attachment in its stowed position at line D-D through to line C-C of FIG. 63 according to an embodiment of the present invention.
Figure 66:
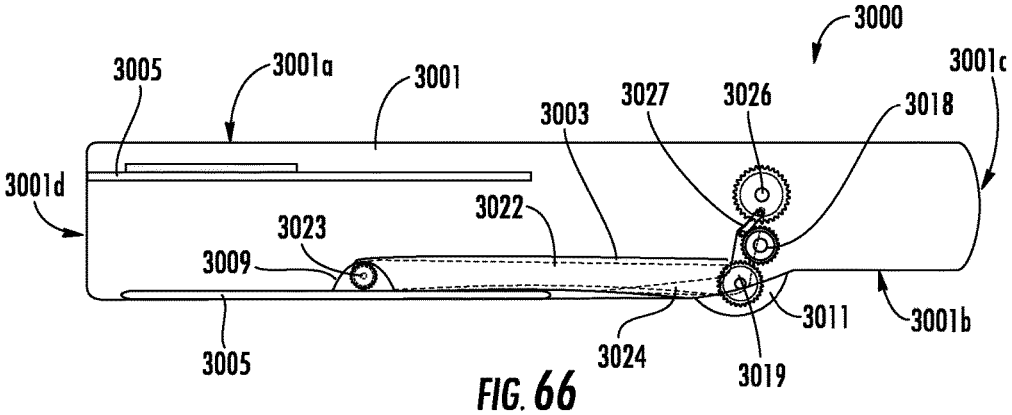
FIG. 66 is a cross-sectional view of the body surfing device of FIG. 63 with the leg fins in their retracted position and the wing attachment in its stowed position at line C-C through to line B-B of FIG. 63 according to an embodiment of the present invention.

Base 3001 include fin cavities in back side 3001*d* of base 3001, which are not illustrated, but would follow along the outside portion of leg fins 3005 in FIGS. 63, 65, and 66. The fin cavities may include one or more tracks (not shown), which may be channels formed in the bottom of the cavities. The tracks may be located in various locations along the cavity walls and may vary in shape and size. Extendable leg fins 3005 may comprise one or more guides (not shown) positioned on their bottom sides, which are in sliding communication with the tracks. The guides may be located in various locations about leg fins 3005 to correspond with the respective tracks. Extendable leg fins 3005 are shown in their extended position in FIGS. 64, 67 and 68. Extendable leg fins 3005 may retract into a nested position within the cavities. Extendable leg fins 3005 in their nested position are illustrated in FIGS. 63, 65 and 66. Extendable leg fins 3005 in their extended position act as shelves to support the legs of the user and prevent the user's legs or a portion thereof from dragging in the water. The length of leg fins 3005 can vary. In embodiments, the length is of sufficient length to accommodate all or a substantial portion of the user's thigh.

Extendable leg fins 3005 may further comprise outer leg stops 3073 positioned on the top, outer sides of leg fins 3005. Outer leg stops 3073 can be used to prevent a user's legs from moving off of extendable leg 3005. In embodiments including outer leg stops 3073, leg fin cavities (not shown) in bottom side 3001*b* of base 3001 is shaped in an accommodating manner to allow extendable leg fins 3061 to retract to a nested position. Outer leg stops 3073 can vary in shape and size. In embodiments having leg stops with more height, such as outer leg stops 3073 illustrated in the figures, leg stop slots 3074 in base 3001, which each extend from top surface 3001*a* through base 3001 to the cavity, allow extendable leg fins 3005 to retract into the cavity without impediment.

Figure 67:
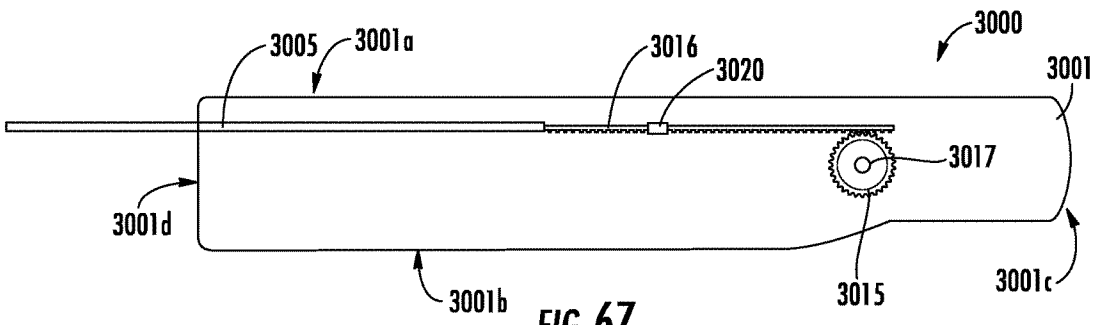
FIG. 67 is a cross-sectional view of the body surfing device of FIG. 63 with the leg fins in their extended position and the wing attachment in its deployed position at line D-D through to line C-C of FIG. 64 according to an embodiment of the present invention.
Figure 68:
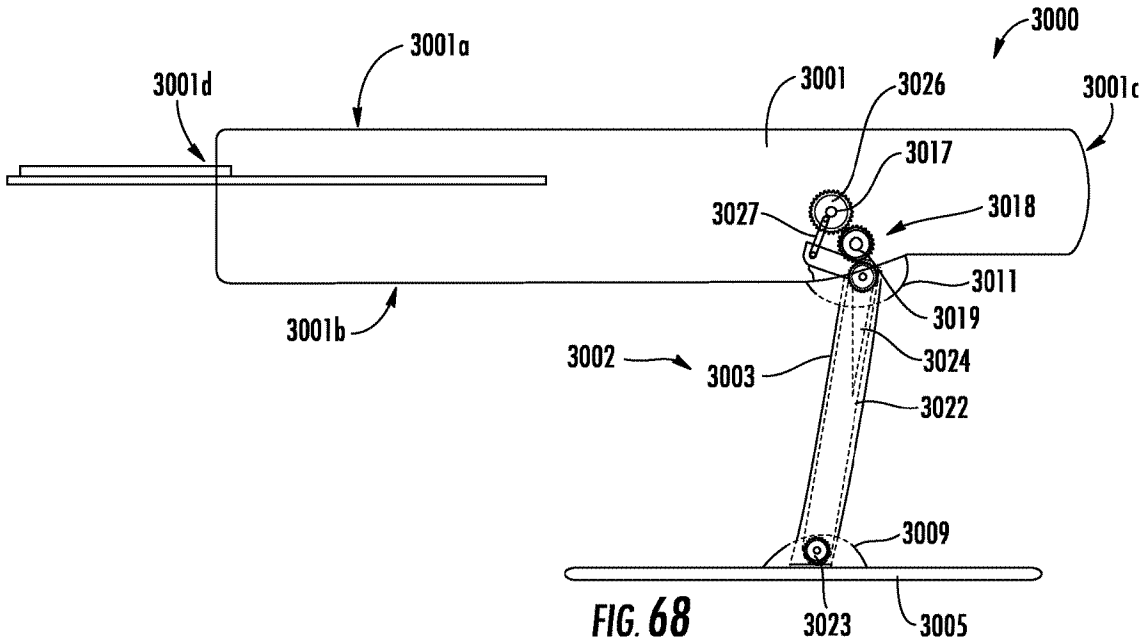
FIG. 68 is a cross-sectional view of the body surfing device of FIG. 63 with the leg fins in their extended position and the wing attachment in its deployed position at line C-C through to line B-B of FIG. 64 according to an embodiment of the present invention.
Figure 69:
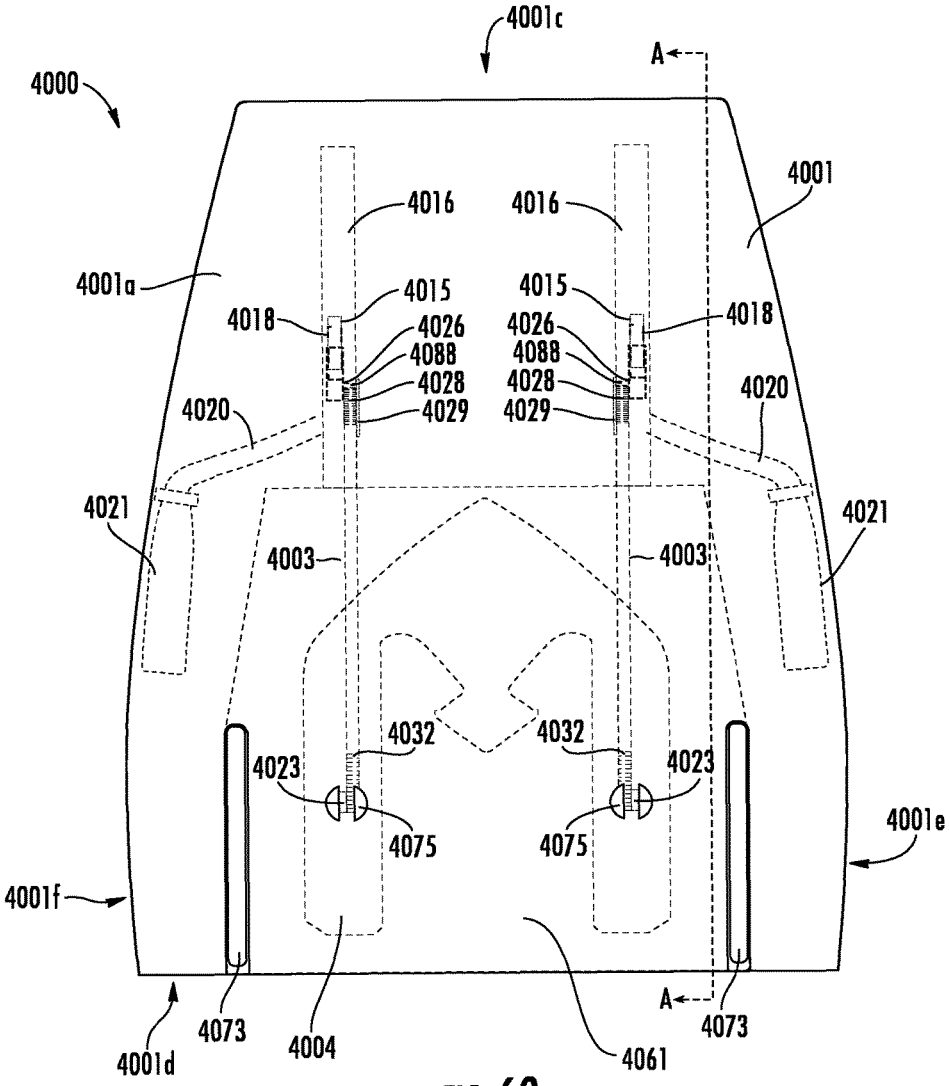
FIG. 69 is a top plan view of the body surfing device having an extendable leg fin and a double strut deployable wing attachment with the leg fin in its retracted position and the wing attachment in its stowed position showing the internal elements that operate the extendable leg fin and the deployable wing attachment according to an embodiment of the present invention.
Figure 70:
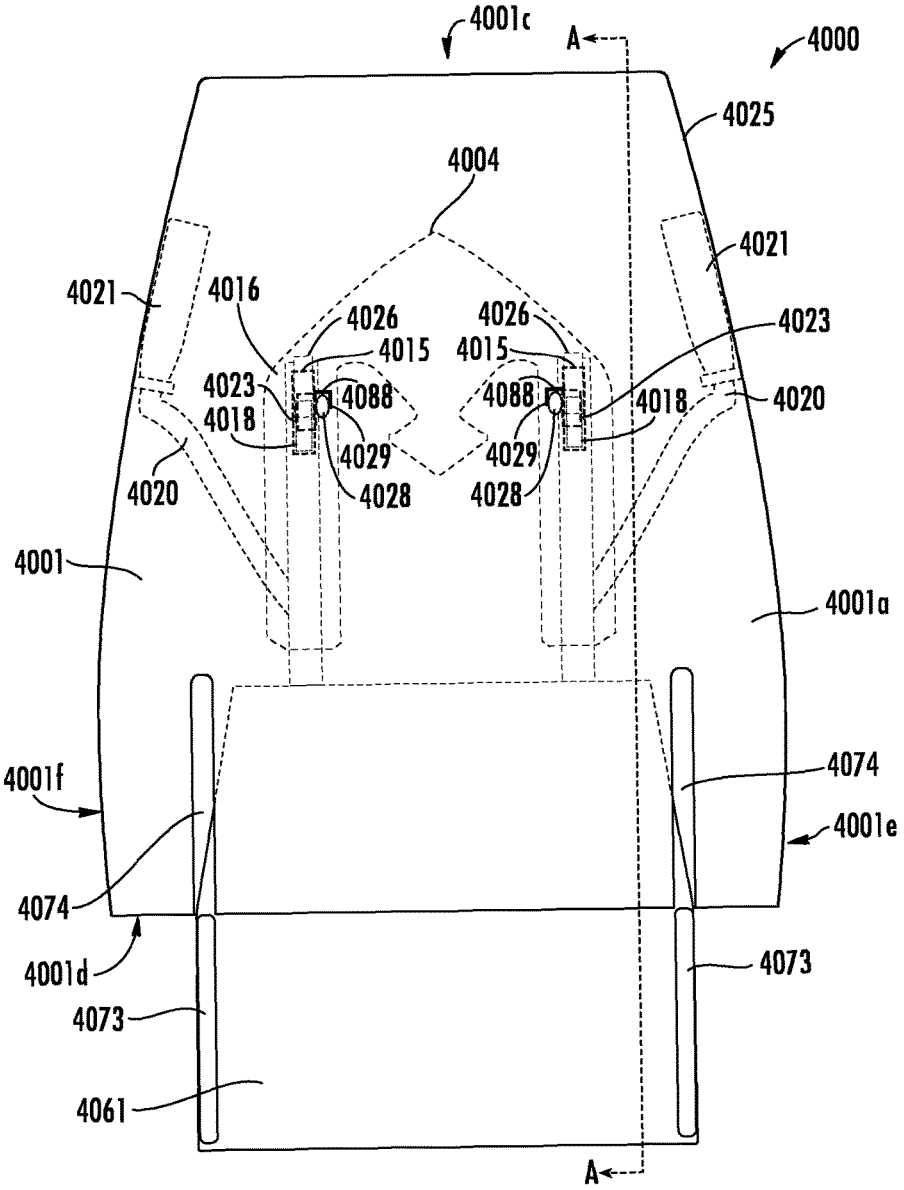
FIG. 70 is a top plan view of the body surfing device of FIG. 69 with the leg fin in its extended position and the wing attachment in its deployed position showing the internal elements that operate the extendable leg fin and the deployable wing attachment according to an embodiment of the present invention.

Deployable wing attachment 3002 includes wing strut 3003 and wing extension 3004, wing strut mount 3009 (not illustrated in FIG. 64 for purposes of simplicity), and base strut mount 3011 (not illustrated in FIG. 69 or 70 for purposes of simplicity). One end of wing strut 3003 rotatably attaches to bottom surface 3001*b* of base 3001 at respective base strut mounts 3011. The opposite end of wing strut 3003 rotatably attaches to the top surface of wing extension 3004 at wing strut mount 3009. Wing strut mount 3009 and base strut mount 3011 can be formed of one or more elements. As shown here, wing strut mount 3009 and base strut mount each comprise two elements. Wing strut mount 3009 and base strut mount 3011 allow rotation at the respective ends of wing strut 3003 allowing movement of wing attachment 3002 between a deployed position (as shown in FIGS. 64, 67 and 68) and a stowed position (as shown in FIGS. 63, 65 and 66). In its stowed position, wing extension 3004 is positioned within the base cavity located on bottom surface 3001*b* of base 3001. The base cavity is not illustrated, but would follow along the outside portion of wing extension 3004. The base cavity and wing extension 3004 can vary in shape and size. To prevent unnecessary drag, the base cavity and wing extension 3004 should be similar in shape and size.

Body surfing device 3000 may also include levers 3020, which may include handles 3021. Actuation of lever 3020 may be used to cause wing attachment 3002 to move between a deployed position and a stowed position and leg fins 3005 to move between an extended position and a retracted position. To allow ease of paddling by a user, handles 3021 and levers 3020 may be positioned under base 3001. In embodiments, handles 3021 and levers 3020 may be positioned just below a hand grip (not shown). Handles 3021 and levers 3020 may be restricted such that they do not extend beyond the periphery (right side 3001*e* or left side 3001*f*) of base 3001 when they are not being actuated; during actuation all or a portion of handles 3021, and possibly portion of levers 3020, may extend beyond the periphery of base 3001. Movement of wing attachment 3002 between a deployed and stowed position and of leg fins 3005 between an extended and retracted position using levers 3020 can be achieved in a number of ways. An exemplary mechanism utilizing a series of gears is illustrated here. On the opposing sides of handles 3021, the opposing sides of which are located within base 3001, levers 3020 may be connected to leg fins 3005 or, as shown here, to gear racks 3016. As levers 3020 move from their forward position (as shown in FIGS. 64, 67 and 68) to their rearward position (as shown in FIGS. 63, 65 and 66), they cause gear racks 3016 to move longitudinally forward towards front side 3001*c* of base 3001 and also cause leg fins 3005 to move from an extended position to a retracted position. Gear racks 3016 are in communication with pinion gears 3015. As gear racks 3016 move forward, they cause pinion gears 3015 to rotate. Pinion gears 3015 are connected at their central axis to opposing end of connecting rod 3017 and rotate about connecting rod 3017. Rod gear 3026 is connected at its central axis to connecting rod 3017 between pinion gears 3015 and rotates about connecting rod 3017. Rotation of pinion gears 3015 causes rotation of connecting rod 3017, which causes rotation of rod gear 3026. Rod gear 3026 is in communication with breakaway gear mechanism 3018. Breakaway gear mechanism 3018 may allow wing extension 3002 to move from a deployed position to a stowed position upon a predetermined force impacting wing extension 3004, such as may occur, for example, when a user in approaching the beach, moves too quickly into shallow waters and hits the sand at a high force. Such a safety release/retraction can prevent injury to body surfing device 3000 and, more importantly, to the user. Breakaway gear mechanism 3018 is shown as single gear elements in the figures but may comprise multiple components. Rotation of rod gear 3026 causes movement in breakaway gear mechanisms 3018, which may be rotation of one or more gears. Breakaway gear mechanism 3018 is in communication with base-strut gear 3019. Movement of breakaway gear mechanism 3018 causes rotation of base-strut gear 3019. Belt 3022 extends between and around and is in rotatable communication with base strut gear 3019 and wing extension gear 3023, which is rotatably mounted about its central axis within wing strut mount 3009. Angled strut lever 3024 is mounted to base-strut gear 3019 and rotates with base-strut gear 3019. Movement of angled strut lever 3024 is partially constrained by its connection at one end (its base end) to an end of bracket 3027. The opposing end of bracket 3027 is connected to the side face of rod gear 3026 at or near its outer circumference. The opposing end of angled strut (its strut end) is located within strut 3003. As angled strut gear 3019 rotates about its connection to base-strut gear 3019, it moves between the positions shown best in FIGS. 66 and 68. Movement of the strut end of angled strut gear 3019 in the rearward direction (towards back end 3001*d* of base 3001) causes angled strut gear 3019 to press against the rear interior of strut 3003, which causes wing attachment to move towards its stowed position. Conversely, movement of the strut end of angled strut gear 3019 in the frontward direction (towards front end 3001*c* of base 3001) causes angled strut gear 3019 to press against the front interior of strut 3003, which causes wing attachment 3002 to move towards its deployed position.

In an exemplary embodiment, movement of a double-strut wing attachment between a deployed position and a stowed position and movement of the leg fin between an extended position and a retracted position is accomplished through use of a series of gears as shown and described with reference to FIGS. 69 through 72. As shown, body surfing device 4000 has base 4001, single extendable leg fin 4061 and double-strut wing attachment 4002 having wing struts 4003 and wing extension 4004. Although not shown, connections to shoulder straps or permanent shoulder straps as shown in other embodiments may also be utilized with body surfing device 4000. Base 4001 has top surface 4001*a* and bottom surface 4001*b*. In use, top surface 4001*a* faces the user and bottom surface 4001*b* faces the water. Base 4001 also has front side 4001*c*, back side 4001*d*, right side 4001*e* and left side 4001*f*. In use, front side 4001*c* is the portion of base 4001 nearest a user's head and back side 4001*d* is the portion of base 4001 nearest a user's waist. In use, right side 4001*e* would be on a user's right side and left side 4001*f* would be on a user's left side.

Although not shown, separation members, similar to those shown and described with respect to FIG. 2, may be attached to top surface 4001*a* of base 4001. Base 4001 may include one or more hand grips (not shown) on all or a portion of left side 4001*f*, front side 4001*c*, and right side 4001*e* of base 4001.

Figure 71:
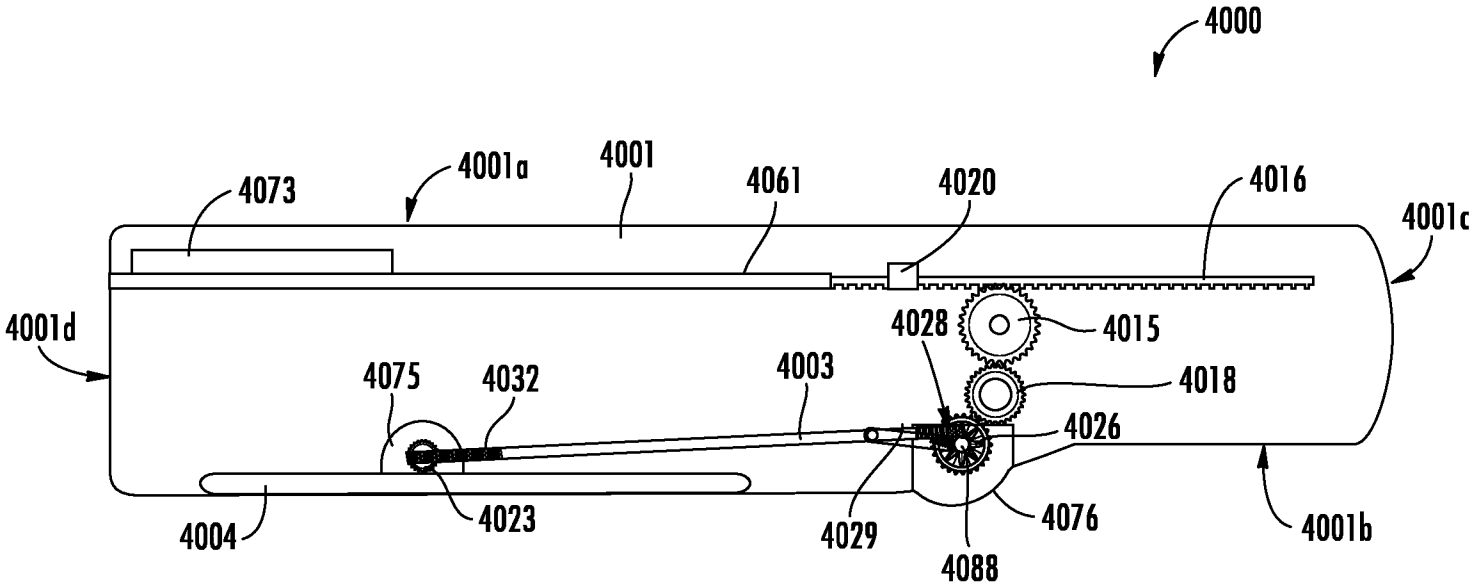
FIG. 71 is a cross-sectional view of the body surfing device of FIG. 69 with the leg fin in its retracted position and the wing attachment in its stowed position at line A-A of FIG. 69 according to an embodiment of the present invention.

Base 4001 includes a fin cavity in back side 4001*d* of base 4001, which is not illustrated, but would follow along the outside portion of leg fin 4061 in FIGS. 69 and 71. The fin cavity may include one or more tracks (not shown), which may be channels formed in the bottom of the cavity. The tracks may be located in various locations along the cavity wall and may vary in shape and size. Extendable leg fin 4061 may comprise one or more guides (not shown) positioned on its bottom side, which are in sliding communication with the tracks. The guides may be located in various locations about leg fin 4061 to correspond with the respective track. Extendable leg fin 4061 is shown in its extended position in FIGS. 70 and 72. Extendable leg fin 4061 may retract into a nested position within the cavity. Extendable leg fin 4061 in its nested position is illustrated in FIGS. 69 and 71. Extendable leg fin 4061 in its extended position act as a shelf to support the legs of the user and prevent the user's legs or a portion thereof from dragging in the water. The length of leg fin 4061 can vary. In embodiments, the length is of sufficient length to accommodate all or a substantial portion of the user's thigh.

Extendable leg fin 4061 may further comprise outer leg stops 4073 positioned on the top, outer sides of leg fin 4061. Outer leg stops 4073 can be used to prevent a user's legs from moving off of extendable leg fin 4061. In embodiments including outer leg stops 4073, a leg fin cavity (not shown) in bottom side 4001*b* of base 4001 is shaped in an accommodating manner to allow extendable leg fin 4061 to retract to a nested position. Outer leg stops 4073 can vary in shape and size. In embodiments having leg stops with more height, such as outer leg stops 4073 illustrated in the figures, leg stop slots 4074 in base 4001, which each extend from top surface 4001*a* through base 4001 to the cavity, allow extendable leg fin 4061 to retract into the cavity without impediment.

Deployable wing attachment 4002 includes wing struts 4003 and wing extension 4004, wing strut mounts 4075 (not illustrated in FIG. 70 for purposes of simplicity), and base strut mounts 4076 (not illustrated in FIG. 69 or 70 for purposes of simplicity). One end of each of wing struts 4003 rotatably attaches to bottom surface 4001*b* of base 4001 at respective base strut mounts 4076. The opposite end of each of wing struts 4003 rotatably attaches to the top surface of wing extension 4004 at respective wing strut mounts 4075. Each of wing strut mounts 4075 and base strut mounts 4076 can be formed of one or more elements. As shown here, each wing strut mount 4075 and each base strut mount comprises two elements. Wing strut mounts 4075 and base strut mounts 4076 allow rotation at the respective ends of wing struts 4064 allowing movement of wing attachment 4002 between a deployed position (as shown in FIGS. 70 and 72) and a stowed position (as shown in FIGS. 69 and 71). In its stowed position, wing extension 4004 is positioned within the base cavity located on bottom surface 4001*b* of base 4001. The base cavity is not illustrated, but would follow along the outside portion of wing extension 4004. The base cavity and wing extension 4004 can vary in shape and size. To prevent unnecessary drag, the base cavity and wing extension 4004 should be similar in shape and size.

Body surfing device 4000 may also include levers 4020, which may include handles 4021. Actuation of lever 4020 may be used to cause wing attachment to move between a deployed position and a stowed position and leg fin 4061 to move between an extended position and a retracted position. To allow ease of paddling by a user, handles 4021 and levers 4020 may be positioned under base 4001. In embodiments, handles 4020 and levers may be positioned just below hand grip (not shown). Handles 4021 and levers 4020 may be restricted such that they do not extend beyond the periphery (right side 4001*e* or left side 4001*f*) of base 1001 when they are not being actuated; during actuation all or a portion of handles 4021, and possibly portions of levers 4020, may extend beyond the periphery of base 4001. Movement of wing attachment 4002 between a deployed and stowed position and of leg fin 4061 between an extended and retracted position using levers 4020 can be achieved in a number of ways. An exemplary mechanism utilizing a series of gears is illustrated here. On the opposing sides of handles 4020, the opposing sides of which are located within base 4001, levers 4020 may be connected to leg fin 4061 or, as shown here, to gear racks 4016. As levers 4020 move from their forward position (as shown in FIGS. 70 and 72) to their rearward position (as shown in FIGS. 69 and 71), they cause gear racks 4016 to move longitudinally forward towards front side 4001*c* of base 4001 and also cause leg fin 4061 to move from an extended position to a retracted position. Gear racks 4016 are in communication with pinion gears 4015. As gear racks 4016 move forward, they cause pinion gears 4015 to rotate. Pinion gears 2015 are in communication with breakaway gear mechanism 4018. Breakaway gear mechanism may allow wing extension 4002 to move from a deployed position to a stowed position upon a predetermined force impacting wing extension 4004, such as may occur, for example, when a user in approaching the beach, moves too quickly into shallow waters and hits the sand at a high force. Such a safety release/retraction can prevent injury to body surfing device 4000 and, more importantly, to the user. Breakaway gear mechanisms 4018 are shown as single gear elements in the figures but may comprise multiple components. Rotation of pinion gears 4015 causes movement in breakaway gear mechanisms 4018, which may be rotation of one or more gears. Breakaway gear mechanisms 4018 are each in communication with base worm gears 4026. Movement of breakaway gear mechanisms 4018 causes rotation of base worm gears 4026. Struts 4003, which have base/strut worms 4028 at one end and strut/wing extension worms 4032 at the opposite end, are in communication with base worm gears 4026; more specifically, base/strut worms 4028 are in communication with the side faces of respective base worm gears 4026. Axels 4088, which are connected to respective base worm gears 4026 at the central axis of base worm gears 4026, are connected to an end of respective brackets 4029. The opposing ends of brackets 4029 are connected to strut 4003. Brackets 4029 rotate about respective axels 4088 and the connections to axels 4088 prevent lateral movement of respective brackets 4029. Strut/wing extension worms 4032 are in communication with the side faces of respective wing worm gears 4023. Wing worm gears 4023 are mounted within respective wing strut mounts 4075 at the central axis of wing worm gears 4023. Rotation of base worm gears 4026 causes rotational movement of strut 4003, which causes wing attachment 4003 to move between a deployed position and a stowed position.

A frame structure for body surfing devices 1000, 1060, 2000, and 3000 incorporating the moving components and the leg fin extension cavities can be manufactured using injection molding or other plastics manufacturing methods. That frame structure may then be transferred into another mold that forms polystyrene or other suitable buoyant foam material around the frame structure before skinning it with fiberglass or carbon fiber cloths or a soft semi rigid foam material. The frame structure could be manufactured as a common sized modular component containing the above defined single strut and hydrofoil wing or dual strut and hydrofoil wing and leg fins. These individual modules could be interchanged into different sized bases that are functional for different sized male or female users. Embodiments of the body surfing devices may comprise a module with a battery operated mini water-jet propulsion motor.

The combination of elements of each of the embodiments described herein should not be construed as limiting. Many of the elements of the embodiments described herein can be used in different combinations. For example, the base and back cover combination described with reference to FIGS. 1-2 and 4 could be combined with the extendable wing attachment described with reference to FIGS. 18-20 and 23-24. As another example, leg fins of FIG. 25 or rotating leg fins of FIGS. 18-23 could be added to the base of the body surfing devices 100, 150, 210, 300 or the leg fins of body surfing devices 500, 515, 520, 550, 570, 580, 600 could be replaced with rotating leg fins of FIGS. 18-23.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A body surfing device comprising:

a base having a bottom surface, wherein the bottom surface of base has a wing extension cavity and a strut cavity therein;

a wing strut having a first end and a second end, wherein the first end of the wing strut is in rotatable communication with the bottom surface of the base;

a wing extension in rotatable communication with the second end of the wing strut such that a top surface of the wing extension is substantially parallel to the bottom surface of the base, wherein the wing strut and wing extension are rotatable between a deployed position, wherein the wing strut is substantially perpendicular to the bottom surface of base and the top surface of the wing extension, and a stowed position, wherein the wing strut and the top surface of the wing extension are substantially parallel to the bottom surface of the base and the wing strut and the wing extension are nested in the wing strut cavity and the wing extension cavity, respectively;

a left leg fin cavity positioned in a back side of the base;

a right leg fin cavity positioned in the back side of the base;

a right leg fin positioned at least partially within the right leg fin cavity; and a left leg fin positioned at least partially within the left leg fin cavity.

2. The device of claim 1, further comprising:

a separation member positioned on a top surface of the base.

3. The device of claim 1, further comprising:

a secondary wing strut having a first end and a second end, wherein the first end of the secondary wing strut is in rotatable communication with the bottom surface of the base and the second end of the secondary wing strut is in rotatable communication with the wing extension.

4. The device of claim 3, further comprising:

a right leg outer stop protruding from a right side of the right leg fin; and a left leg outer stop protruding from a left side of the left leg fin.

5. The device of claim 3, further comprising:

a right leg inner stop protruding from a left side of the right leg fin; and a left leg inner stop protruding from a right side of the left leg fin.

6. The device of claim 3, wherein the right leg fin and the left leg fin are extendably connected to the base within the right leg fin cavity and left leg fin cavity, respectively, and each extends between an extended position and a retracted position.

7. The device of claim 6, wherein the right leg fin cavity comprises at least one right leg fin track and left leg fin cavity comprises at least one left leg fin track and the right leg fin slidingly engages with the at least one right leg fin track and the left leg fin slidingly engages with the at least one left leg fin track.

8. The device of claim 1, further comprising:

a right leg outer stop protruding from a right side of the right leg fin; and a left leg outer stop protruding from a left side of the left leg fin.

9. The device of claim 1, further comprising:

a right leg inner stop protruding from a left side of the right leg fin; and a left leg inner stop protruding from a right side of the left leg fin.

10. The device of claim 1, wherein the right leg fin and the left leg fin are extendably connected to the base within the right leg fin cavity and left leg fin cavity, respectively, and each extends between an extended position and a retracted position.

11. The device of claim 10, wherein the right leg fin cavity comprises at least one right leg fin track and left leg fin cavity comprises at least one left leg fin track and the right leg fin slidingly engages with the at least one right leg fin track and the left leg fin slidingly engages with the at least one left leg fin track.

12. The device of claim 10, further comprising:

a left lever extending from a first end positioned outside of the base and extending to a second end positioned inside the base, wherein the left lever is in communication with the wing strut, the left leg fin and the right leg fin;

a right lever extending from a first end positioned outside of the base and extending to a second end positioned inside the base, wherein the right lever is in communication with the wing strut, the left leg fin and the right leg fin; and wherein actuation of the left lever and right lever cause the wing strut and the wing extension to move between the deployed position and the stowed position and the left leg fin and the right leg fin to move between the extended position and the retracted position.

13. The device of claim 10, further comprising:

a left handle slot positioned in a top surface of the base;

a right handle slot positioned in the top surface of the base;

a left slide handle in communication with left leg fin and extending at least partially through the left handle slot;

a right slide handle in communication with the right leg fin and extending at least partially through the right handle slot;

wherein the left leg fin and the right leg fin are in communication with the wing strut; and wherein actuation of the left slide handle and right slide handle causes the wing strut and wing extension to move between the deployed position and the stowed position and the left leg fin and the right leg fin to move between the extended position and the retracted position.

14. A body surfing device comprising:

a base having a bottom surface, wherein the bottom surface of base has a wing extension cavity and a strut cavity therein;

a wing strut having a first end and a second end, wherein the first end of the wing strut is in rotatable communication with the bottom surface of the base;

a wing extension in rotatable communication with the second end of the wing strut such that a top surface of the wing extension is substantially parallel to the bottom surface of the base, wherein the wing strut and wing extension are rotatable between a deployed position, wherein the wing strut is substantially perpendicular to the bottom surface of base and the top surface of the wing extension, and a stowed position, wherein the wing strut and the top surface of the wing extension are substantially parallel to the bottom surface of the base and the wing strut and the wing extension are nested in the wing strut cavity and the wing extension cavity, respectively;

a left lever extending from a first end positioned outside of the base and extending to a second end positioned inside the base, wherein the left lever is in communication with the wing strut;

a right lever extending from a first end positioned outside of the base and extending to a second end positioned inside the base, wherein the right lever is in communication with the wing strut; and wherein actuation of the left lever and the right lever cause the wing strut and the wing extension to move between the deployed position and the stowed position.

15. A body surfing device comprising:

a base having a bottom surface, wherein the bottom surface of base has a wing extension cavity and a strut cavity therein;

a wing strut having a first end and a second end, wherein the first end of the wing strut is in rotatable communication with the bottom surface of the base;

a wing extension in rotatable communication with the second end of the wing strut such that a top surface of the wing extension is substantially parallel to the bottom surface of the base, wherein the wing strut and wing extension are rotatable between a deployed position, wherein the wing strut is substantially perpendicular to the bottom surface of base and the top surface of the wing extension, and a stowed position, wherein the wing strut and the top surface of the wing extension are substantially parallel to the bottom surface of the base and the wing strut and the wing extension are nested in the wing strut cavity and the wing extension cavity, respectively;

a leg fin cavity positioned in a back side of the base; and a leg fin positioned at least partially within the leg fin cavity.

16. The device of claim 15, further comprising:

a right leg outer stop protruding from a right side of the leg fin; and a left leg outer stop protruding from a left side of the leg fin.

17. The device of claim 15, wherein the leg fin is extendably connected to the base within the leg fin cavity and extends between an extended position and a retracted position.

18. The device of claim 17, wherein the fin cavity comprises at least one fin track and the leg fin slidingly engages with the at least one leg fin track.

19. The device of claim 17, further comprising:

a left lever extending from a first end positioned outside of the base and extending to a second end positioned inside the base, wherein the left lever is in communication with the wing strut and the leg fin;

a right lever extending from a first end positioned outside of the base and extending to a second end positioned inside the base, wherein the right lever is in communication with the wing strut and the leg fin; and wherein actuation of the left lever and right lever cause the wing strut and the wing extension to move between the deployed position and the stowed position and the leg fin to move between the extended position and the retracted position.

20. The device of claim 17, further comprising:

a left handle slot positioned in a top surface of the base;

a right handle slot positioned in the top surface of the base;

a left slide handle in communication with the leg fin and extending at least partially through the left handle slot;

a right slide handle in communication with the leg fin and extending at least partially through the right handle slot;

wherein the leg fin is in communication with the wing strut; and wherein actuation of the left slide handle and right slide handle causes the wing strut and wing extension to move between the deployed position and the stowed position and the leg fin to move between the extended position and the retracted position.

21. The device of claim 15, further comprising:

a secondary wing strut having a first end and a second end, wherein the first end of the secondary wing strut is in rotatable communication with the bottom surface of the base and the second end of the secondary wing strut is in rotatable communication with the wing extension.

22. The device of claim 21, further comprising:

a right leg outer stop protruding from a right side of the leg fin; and a left leg outer stop protruding from a left side of the leg fin.

23. The device of claim 21, wherein the leg fin is extendably connected to the base within the leg fin cavity and extends between an extended position and a retracted position.

24. The device of claim 23, wherein the fin cavity comprises at least one fin track and the leg fin slidingly engages with the at least one leg fin track.

25. The device of claim 23, further comprising:

a left lever extending from a first end positioned outside of the base and extending to a second end positioned inside the base, wherein the left lever is in communication with the wing strut, the secondary wing strut and the leg fin;

a right lever extending from a first end positioned outside of the base and extending to a second end positioned inside the base, wherein the right lever is in communication with the wing strut, the secondary wing strut and the leg fin; and wherein actuation of the left lever and right lever cause the wing strut, the secondary wing strut and the wing extension to move between the deployed position and the stowed position and the leg fin to move between the extended position and the retracted position.

26. The device of claim 23, further comprising:

a left handle slot positioned in a top surface of the base;

a right handle slot positioned in the top surface of the base;

a left slide handle in communication with the leg fin and extending at least partially through the left handle slot;

a right slide handle in communication with the leg fin and extending at least partially through the right handle slot;

wherein the leg fin is in communication with the wing strut and the secondary wing strut; and wherein actuation of the left slide handle and right slide handle causes the wing strut, the secondary wing strut and the wing extension to move between the deployed position and the stowed position and the leg fin to move between the extended position and the retracted position.

* * * * *